US005915146A

United States Patent [19]

Kusaka et al.

[11] Patent Number: 5,915,146

[45] Date of Patent: Jun. 22, 1999

[54] IMAGE HEATING APPARATUS WITH MULTIPLE TEMPERATURE DETECTING MEMBERS

[75] Inventors: Kensaku Kusaka, Kawasaki; Tsuyoshi Watanabe, Ebina; Hisaaki Senba, Yokohama; Koji Masuda, Yokohama; Takeo Yamamoto, Yokohama, all of Japan

[73] Assignee: Canon Kabushiki Kaisha, Tokyo, Japan

[21] Appl. No.: 08/226,369

[22] Filed: Apr. 12, 1994

Related U.S. Application Data

[63] Continuation of application No. 07/949,229, Sep. 23, 1992, abandoned.

[30] Foreign Application Priority Data

| | | | |
|---|---|---|---|
| Sep. 24, 1991 | [JP] | Japan | 3-243300 |
| Sep. 24, 1991 | [JP] | Japan | 3-243301 |
| Sep. 24, 1991 | [JP] | Japan | 3-243302 |
| Nov. 13, 1991 | [JP] | Japan | 3-326351 |

[51] Int. Cl.[6] ..... G03G 15/20

[52] U.S. Cl. ..... 399/68; 219/216; 399/329

[58] Field of Search ..... 355/206, 282, 355/285, 289, 290; 219/216; 399/68, 320, 329, 335

[56] References Cited

U.S. PATENT DOCUMENTS

| | | | |
|---|---|---|---|
| 4,001,545 | 1/1977 | Wada et al. | 219/216 |
| 4,301,359 | 11/1981 | Ito et al. | 219/216 X |
| 4,540,267 | 9/1985 | Moser | 219/216 X |
| 4,585,325 | 4/1986 | Euler | 355/290 |
| 5,043,763 | 8/1991 | Koh et al. | 355/206 |
| 5,115,279 | 5/1992 | Nishikawa et al. | 355/290 |
| 5,170,215 | 12/1992 | Pfeuffer | 355/285 |
| 5,171,969 | 12/1992 | Nishimura et al. | 355/285 X |
| 5,182,606 | 1/1993 | Yamamoto et al. | 355/289 |
| 5,196,675 | 3/1993 | Suzuki et al. | 355/285 X |
| 5,204,723 | 4/1993 | Hanada et al. | 355/285 |
| 5,289,247 | 2/1994 | Takano et al. | 355/285 |
| 5,303,015 | 4/1994 | Sato | 355/285 |

FOREIGN PATENT DOCUMENTS

| | | |
|---|---|---|
| 0372479 | 6/1990 | European Pat. Off. . |
| 426072 | 5/1991 | European Pat. Off. . |
| 3917773 | 12/1989 | Germany . |
| 57-102676 | 6/1982 | Japan . |
| 57-211180 | 3/1983 | Japan . |
| 61-201284 | 9/1986 | Japan . |
| 61-204668 | 9/1986 | Japan . |
| 63-313182 | 12/1988 | Japan . |
| 2157878 | 6/1990 | Japan . |

*Primary Examiner*—Fred L. Braun

*Attorney, Agent, or Firm*—Fitzpatrick, Cella, Harper & Scinto

[57] ABSTRACT

An image heating apparatus includes a heater which heats an image on a recording material, which extends in a direction perpendicular to a moving direction of the recording material; a first temperature detecting member for detecting the temperature of the heater; power controlling device for controlling the power supplied to the heater, so that the temperature detected by the temperature detecting member remains constant; a second temperature detecting member which is positioned at a location apart, in the longitudinal direction of the heater, from where the first temperature detecting member is positioned; and an interrupting device for interrupting the imaging heating process in accordance with the temperature detected by the second temperature detecting member.

1 Claim, 34 Drawing Sheets

IMAGE HEATING APPARATUS WITH MULTIPLE TEMPERATURE DETECTING MEMBERS

This application is a continuation division, of application Ser. No. 07/949,229, filed Sep. 23, 1992, now abandoned.

FIELD OF THE INVENTION AND RELATED ART

This invention relates to an image heating apparatus to heat an image on recording material, in particular, the image heating device to be preferably adopted in an apparatus in which the unfixed image on the recording material is fixed by heat.

The image heating device in wide use for thermally fixing the unfixed image or improving the surface properties of the image is of a heating roller type in which the recording material carrying the image is pressed through a nip formed between a heating roller and a pressing roller.

In such a heating roller type, the thickness of the core metal in the heating roller is reduced to increase the rising speed of the temperature of the heating roller.

In Japanese Laid-Open Patent Applications Nos. 313182/1988 and 157878/1990, a thermal fixing device is disclosed which employs a low heat capacity thermal head and a strip of film which slides on the surface of this thermal head.

This thermal fixing device has a heat generating conductive layer extending in the direction perpendicular to the moving direction of the recording material, wherein electricity is made to flow through the entire region of the heat generating conductive layer regardless of the recording material size.

In this type of image heating device, which employs the heating roller with an extremely thin core metal, or a thermal head, the temperature increases in the region outside the recording material passage increases.

In particular, if recording material with a width smaller than the largest one is continuously passed, the temperature increase becomes larger in the region outside the recording material passage.

If this temperature increase in the region outside the recording material passage becomes excessive, the function of the image heating device becomes abnormal and deteriorates, and in the worst case, the image heating device is damaged.

Further, in the image heating device which employs the above mentioned film, the film begins to wrinkle or snake because of the large temperature difference between the regions within and outside the recording material passage.

SUMMARY OF THE INVENTION

A principal object of the present invention is to provide an image heating device in which the temperature increase is prevented in the region outside the recording material passage.

Another object of the present invention is to provide an image heating device in which the film is prevented from developing wrinkles or snaking.

A further object of the present invention is to provide an image heating device in which multiple temperature detecting members are positioned at different locations along the heating element in its longitudinal direction.

A yet further object of the present invention will be made apparent through the following descriptions.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
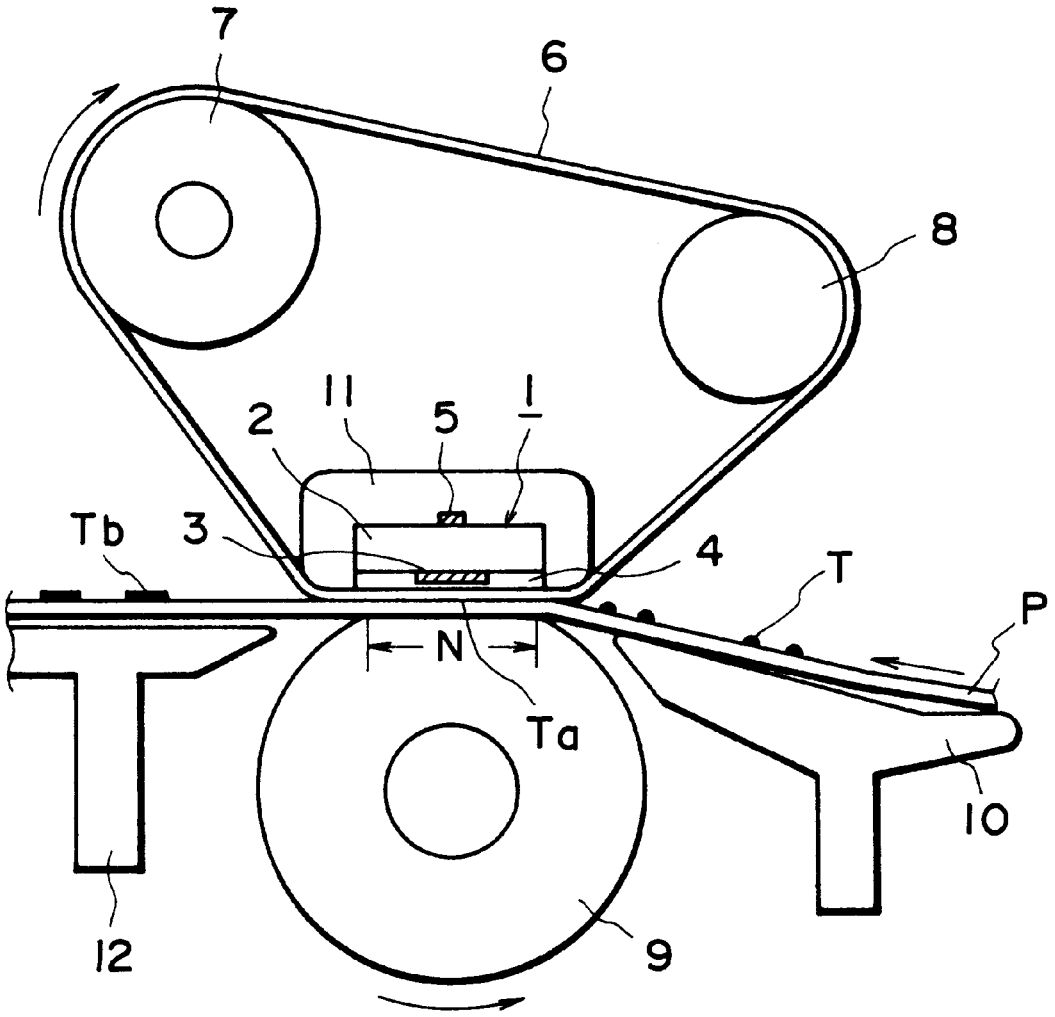
FIG. 1 is a sectional view of an image fixing device in accordance with an embodiment of the present invention.

Hereinafter, the embodiments of the present invention are described, referring to the drawings.

Figure 2:
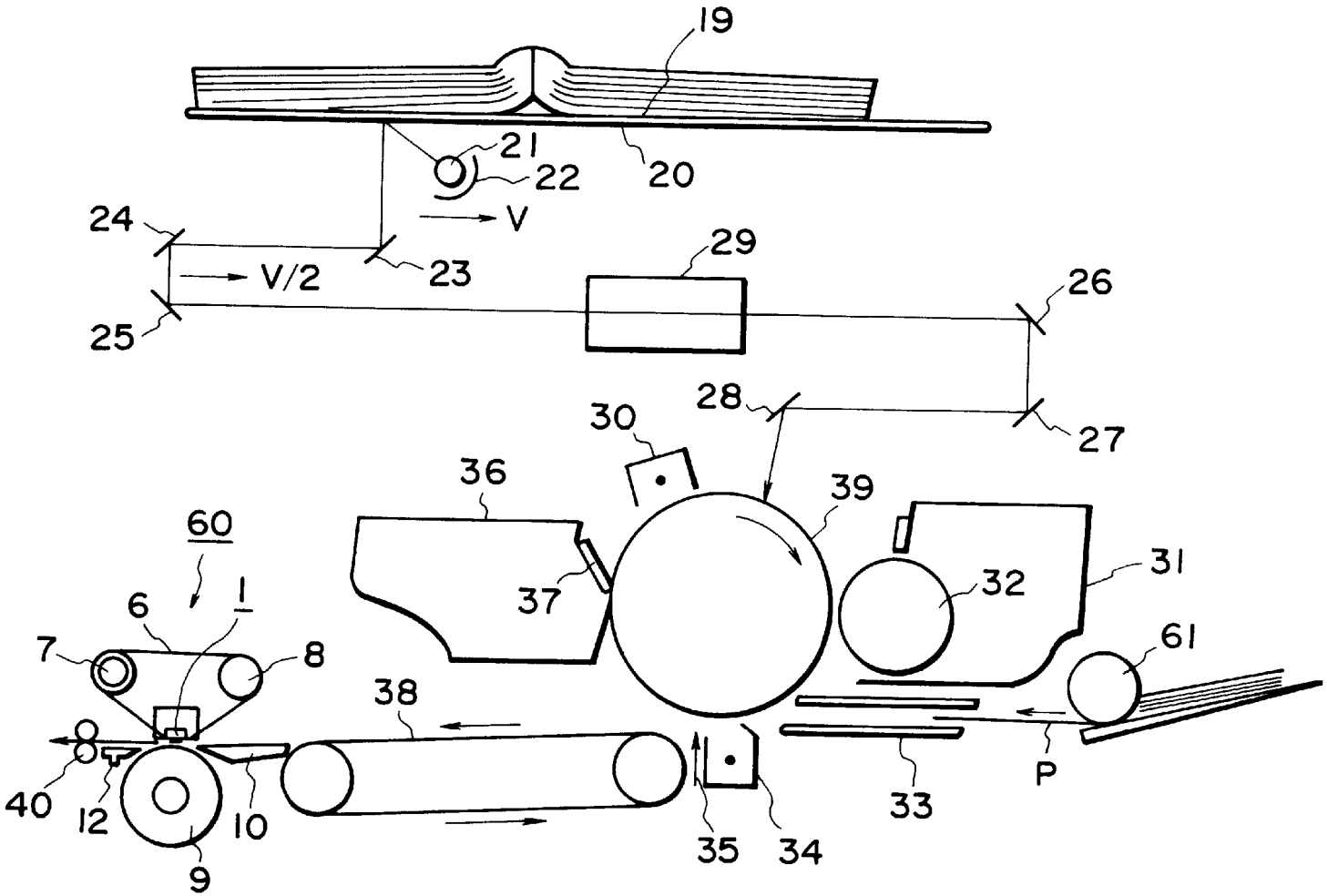
FIG. 2 is a sectional view of an image forming apparatus which employs the device presented in FIG. 1.

FIG. 2 shows the structural outline of an example of image forming apparatus which employs a fixing device 60 in accordance with an embodiment of the present invention.

This image forming apparatus is a transfer type electronographic copying machine in which a stationary original holder, a moving optical system, and a rotatable drum are employed.

An original 19 is laid, as required, on a stationary original supporting platen glass 20. After relevant copying conditions are set, a copy start key is pressed. Then, a photosensitive drum 39 is rotatively driven at a predetermined peripheral velocity in the clockwise direction indicated by an arrow.

A light source 21 (22 is a reflective shade) and the first mirror 23 moves along the bottom surface of the original supporting glass 20 from the left side home position toward the right side end of the glass at a predetermined speed of V, and a second mirror 24 and a third mirror 25 move in the same direction at a speed of V/2, whereby the downward facing image surface of an original 19 laid on the original supporting glass 20 is optically scanned left to right, and the optical scanning light reflected from the original surface travels through fourth 26, fifth 27, and sixth 28 mirrors, which are stationary, and are imaged on the surface of the rotating photosensitive drum 39, exposing the surface in a slit.

Before this exposure, the surface of the rotating photosensitive drum 39 is uniformly charged to a predetermined positive or negative potential by a primary charger 30, and as this charged surface is exposed in the above mentioned manner, an electrostatic latent image which corresponds to the original image is formed line by line on the surface of the drum 39. The electrostatic image formed on the surface of the photosensitive drum 39 is visualized as a toner image by a developing roller 32 in a developing device 31.

Meanwhile, a transfer sheet P, which is the recording material, is fed by a feed roller 61, and conveyed through a guide 33, to be introduced at a predetermined timing into a transfer section between the drum 39 and a transfer charger 34, where it is subjected to the transfer corona and contacts the drum 39, whereby the visualized toner image on the surface of the drum 39 is transferred line by line onto the surface of the sheet P.

After passing through the image transfer section, the sheet P is gradually separated from the drum 39 surface by being exposed to discharging needles 35 which removes the back side charge; is introduced, by a conveyer 38 and an entrance guide 10, into the fixing device 60, where the toner image is fixed as will be described later; and is discharged, as a copy or print, out of the machine by a discharge guide 12 and a pair of discharge rollers 40.

The surface of the drum 39 is cleaned by a cleaning blade 37 of a cleaner 36, to remove the contaminants such as residual toner, so that it is repeatedly used for image formation.

When the moving optical members 21 to 25 reach a predetermined destination point, their moving directions are switched to the returning ones, whereby they return to the initial home position where they wait for the beginning of the next copying cycle (returning step of optical system).

Figure 3:
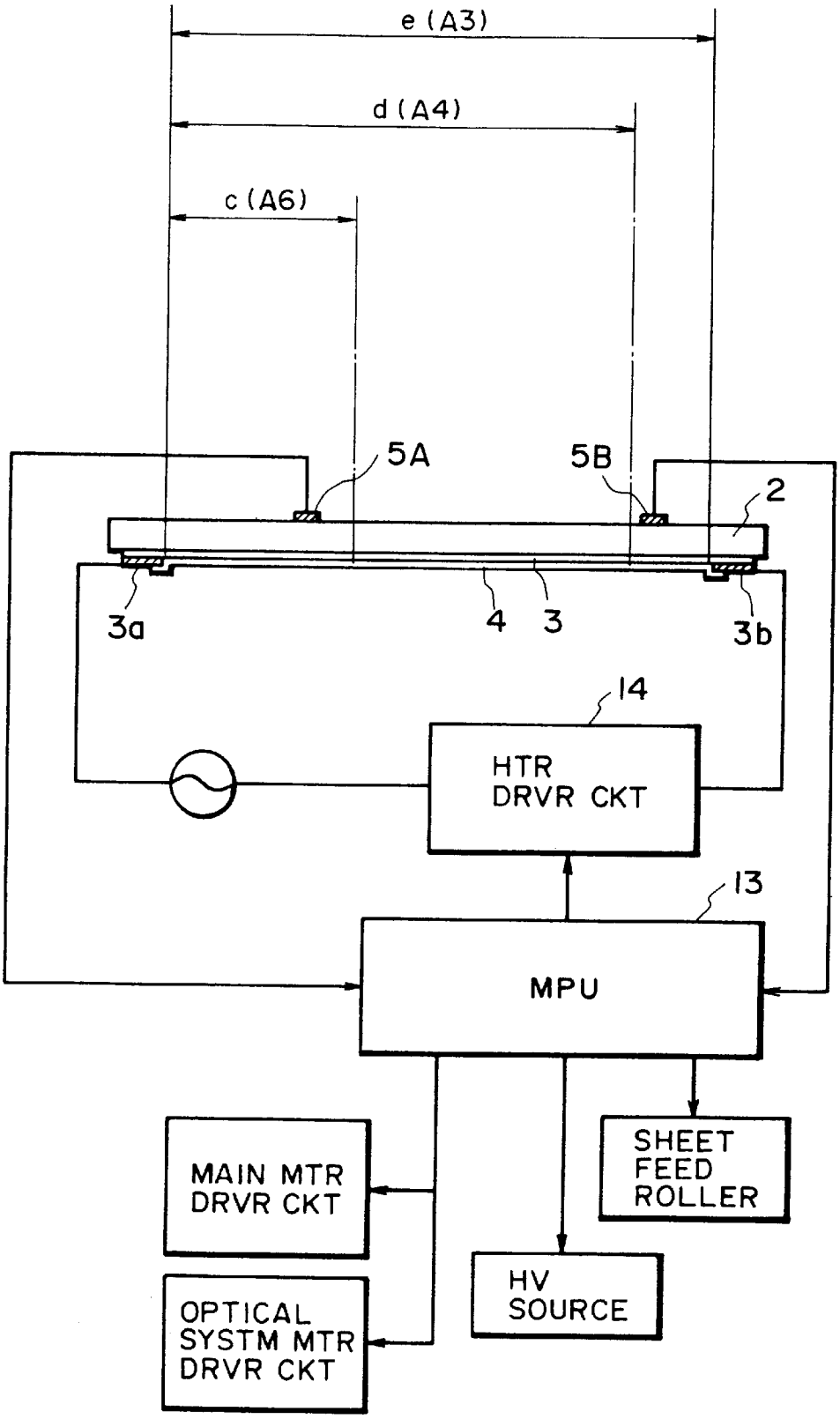
FIG. 3 is a side view of a heater in accordance with the embodiment presented in FIG. 1.

If the copy count is selected to be more than one, for example 100 copies, before the copy start key is depressed, the above mentioned steps are repeated with predetermined intervals by a microcomputer MPU shown in FIG. 3, to form images consecutively after the returning step of the optical system ends.

Next, the fixing device 60 is described, which is the image heating device in accordance with the embodiment of the present invention.

FIG. 1 is a sectional side view of the fixing device 60.

Reference numeral 6 refers to a fixing film which forms an endless belt, and is stretched, over and around, and supported by, the three members 7, 8, and 1: driving roller 7 which is positioned on the left side and rotatively drives the fixing film, a follower roller 8 which is positioned on the right side and rotates by following the rotation of the fixing film, and a low heat capacity linear heater 1 which is fixedly positioned below the mid point between both rollers 7 and 8.

The follower roller 8 doubles as a tension roller which provides tension to stretch outward the fixing film 6.

The surface of the driving roller 7 is covered with a layer of rubber, such as silicon rubber, to increase its friction coefficient, and as it is rotated in the clockwise direction, the fixing film 6 is rotatively driven in the clockwise direction at a predetermined velocity, without wrinkling, snaking, and delaying.

Reference numeral 9 refers to a pressing roller which is a pressing means for providing pressure between the heater, fixing film, and recording material, and has an elastic layer of rubber with excellent parting properties, such as silicon rubber. This pressing roller 9 is pressed on the bottom surface of the heater 1 by a pressing means such as a spring, generating total contact pressure of, for example, 5 kg to 10 kg, and rotates in the counterclockwise direction in the drawing, that is, the conveying direction of the sheet P, while sandwiching the endless belt of the fixing film 6, in conjunction with the heater 1.

Since the rotatively driven endless fixing film 6 is repeatedly used for thermally fixing the toner image, it must excel in heat resistance, parting properties, and durability, and generally speaking, film with a thickness less than 100 μm, preferably less than 40 μm, is employed for this purpose. An example is an endless belt with an overall thickness of 30 μm which comprises a thin endless base belt with a thickness of 20 μm, and a 10 μm thick layer of a coat with parting properties. The base film is made of highly heat resistant resin such as polyimide, polyether imide, polyether sulfone, polyether ether ketone or the like; or metal such as nickel, SUS; or the like. The coat layer on the outer peripheral surface of this endless film is made of resin with low surface energy, such as PTFE (polytetrafluoroethylene resin), PFA, or the like; or the same resin with conductive additive such as carbon black.

The low heat capacity heater 1 comprises a substrate 2 with excellent thermal conductivity, exothermic layer 3, and protective layer 4. The substrate 2 is a piece of aluminum measuring 1.0 mm thick, 10 mm wide, and 340 mm long, for example; the exothermic layer 3 is formed of resistive material, such as silver-palladium, ruthenium oxide, or the like, which is coated on the substrate 2 to a thickness of 10 μm and a width of 1.0 mm; and the protective layer 4 is formed over the exothermic layer 3, and is made of 10 μm thick glass or the like, in consideration of its sliding contact with the film 6.

The heater 1 is fixedly supported on a heater mount 11.

The heater mount 11 has thermally insulating property, high heat resistance, and high rigidity, so that it can support the heater 1 in the image forming apparatus in a thermally insulated manner. It is made of highly heat resistant resin, such as PPS (polyphenylene sulfide), PEEK (polyether ether ketone), or liquid crystal polymer; or compound material of these resins and ceramic, metal, or the like.

The power is applied through both of the longitudinal ends of an exothermic layer 3 of the heater 1.

The power is an alternating current with a voltage of 100 V, and is controlled by a microcomputer MPU 13 (FIG. 3) in such a way that the temperature detected by a temperature sensor 5 such as an NTC thermistor is maintained at a predetermined constant degree. The temperature sensor 5 is glued with a thermally conductive adhesive such as silicon adhesive, is pressure-welded, or is integrally formed, on the back surface of the substrate 2.

FIG. 3 is a side view of the heater 1, being seen from the sheet feeding side. The exothermic layer 3 which generates heat through power application is formed on the bottom surface of the substrate 2, approximately in the middle, in a straight line, and in the longitudinal direction of the substrate. Reference numerals 3*a* and 3*b* refer to electrodes (input terminals) of electrically conductive material such as silver, which are provided at both left and right ends, respectively, of this exothermic layer 3.

Reference code e stands for the range between the electrodes 3*a* and 3*b*, which is the entire effective range of the heating layer 3, and in case of this embodiment, its length is established to correspond to A3 (297 mm wide), the largest transfer sheet that can be fed through the apparatus.

In the image forming apparatus shown in FIG. 2, a line (I) on the left end of the exothermic layer 3 in FIG. 3 is used as the reference line. That is, the transfer sheets of various sizes are fed on the basis of a single side reference.

A sheet passage range c for the A6 size (105 mm wide) is the sheet passage range for the recording material of the smallest size which can be accommodated by the image forming apparatus presented in FIG. 2.

A reference numeral 5A refers to a thermistor, which is a temperature sensor provided within the smallest sheet passage range.

During the fixing operation, the MPU 13 controls a heater driving circuit 14, thereby controlling the power supplied to the exothermic layer 3, so that the output detected by the thermistor 5A takes a predetermined constant value.

A reference numeral 5B is a thermistor, which is a temperature sensor provided outside the smallest sheet passage range, and in this embodiment, it is positioned within the largest sheet passage range e, as well as outside the sheet passage range d for A4 size (257 mm wide).

Next, the fixing operation is described with reference to the first sheet.

The image forming apparatus is started by an image formation start signal to carry out the image forming operation, and with a predetermined timing, it begins to start the rotation of the fixing film 6, as well as to supply the power to the heater 1.

The transfer sheet P, the recording material, which carries the unfixed toner image T on its upper surface, is conveyed from a transfer section 34 to the fixing device 60. The sheet P is guided by the entrance guide 10, to enter the nip N formed between the heater 1, the temperature of which will have quickly reached a predetermined fixing temperature, and the pressing roller, where it is firmly pressed on the fixing film 6, with the unfixed toner facing the heater.

The sheet P passes through the fixing nip N between the heater 1 and the pressing roller 9, without sustaining surface deviation or wrinkles, while being flatly and firmly laid on the moving fixing film 6 and subjected to the compressive force of the nip N.

While the sheet P passes through the fixing nip N, the surface of the sheet P which carries the toner image is pressed against the surface of the fixing film, where it receives the heat from the exothermic layer 3 through the fixing film 6, and the toner image is melted by the high temperature and fused onto the surface of sheet P, forming Ta.

In the case of this embodiment, the sheet P, which is the recording material, is separated from the fixing film 6 when the sheet P comes out of the fixing nip N.

At this time of separation, the temperature of the melted toner Ta remains higher than the glass transition point.

At this point of separation, since the toner Ta with a temperature higher than the glass transition point has a proper amount of elastic property, the toner image surface turns out to have a proper amount of irregularity, without conforming flatly to the fixing film surface, and since this surface property is retained while the toner Ta is cooled and hardened, no excessive gloss develops on the surface of the fixed toner image, offering thereby a high quality appearance.

The sheet P separated from the fixing film 6 is guided by the discharge guide 12 to the discharge roller pair 40. Meanwhile, the temperature of the toner Ta which is higher than the glass transition point naturally drops (natural cooling) to a point below the glass transition point, allowing the toner Ta to harden to form a toner Tb, and then, the sheet P with the fixed toner image is outputted.

Next, an operational sequence for the continuous imaging forming operation is described.

Figure 4:
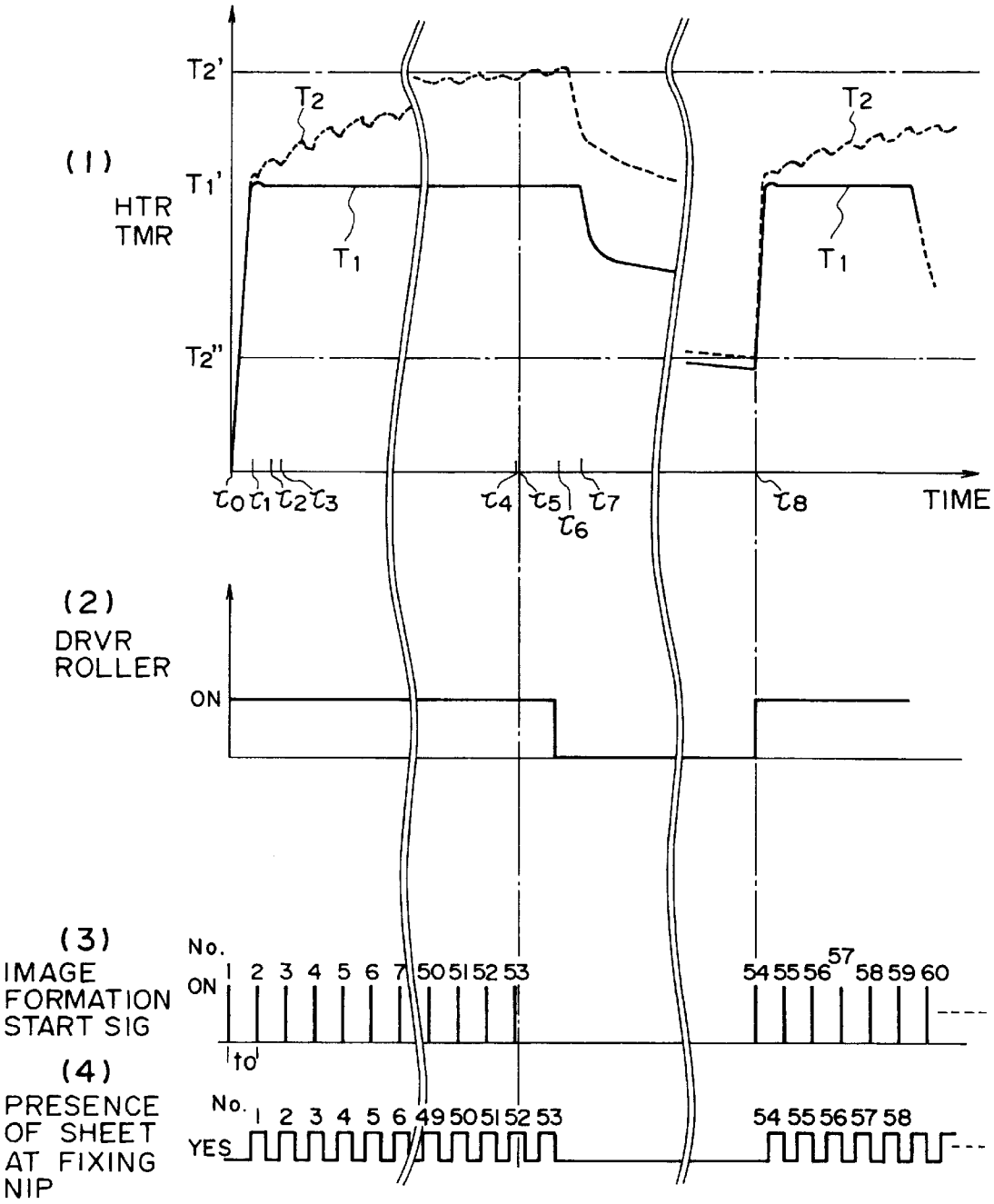
FIG. 4 is an operational timing chart for the embodiment of the present invention.

FIG. 4 is a graph showing the case in which a copy count of more than one (for example 100 copies) is selected before the copy start key is depressed. In this graph, two timing cues, that is, one for the timing at which the image formation start signal is turned on, and the other for the timing at which the sheet P passes through the fixing nip N ("present" means that the sheet P is passing, and "absent" means that it is not passing), and time-based changes of temperature T1 detected by the first thermistor 5A, and temperature T2 detected by the second thermistor 5B, are plotted together on the same time-axis.

The image formation start signal in this embodiment is a signal outputted from the microcomputer MPU 13, to control the operations of the unshown clutch which controls the movement of the feed roller 61 and the light sources 21 and 22, and initiates the image forming operation.

Incidentally, in this embodiment, B4 size (257 mm wide) sheets, which has a basis weight of 80 g/m$^2$, are passed at a speed of 100 mm/sec. Also, in this embodiment, the power is supplied to the heater 1 in a way to correspond to the value of T1, so that the temperature T1 detected by the first thermistor 5B is maintained at a predetermined constant fixing temperature T1' (for example, 190° C.). As soon as the copy key is depressed at a time $\tau_0$, the image formation start signal is transmitted by the MPU 13 to each section of the image forming apparatus, and for example, the feed roller 61 begins to rotate to convey the sheet P toward the transfer charger 34. Also, at the same time of $\tau_0$, the rotation of the fixing film 6 in the fixing device, and the power for the heater 1, are initiated.

At a time $\tau_1$, the B4 wide sheet P reaches a fixing point P, but the temperatures T1 and T2 detected by the thermistors increase in advance from room temperature to the temperature T1' at approximately the same speed. While the sheet P passes through the nip N, the temperature reaches a point where T1=T2, but T2 climbs higher than T1' because of so-called non-passage region heat accumulation.

The sheet passes through the nip N after staying for a period of $t_c=\tau_2-\tau_1$).

The image formation signal for the second sheet is issued from the MPU 13 after a duration of $t_0$ (for example 5 second) since the copy key was depressed, whereby the sheet P is fed. Then, the second sheet enters the nip N at a time $\tau_3$, with an interval having a predetermined duration of $t_i$ after the first sheet passes the nip N. From this point on, the above mentioned procedure is repeated for a while.

The temperature T2 detected by the second thermistor rises during the sheets passage, and falls during the interval having the duration of ti. However, in macro terms, it gradually climbs.

Soon after the image formation signal which corresponds to the 53rd sheet is issued at a time $\tau_4$, the temperature T2 detected by the second thermistor 5B reaches a predetermined temperature T2' (240° C. in this embodiment) at a time $\tau_5$ when the 52nd sheet P is passing through the fixing nip N.

If the temperature of the non-passage region increases as described above, and the temperature detected by the second thermistor 5B in the non-passage region reaches T2' which is 50° C. higher than the fixing temperature T1, the microcomputer MPU 13 interrupts the fixing operation.

That is, the image formation signal is not issued even after an elapse of the duration of t0 from the time $\tau_4$. The power supplied to the heater 3 is stopped at a time $\tau_6$ when the 53rd sheet P is detected by an unshown sensor after passing through the nip N at a speed of Vp while being exposed to the fixing process. Then, slightly afterward (approximately 0.3 second to 10 seconds), the rotation of the driving roller 7 is stopped at a time $\tau_7$; therefore, the movement of the fixing film is stopped. Since there is a chance that the fixing film 6 might stick to the pressing roller 9 due to the heat if the movement of the fixing film 6 is stopped at the same time as the power supplied to the heater 3 is stopped (at the time $\tau_6$), the fixing film 6 and pressing roller 9 are idled for a short period from the time $\tau_6$ to the time $\tau_7$, without being heated, before they are stopped. Incidentally, if there is no chance of heat adhesion between the fixing film 6 and pressing roller 9 because of such a reason as the temperature T2' being sufficiently low, $\tau_7$ and $\tau_6$ may be selected as being the same time.

If the temperature detected by the second thermistor exceeds T2, the microcomputer MPU 13 exhibits a display indicating "wait" on an unshown display panel after completing the fixing process for the sheet P which is being processed at this moment. While this display is exhibited, no key input from an operator is accepted.

Further, if the power source of the apparatus main assembly is turned off at this time, the status of "wait" is stored in the MPU 13.

When the power source is turned on next time, if the temperature T2 detected by the second thermistor reaches a point where T2>T2" (T2" is 50° C. in this embodiment), "wait" is restored.

After the interruption of the fixing operation, T2 drops to T2" at a time $\tau_8$.

At this time, the temperature T2 within the non-passage region and the temperature T1 within the passage region become approximately equal because of the heat radiation from the heater 1 and the heat conduction in the longitudinal direction of the heater 1.

If the temperature reaches a point where T2≦T2" at the time $\tau_8$, the microcomputer 13 cancels the commands for the display indicating the "wait," and the interruption of the fixing operation; therefore, the image formation start signal for the 54th sheet is automatically issued from the MPU 13 to restart the image forming operation. From then on, the image forming and fixing processes are continued to finish a total of 100 sheets.

However, if T2 happens to exceed T2' again after the 54th sheet, the interruption process takes over in the above mentioned manner, and the operation is restarted when the temperature cools down to a point where T2≦T2" again.

COMPARATIVE EXAMPLE

The fixing process was continued after the temperature T2 detected by the second thermistor 5B exceeded T2'.

After the 100th sheet, the temperature reached a point where T2=260° C.

Then, the film laterally shifted toward the side with a higher temperature, damaging its edge.

Further, after this procedure of continuously making 100 copies was repeated 20 times (total of 2,000 copies), the occurrence of damage was observed on the coating of the fixing film.

EMBODIMENT 2

The temperature T2", at which the interruption of the fixing operation is canceled in the above mentioned first embodiment, is made variable.

When the temperature reaches a point where T2≧T2' more than once during a single continuous copying procedure, the wait period is introduced each time, and each time the waiting period is introduced, the wait canceling temperature T2" is changed. That is, the following wait canceling temperature was made lower than the preceding one.

During the continuous copying procedure, since the neighboring area of the heater 1 is warmed up to a higher temperature during the second wait period than the first one, it takes less time for T2 to reach a point where T2≧T2' if the wait canceling temperature is kept the same.

Therefore, the number of wait periods can be reduced by setting the second wait canceling temperature lower than the first one.

Further, the wait canceling temperature may be adjusted corresponding to the number of copies yet to be made at the time when T2 reaches a point where T2≧T2'. In other words, the wait canceling temperature is raised if the number of copies yet to be made is less than a predetermined one.

Also, the wait canceling temperature T2" is changed in response to the rising speed of the temperature T2. In practical terms, if T2 reaches a point where T2≧T2' while the nth copy is processed, the larger the value of n is, the higher the wait canceling temperature is going to be set.

In this manner, the waiting period can be shortened without inflicting damage on the device or increasing the frequency of the wait processes.

EMBODIMENT 3

During the period from $\tau_6$ to $\tau_8$, which is the period when the fixing operation is interrupted, it is preferable for the heat radiation from the heater to be large.

Therefore, in this embodiment, the pressure applied on the heater 3 by the pressing roller 9 is reduced or released by an unshown pressure release means such as a solenoid, at a predetermined time during the period between $\tau_6$ and $\tau_7$.

Then, at the time $\tau_8$ when the fixing operation is restored from the interruption, the state of pressure is restored to the initial one.

In this manner, the heat radiation from the heater is enhanced; therefore, the wait period can be shortened.

EMBODIMENT 4

Figure 5:
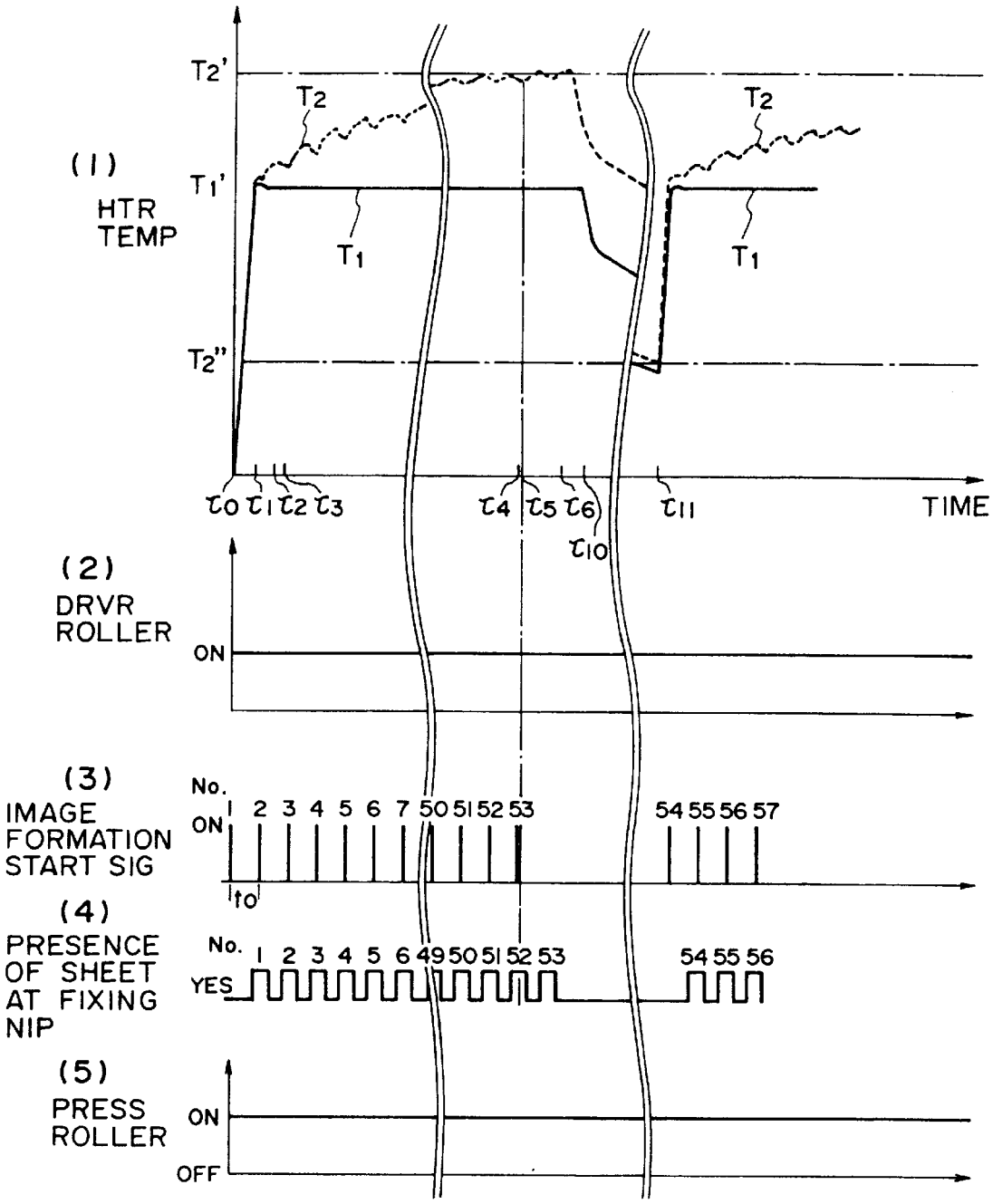
FIG. 5 is an operational timing chart for another embodiment of the present invention.

FIG. 5 shows a timing chart for the fourth embodiment.

At the time $\tau_5$, the temperature T2 detected by the second thermistor 5B reaches a point where T2≧T2', and at the time $\tau_6$, the power supplied to the heater 3 is stopped; the "wait" display is given; and the image forming operation, including the fixing process, is interrupted.

Even during this wait period, the driving roller 7 is kept rotating to keep the fixing film 6 running.

The roller 9 also keeps on rotating, following the fixing film 6.

At a time $\tau_9$, T2 reaches a point where T2≦T2", when the image forming operation is restarted.

Since the convectional heat radiation is enhanced by the rotation of the fixing film 6 and pressing roller 9, the heater temperature drops faster. Therefore, the wait period can be shortened. Further, since the fixing film 6 and pressing roller 9 are not compressed to each other under the high temperature condition while standing still, adhesion and such caused by the heat do not occur between the fixing film 6 and pressing roller 9, prolonging the component life.

EMBODIMENT 5

Figure 6:
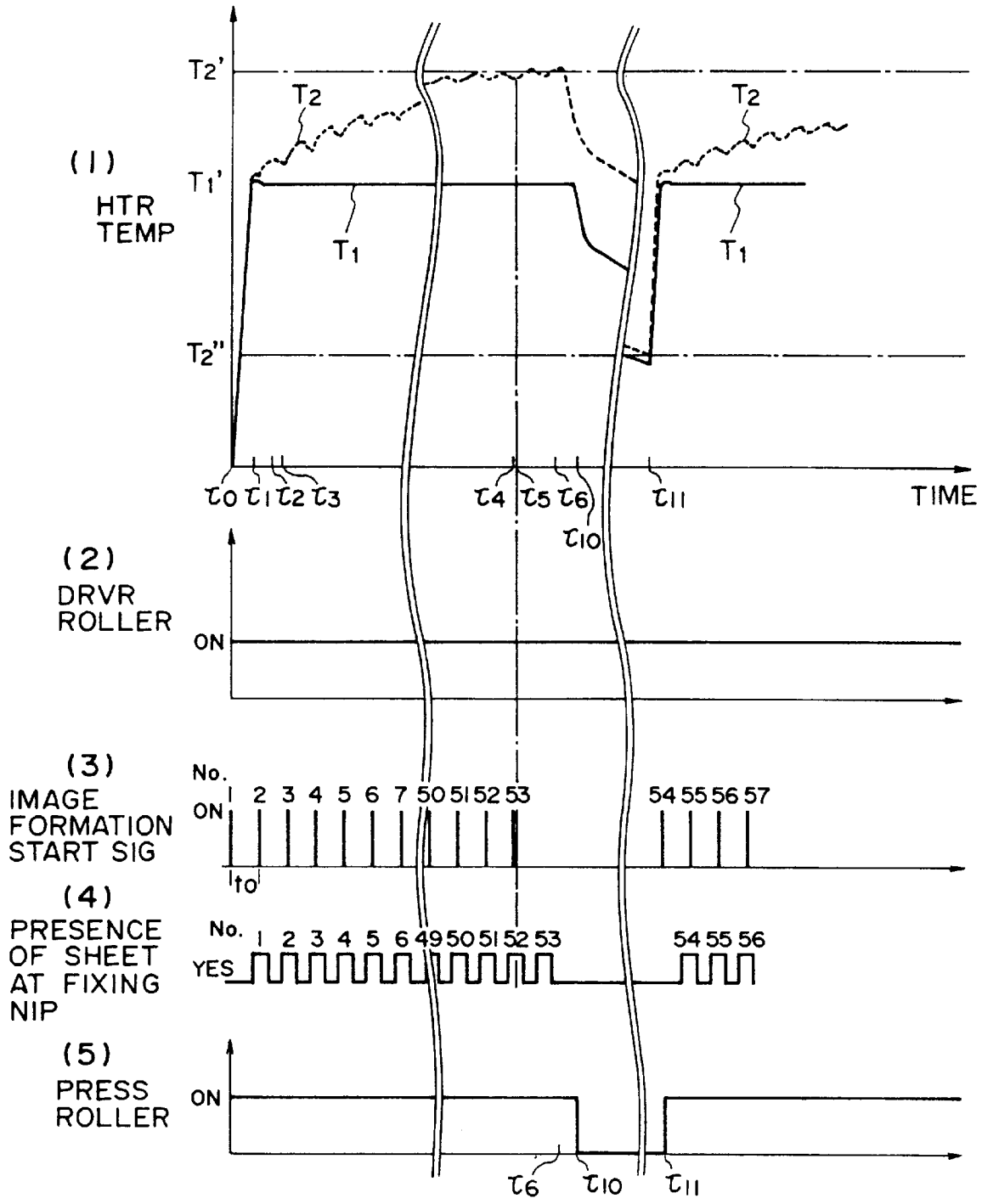
FIG. 6 is an operational timing chart for a further embodiment of the present invention.

FIG. 6 shows a timing chart of the fifth embodiment of the present invention.

At a time $\tau_{10}$, in other words, after a predetermined period of time from the time $\tau_6$ when the 53th sheet comes out of the fixing nip, the pressing roller 6 is moved away from the fixed film by a pressure controlling means such as an unshown solenoid and the like. At a time 11 when the temperature reaches where T2=T2", the pressure imparted on the heater by the pressing roller is restored to restart the image forming operation.

Since there is a layer of air between the fixing film and pressing roller, the convectional heat radiation from the fixing film increases. Therefore, the speed of heat radiation from the heater through the fixing film increases, in other words, T2 drops faster, and the wait period can be shortened. In addition, inconveniences such as the adhesion between the fixing film and pressing roller are eliminated, and since the sliding friction decreases between the fixing film and pressing roller, it is possible to prevent the wear caused on the inner peripheral urface of the fixing film by the idle rotation during the wait period.

EMBODIMENT 6

During the period from the time $\tau_{10}$ to the time $\tau_{11}$ in the fifth embodiment, the rotational direction of the driving roller may be reversed by an unshown driving force transmission means which includes a clutch and the like. In such a case, the pressure is restored after the rotational direction is reversed again to the initial direction at the time $\tau_{11}$.

In the case of the structure of this embodiment, if the temperature difference occurs in the longitudinal direction of the heater, fixing film, and the driving roller, the fixing film laterally shifts toward the high temperature side. However, if the fixing film is rotated in the reverse direction, the direction of lateral shift also reverses; therefore, the lateral shifting of the fixing film can be compensated by the method of this embodiment.

EMBODIMENT 8

Figure 7:
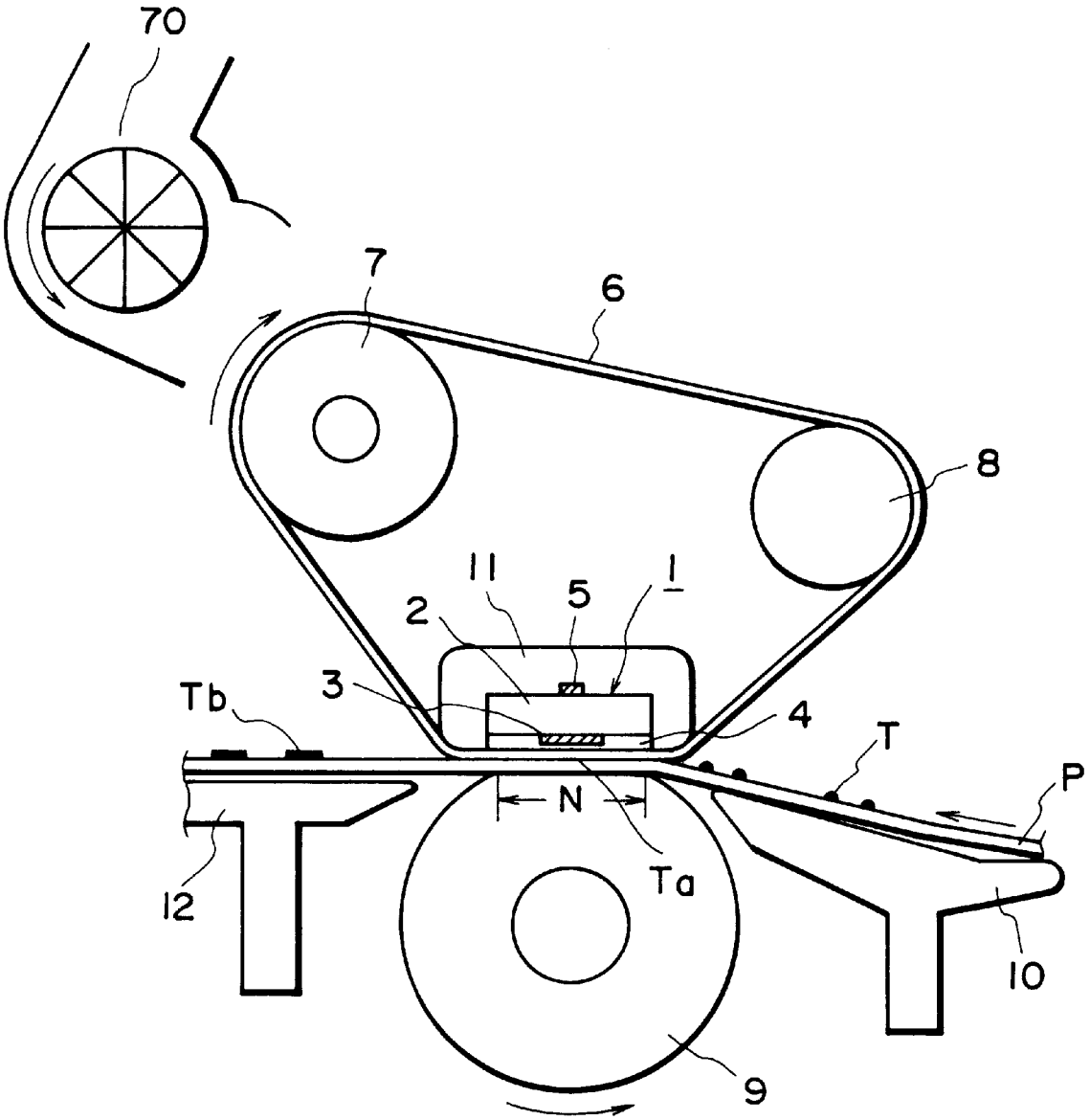
FIG. 7 is a sectional view of the image heating device of another embodiment of the present invention.

FIG. 7 shows a sectional view of the seventh embodiment of the present invention.

In this embodiment, a fan 70 (in this embodiment, a cross-flow fan in which blades are. provided across the entire longitudinal range of the fixing film) is positioned on the sheet discharging side so that the cooling air flow is distributed from the fan, across the entire range of the fixing film, on its section in direct contact with the driving roller.

Figure 8:
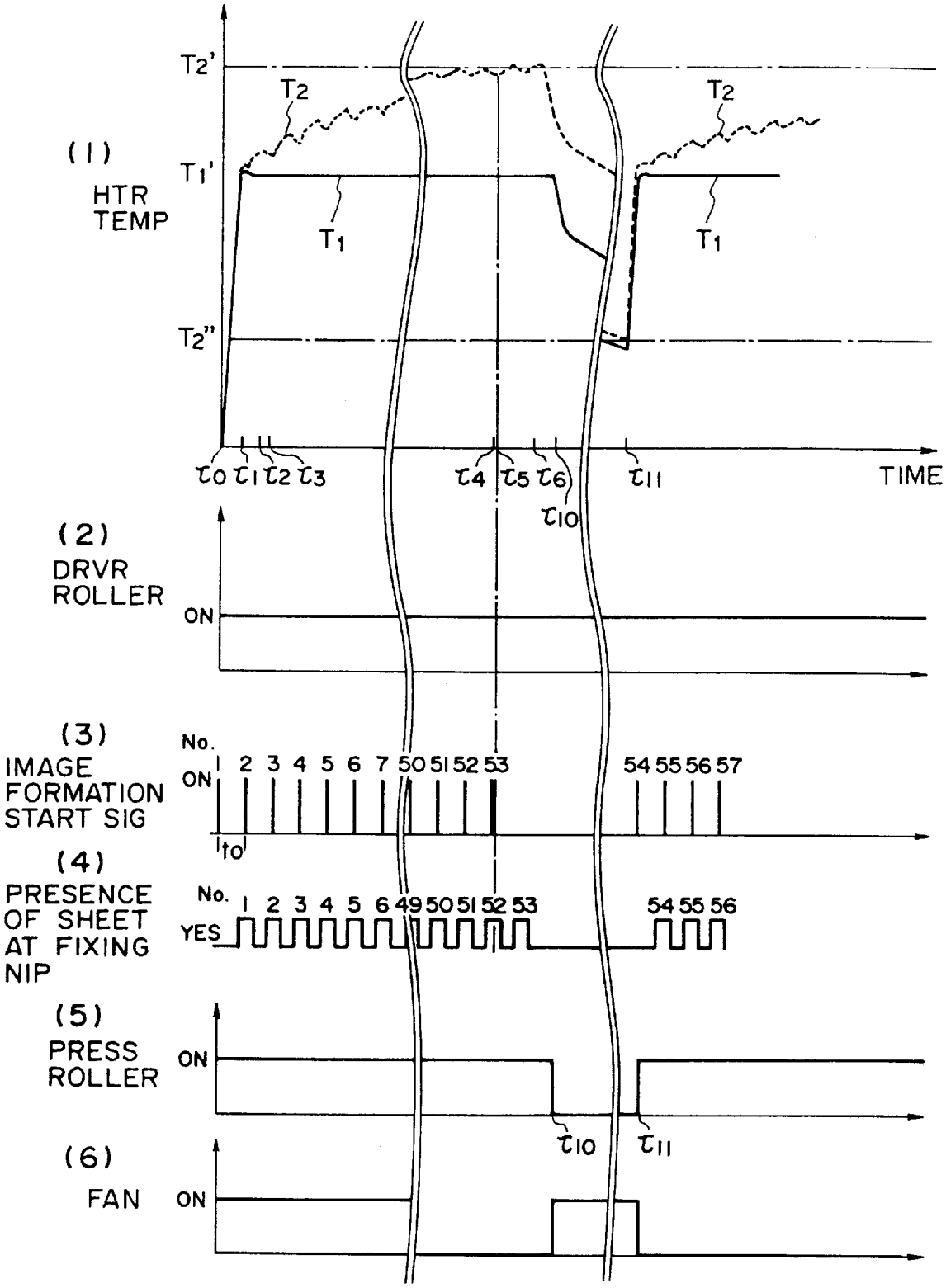
FIG. 8 is an operational timing chart for another embodiment of the present invention.

FIG. 8 shows a timing chart for this embodiment.

At the time $\tau_{10}$, the pressure is released, and at about the same time, the fan is turned on; therefore, the temperature T2 detected by the second thermistor drops below T2." At the time $\tau_{11}$, the pressure is restored, and at about the same time, the rotation of the fan is stopped.

The heat radiation from the heater through the fixing film is enhanced since the fixing film is run even during the wait period; therefore, the wait period is further shortened.

Incidentally, in this embodiment, the cooling air is directed to the location of the driving roller, but it is also acceptable to cool the sheet discharging side of the nip formed between the heater and the pressing roller.

The cooling efficiency is further increased.

EMBODIMENT 8

Figure 9:
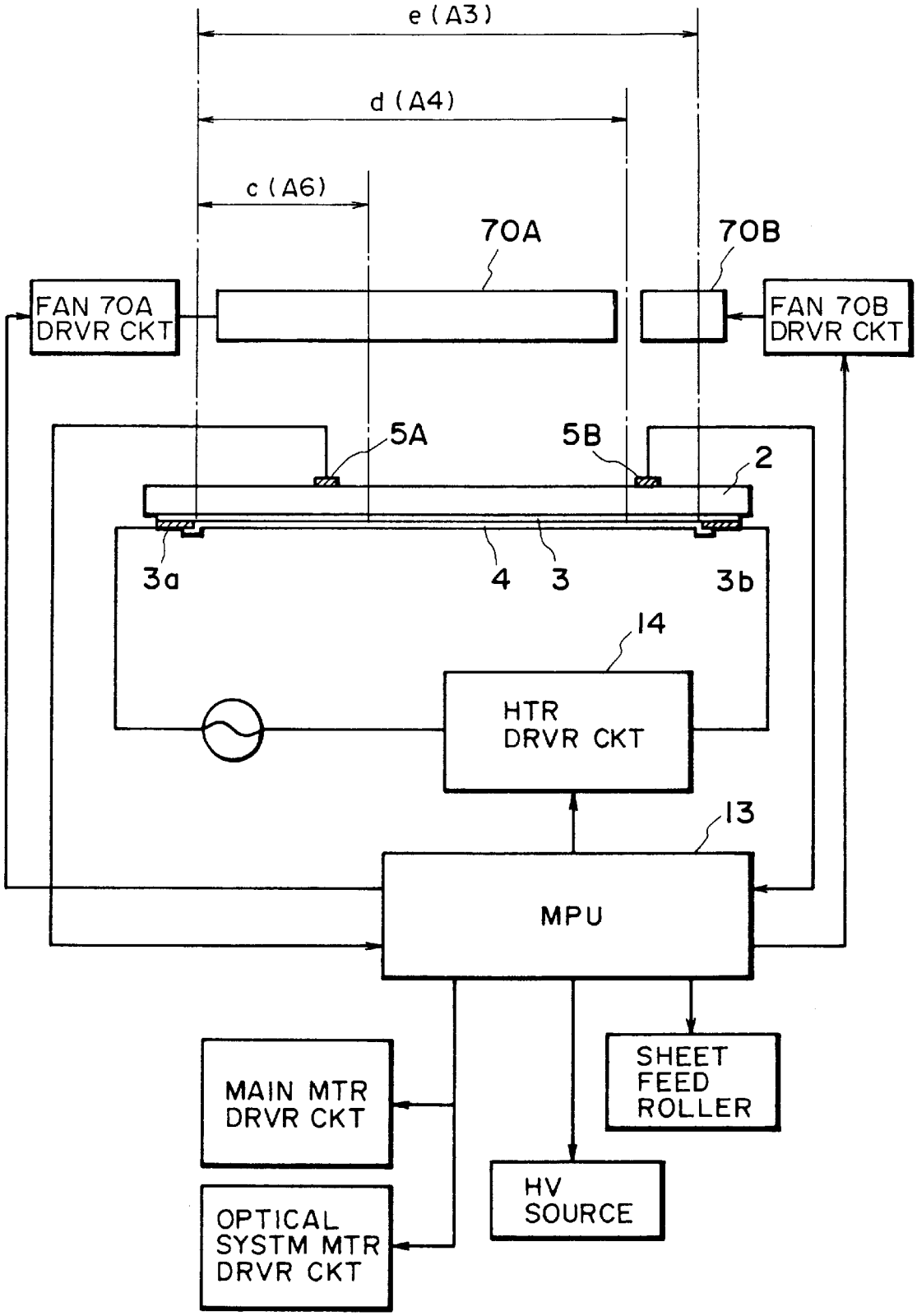
FIG. 9 is a side view of another embodiment of the present invention.

FIG. 9 shows the eighth embodiment of the present invention.

In this embodiment, multiple units of fan are provided along the heater in its longitudinal direction, and at least one of them is positioned facing the non-passage region. A fan 70A is provided within the passage region for B4, and a fan 70B is provided within the non-passage region for B4, which includes the location of the second thermistor.

The temperature T2' at which the fixing process is interrupted is set to be a rather low temperature of 220° C.

Figure 10:
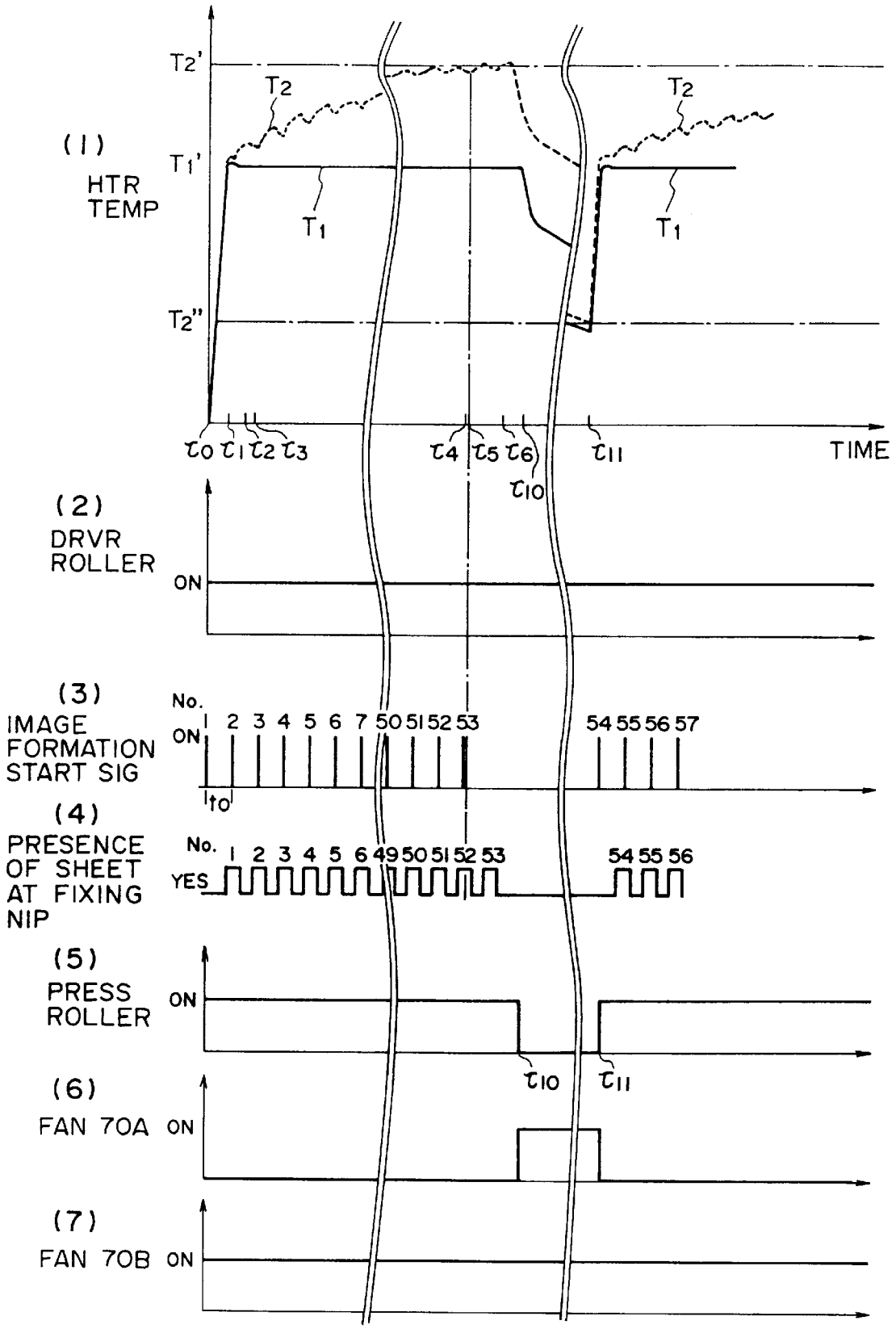
FIG. 10 is an operation timing chart for another embodiment of the present invention.

FIG. 10 shows a timing chart for this embodiment.

Since the fan 70B cools the non-passage region in the longitudinal direction, during the continuous copying operation, climbing speed of the T2 is small.

The temperature reaches a point where T2≧T2' (220° C.) during the processing of the 52th sheet.

An example is shown in which it becomes T2=T2' during the processing of the 52th sheet. The power is stopped at $\tau_6$, and at $\tau_{10}$ after the beginning of the wait period, the fan 70A within the passage region is also turned on.

The fan 70A is turned off at $\tau_{11}$ when it becomes T2≦T2".

The fan 70B remains in on-state from the beginning until the completion of the final copy during the copying process.

Since the rising speed of the temperature T2 is slow, T2' may be set lower. Therefore, even if a copy is made on a large size sheet immediately after the temperature climbs to a point where T2=T2', the toner offset does not occur within the range of |width of the large size sheet—width of the small size sheet|. Further, with T2' being kept at the same level, the number of copies which can be produced before it become T224 T2' can be increased.

EMBODIMENT 9

Figure 11:
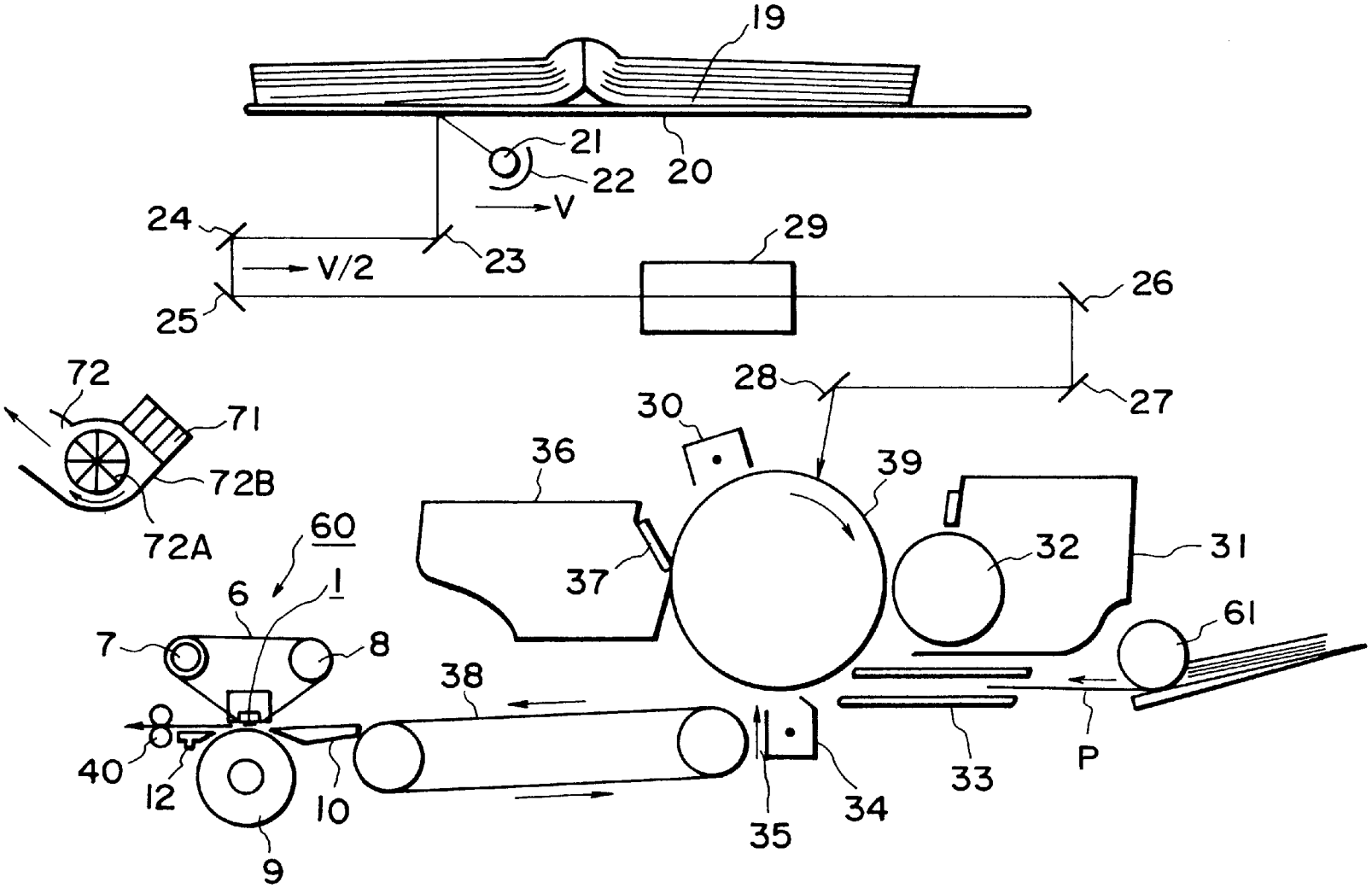
FIG. 11 is a sectional view of an image forming apparatus in accordance with another embodiment of the present invention.
Figure 12:
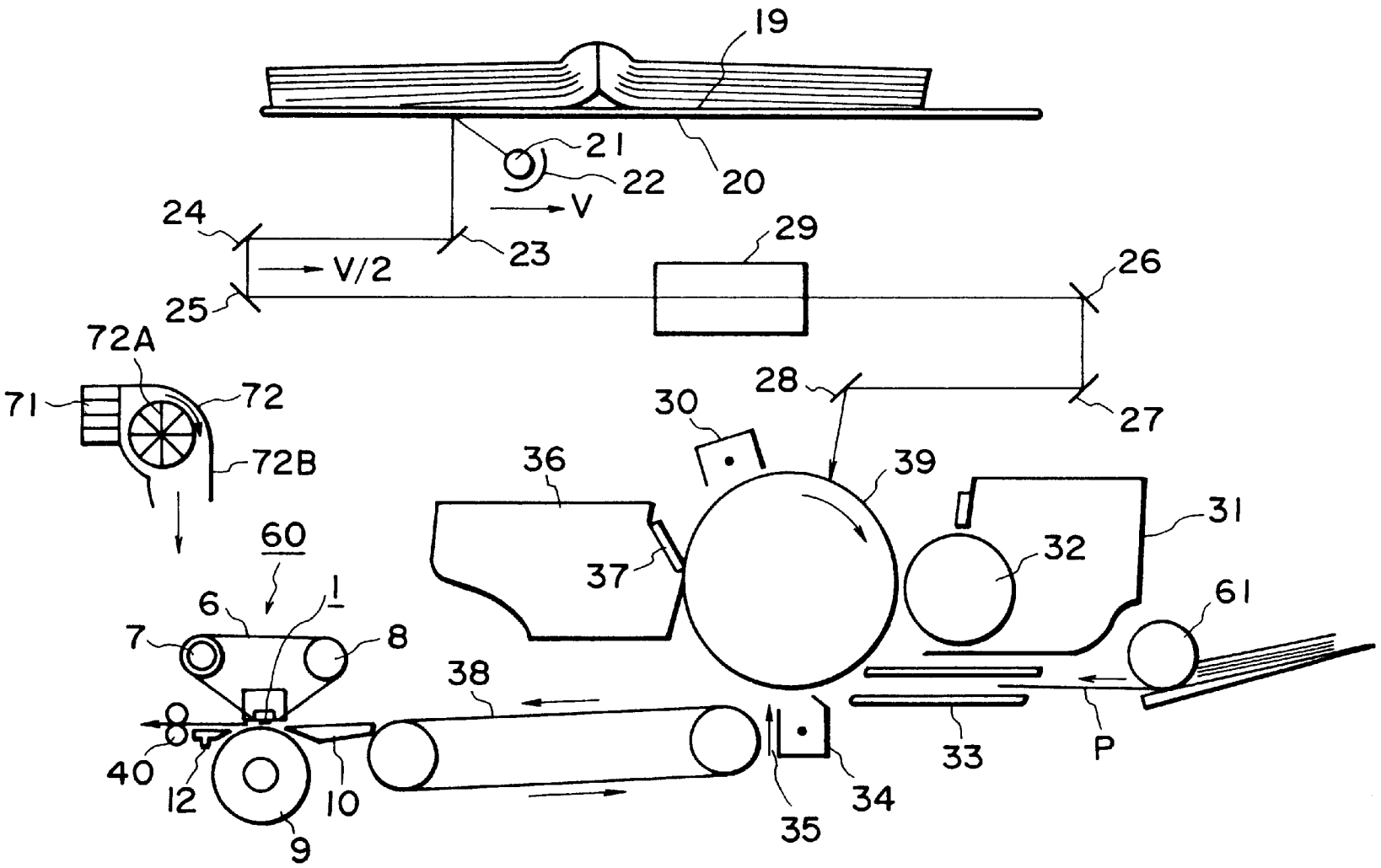
FIG. 12 is a sectional view showing the fan rotation of the embodiment presented in FIG. 11.

FIGS. 11 and 12 are sectional views of the image forming apparatus in accordance with the ninth embodiment of the present invention.

In this embodiment, a fan 72 for exhausting the ozone generated in chargers 30 and 34 is provided above the fixing device 60.

Reference numeral 71 refers to an ozone filter.

The casing 72B of the fan 72 can be rotated by an unshown driving means around an axis, to which the runner 72A is attached, so that two positions can be selected in its rotational direction. The positioning of the casing 72B in FIG. 11 refers to a position held during the image forming operation (hereinafter, referred to as a position A), and the positioning of the casing 72B in FIG. 12 refers to a position held during the wait period (hereinafter, referred to as a position B). During the wait period, the casing 72B is locked at the position B after being rotated from the position A, approximately 120 degrees in the counterclockwise direction, relative to this drawing.

Figure 13:
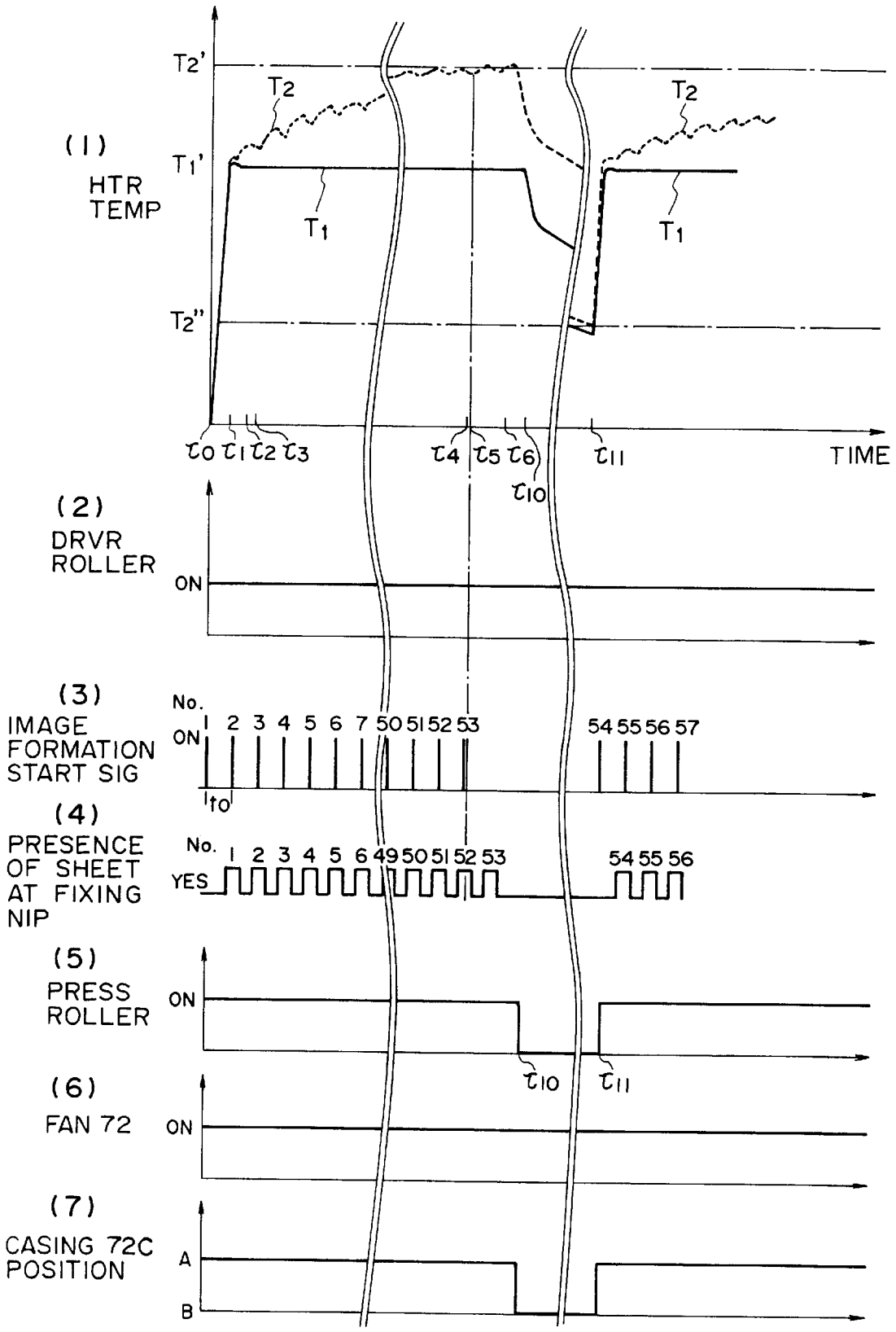
FIG. 13 is an operational timing chart for another embodiment of the present invention.

FIG. 13 is a timing chart for this embodiment.

The fan begins to rotate as soon as the copying apparatus is turned on and keeps on turning. From the time $\tau_0$ to the time $\tau_0'$ the casing is positioned at the position A, and the air flow does not hit the fixing device. From the time $\tau_{10}$ to the time $\tau_{11}$, the casing is positioned at the position B, and the air flow hits the rotating fixing film; therefore, the cooling of the heater through the film is enhanced.

According to this embodiment, it is not necessary to provide a special fan for cooling the fixing film.

EMBODIMENT 10

Figure 14:
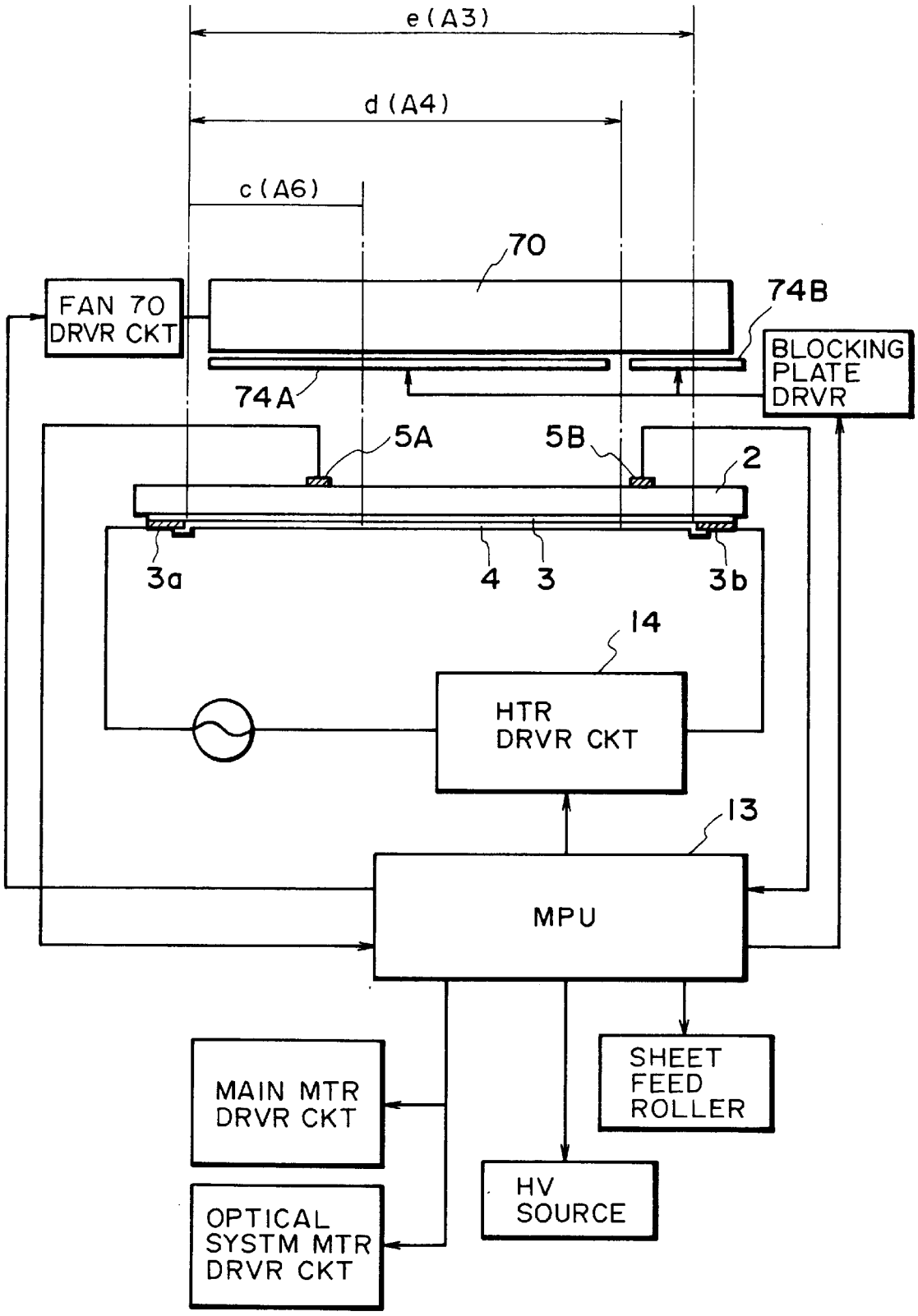
FIG. 14 is a side view of another embodiment of the present invention.

FIG. 14 shows the tenth embodiment of the present invention.

In this embodiment, a fan 70, which is the only fan, and air flow shields 74A and 74B, which correspond to the sheet width, are provided between the fan opening and fixing film.

These air flow shields 74*a* and 74B are retracted by an air flow shield driving means, which includes a stepping motor or latching solenoid, to establish the same air flow condition as the above mentioned eighth embodiment.

Multiple air flow shields may be provided to accommodate the various sheet sizes, wherein the size of the passing sheet is detected to drive the air flow shield which corresponds to the detected size.

EMBODIMENT 11

Figure 15:
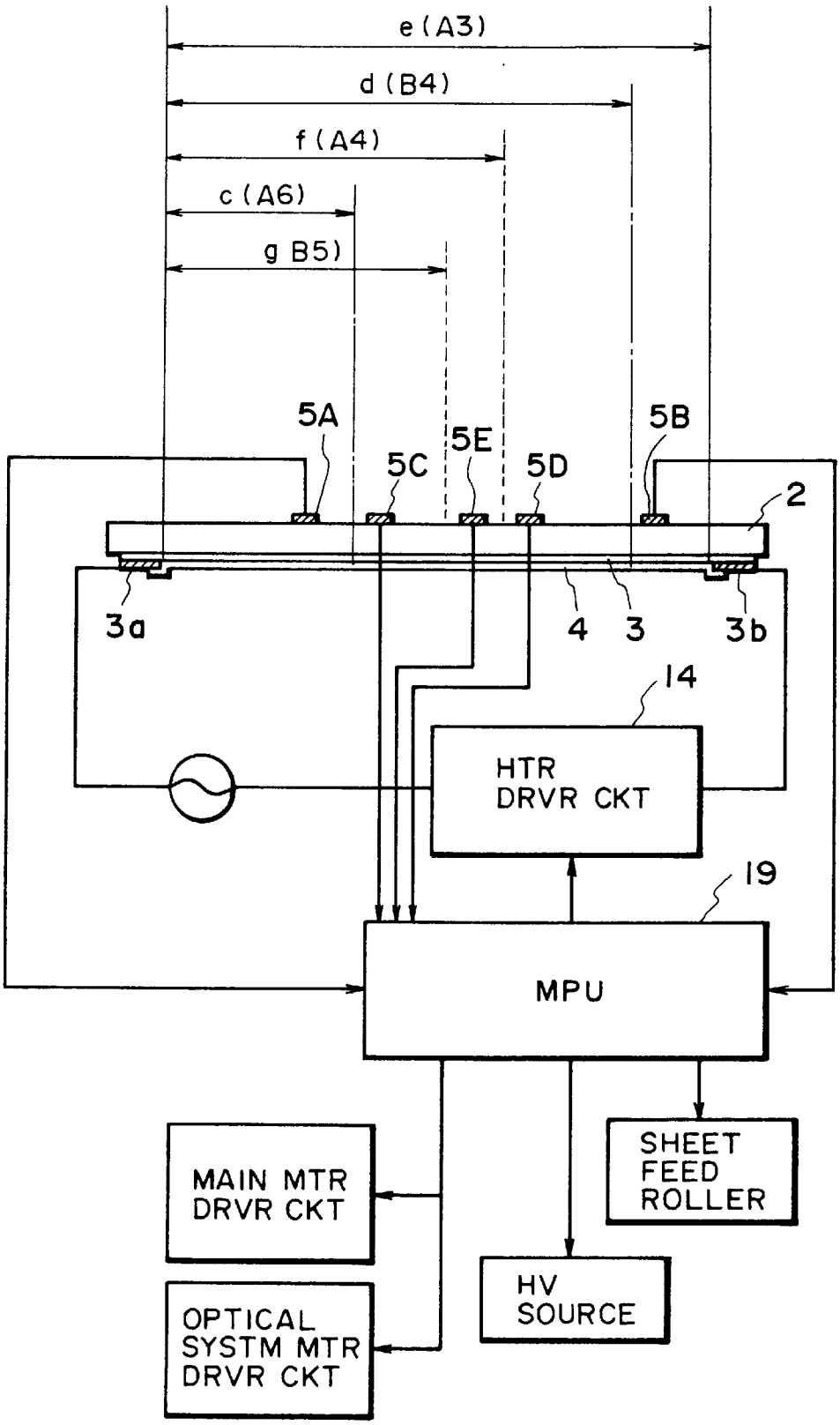
FIG. 15 is a side view of a heater element in accordance with another embodiment of the present invention, showing the structure around the heating unit.

FIG. 15 is a side view of the heater showing the eleventh embodiment of the present invention.

In this embodiment, multiple thermistors 5B, 5C, 5D, and 5E are provided in addition to the thermistor 5A, for maintaining the constant temperature.

In particular, the thermistors are individually provided for each of the recording material sizes.

The temperatures detected by the thermistors 5B to 5E are referred to as T2 to T5, respectively, and if any one of T2 to T5 exceeds T2', the wait period cuts in.

Further, a predetermined temperature sensor (for example, the thermistor positioned closest to the edge of the passage region while being outside the passage region) is selected by a relay, corresponding to the size of the sheet being passed, and if the temperature T of this selected thermistor exceeds T2', the wait period begins.

Also, in this embodiment, the thermistors are provided, one for one, for each of the various recording material sizes, but multiple thermistors may be provided.

EMBODIMENT 12

The rate of temperature rise within the non-passage region varies depending on the size of the sheet being passed, in other words, the distance from the edge of the sheet being passed.

Therefore, in this embodiment, the recording material size is detected by an unshown size detecting means, and the value of the temperature T2' at which the fixing operation is interrupted is switched corresponding to this detected size of the recording material.

Alternatively, during the continuous image forming operation, the value of the temperature T2' is also changed depending on the sheet interval, in accordance with the size of the recording material.

In other words, the temperature at which the fixing operation is interrupted is lowered as the distance increases between the second thermistor and the edge of the sheet being passed. For example, in case a sheet of a size B4 is passed, T2'=240° C.; in the case of A4, T2'=235° C.; and in the case of A6, T2'=225° C.

Therefore, if T2'=240' C. while a sheet of the size A6, which is the smallest size, is passed, the temperature reaches up to the maximum temperature of 255° C. at the heater surface, but if the temperature at which the fixing operation is interrupted is switched depending on the recording material size, the maximum temperature at the heater surface can be kept low regardless of the recording material size.

In the embodiments described so far, the temperature detected by the temperature sensor placed outside the sheet passage region of the smallest size recording material is compared to a predetermined temperature, to interrupt the heating procedure. However, hereinafter, descriptions are given to embodiments in which the heating procedure is interrupted depending on the difference between the temperature detected by the temperature sensor located within the sheet passage region and the temperature detected by the temperature sensor outside the sheet passage region.

EMBODIMENT 13

Figure 16:
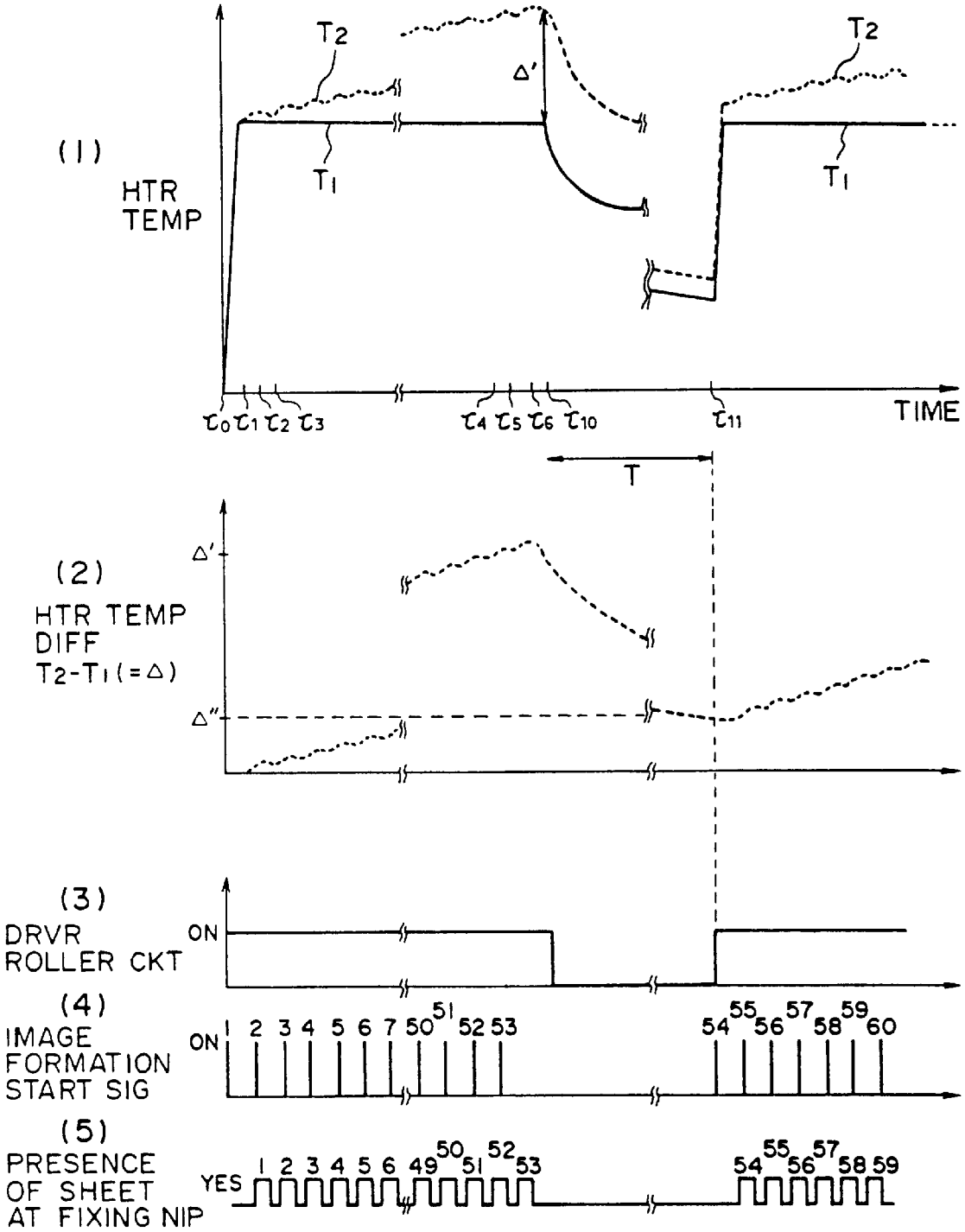
FIG. 16 is an operational timing chart for another embodiment of the present invention.

FIG. 16 is a timing chart for the thirteenth embodiment in which the copy count is set for multiple copies (for example, 100 copies) before the copy start key is depressed, and copies are continuously made using the B4 size sheets with a weight of 80 g/m$^2$, and provides four charts: chart 1) showing the time-based changes of the temperature T1 detected by the first thermistor, and the temperature T2 detected by the second thermistor T2; chart 2) showing the rotational timing of the driving roller 7; chart 3) showing the timing at which a signal for starting the operation (hereinafter, called image formation start signal) of the optical system which includes the unshown clutch to control the operation of the feed roller 61, and the light source 21, is outputted from the microcomputer MPU 19; and chart 4) showing the timing at which the sheet P passes through the fixing nip N ("present" indicates that the sheet P is passing through, and "absent" indicates that the sheet P is not passing through).

In this embodiment, a predetermined amount of power is supplied by the power source and heater driving circuit, corresponding to the value of T1, so that the temperature T1 detected by the first thermistor 5B is maintained at a predetermined value of T1', at least during the fixing process.

As soon as the copy key is depressed at the time of $\tau_0$, the image formation start signal is transmitted from the MPU 19 to the feed roller, high ivoltage power source, main motor driving circuit, optical system motor driving circuit, and the like. Then, the feed roller 61 begins to rotate, whereby the sheet P is conveyed toward the transfer charger 34. At the same time, the power is supplied to the heater 3; the driving roller 7 begins to rotate; and the fixing film 6 begins to run, in the fixing device 60.

At the time $\tau_1$, the B4 size sheet P reaches the fixing nip N. The temperatures T1 and T2 detected by the thermistors climb from the room temperature to T1' at an approximately the same speed in advance before this time of $\tau_1$. While the sheet P is passing through the nip N, T1 is kept at T1', but T2 climbs from T1', in other words, the temperature outside the sheet passage region increases. The sheet P comes out of the nip N after staying in the nip N for a duration of $t_c$.

After the duration of $t_0$ (for example 5 seconds) since the copy key is depressed, the image formation signal for the second sheet is sent out from the MPU 19, to begin feeding the sheet P. Then, the second sheet P enters the nip N at the time $\tau_3$, with the interval having the duration of $t_i$ after the first sheet P comes out of the nip N. From this point on, the above mentioned operation is repeated for a while.

The temperature T2 detected by the second thermistor keeps on climbing for the duration of the sheet passage period $t_c$, and drops during the interval having the duration of $t_i$, but in macro terms, gradually rises. Therefore, a temperature difference T2−T1 also increases. While the 52nd sheet P is passing through the fixing nip N after the image formation signal for the 53rd sheet is outputted at the time $\tau_4$, the T2−T1 (hereinafter, referred to as Δ) reaches a predetermined value (in this embodiment, 50° C.) at the time $\tau_5$.

Then, the image formation signal is not outputted even after an elapse of the duration of $t_0$ from the time $\tau_4$. At the time $\tau_6$ when the 53rd sheet P, which is exposed to the fixing process in the nip N, is detected by an unshown sensor as it comes out of the nip at the speed of Vp, the power supplied to the heater 3 is stopped (such stoppage constituting a form of interrupting means); slightly later (0.3 second to 10 seconds), the rotation of the driving roller 7 stops at the time $\tau_7$; and therefore, the movement of the fixing film 6 also stops.

Next, "wait" is displayed on the display panel, and the wait period begins.

A duration of T after the time $\tau_7$, the temperature T2 drops to T2" at the time $\tau_8$, and at this point of time, the difference Δ between the temperatures T2 and T1 will have become sufficiently small (due to the heat conduction in the longitudinal direction of the heater, and the heat radiation).to have a value of Δ" (for example 10° C.). At the time $\tau_8$, "wait" display is canceled, and the image formation signal for the 54th sheet is automatically sent out from the MPU 19 to restart the image forming operation. From this point on, the image forming and fixing operations are continued to finish a total of 100 copies. However, if Δ exceeds Δ" again, the wait period having the during of T takes over in the above mentioned manner, and afterward, the operation is restarted.

In this embodiment, since the temperature T1 remains constant during the continuous copying operation, there is not much difference between monitoring the T2−T1 and comparing T2 to a predetermined value. Next, an embodiment is described, which shows that it is effective to interrupt the heating process according to the value of the T2−T1.

EMBODIMENT 14

Figure 17:
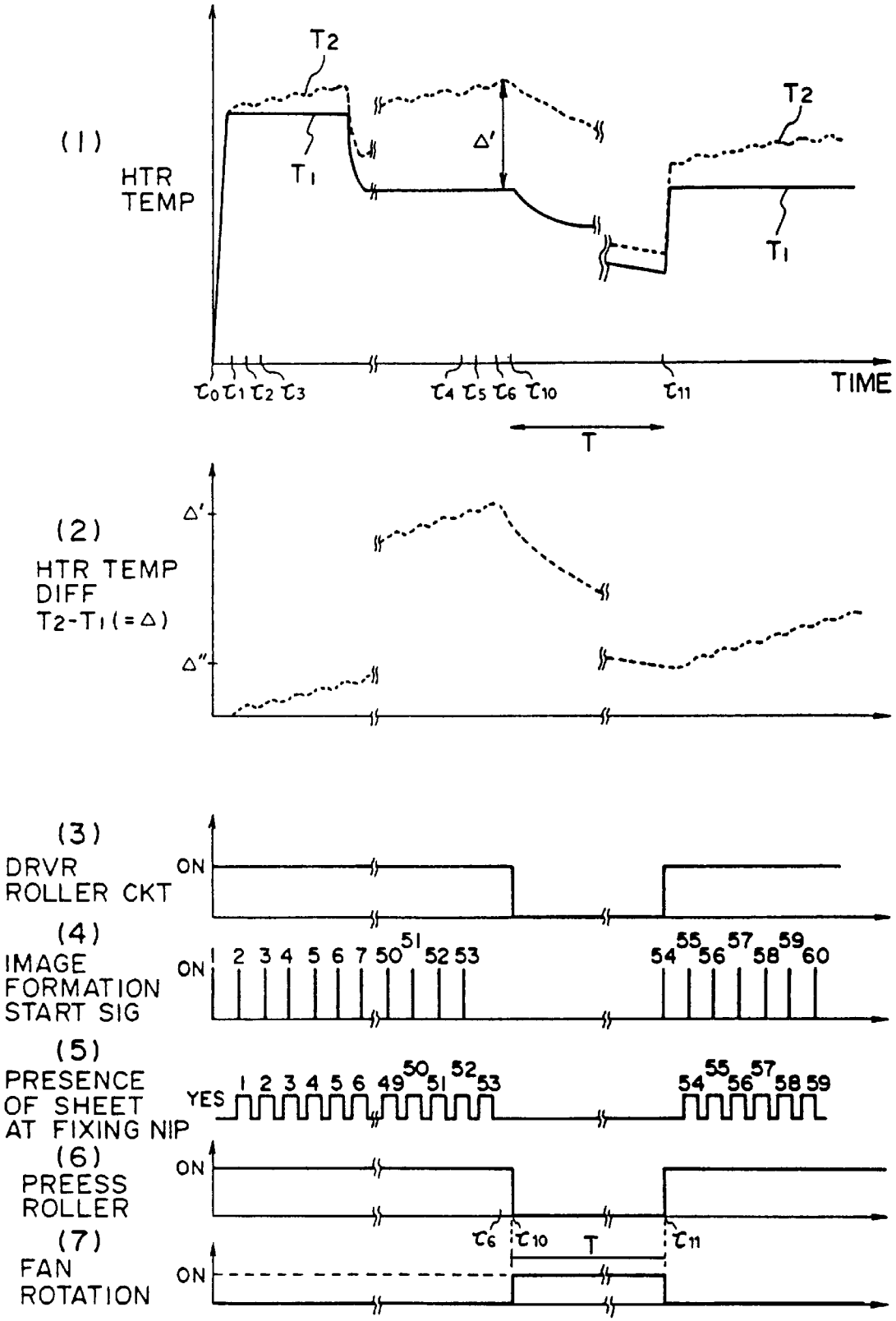
FIG. 17 is an operational timing chart for another embodiment of the present invention.

FIG. 17 is a timing chart showing this embodiment.

When the fifth sheet is detected by an unshown sheet discharge sensor as it comes out of the fixing nip N at the time $\tau_4$, the target temperature T1 (225° C.) of T1 is lowered to T1" (190° C.). Since the heat capacity of the heater 1 is sufficiently small, the temperature T1 quickly drops to T1" when the amount of power supply to the heater 1 is reduced. Following this temperature drop, the temperature T2 also drops in the same manner. Therefore, the value of Δ=T2−T1 hardly changes. The temperature T2 detected by the second thermistor gradually rises in macro terms. On the other hand, the temperature T1 is precisely maintained. As a result, the value of T2−T1 increases. Then, while the 52nd sheet P is passing through the nip N after the image formation signal for the 53rd is outputted at the time $\tau_4$, the value of Δreaches a predetermined value Δ' (here, 50° C.) at the time $\tau_5$. Then, the image formation signal for the 54th sheet is not sent out even after a duration of $t_0$ will have passed since the time $\sigma_4$.

When the temperature T1 changes as above, it is effective to interrupt the fixing process according to the value of T2−T1 so that the device comprises interrupting means for interrupting the image heating process when the difference in temperatures detected by the first and second thermistors exceeds predetermined value Δ'.

When the target temperature is switched, it may be switched in accordance with switching of T2" to be compared with T2, rather than T2−T1.

EMBODIMENT 15

Figure 18:
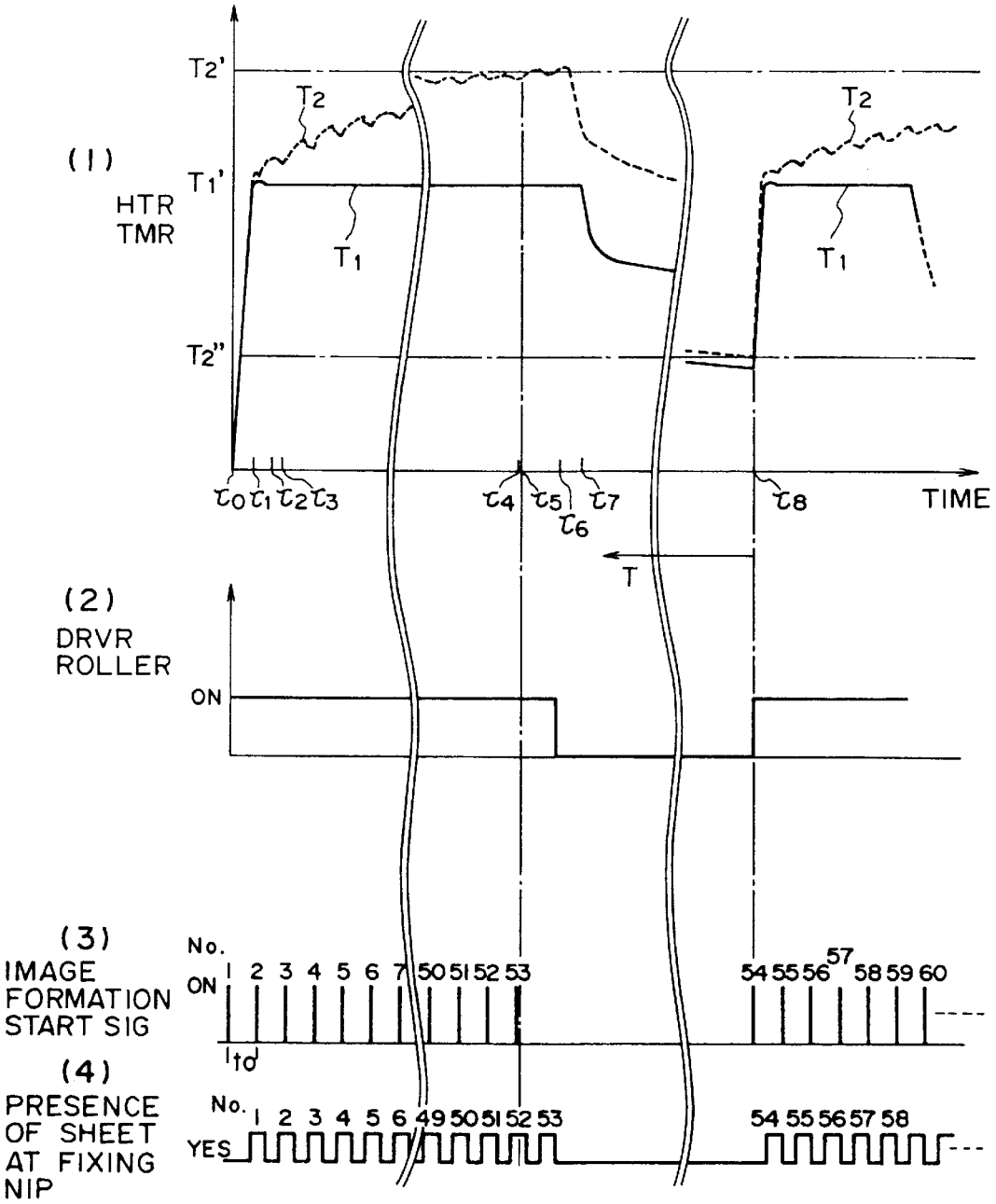
FIG. 18 is an operational timing chart for another embodiment of the present invention.

FIG. 18 is a timing chart for the fifteenth embodiment of the present invention.

The temperature T2 detected by the second thermistor climbs during the sheet passage having the duration of $t_c$, and falls during the wait period having the duration of $t_i$, but in macro terms, it gradually climbs. While the 52nd sheet P is passing through the nip N after the image formation signal for the 53rd sheet is outputted at the time $\tau_4$, T2 reaches the predetermined temperature T2' (here, 240° C.) at the time $\tau_5$.

Then, the image formation signal is not sent out even after the interval of $t_0$ will have passed since the time $\tau_4$. At the time $\tau_5$ when the 53rd sheet P is detected by the unshown sensor as it comes out of the nip N at the speed of Vp after being exposed to the fixing process, the power supplied to the heater 3 is stopped; slightly later (approximately 0.3 second to 10 seconds), the rotation of the driving roller 7 stops at the time $\tau_7$; and therefore, the movement of the fixing film 6 also stops, entering the wait period.

For the predetermined duration T of the interval (in this embodiment, 3 minutes) after the time $\tau_7$, the "wait" is displayed on the unshown display panel. When this display is shown, no key input from the operator is accepted whatsoever. Even if the power source of the apparatus main assembly is turned off during this period, clocking is started from the time $\tau_7$ by an unshown internal clock of the MPU 19. If the main switch is turned on during the interval with the duration of T, the above mentioned display comes back on, and the operation continues. After an elapse of the interval with the duration of T from the time $\tau_7$, the temperature T2 drops to T2" at the time $\tau_8$ but at this point in time, the temperatures T2 and T1 become approximately the same (due to the heat conduction in the longitudinal direction of the heater, and the heat radiation). At the time $\tau_8$, the "wait " display is canceled, and the image formation start signal for the 54th sheet is automatically sent out from the MPU 19 to restart the image forming operation. From this point on, the image forming and fixing processes are continued to finish a total of 100 copies. However, if T2 exceeds T2' after the 54th sheet, the wait period having the duration of T takes over again in the above mentioned manner, and after an interval of a predetermined duration, the operation is restarted.

As described above, the damage to the heater or film can be also prevented by restarting the operation after the interval of the predetermined duration will have passed since the wait period takes over.

Also, the wait period may be initiated according to the vale of T2−T1.

EMBODIMENT 16

In this embodiment, if the wait period occurs more than twice during a single continuous copying operation, the wait period is prolonged.

The first wait period is selected to be three minutes, and the second and following wait periods are five minutes.

Since the neighboring area of the heater is warmer the second time than the first time, it takes a less time for the temperature T2 to reach a point where T2≧T2', for the second time. Therefore, the number of interrupt process can be reduced by prolonging the duration of each interrupt process.

It is also preferable to shorten the duration of the interruption if the number of the copies yet to be made is small at the time when the interrupting process begins.

Further, it is also preferable to change the duration T of the interruption, according to the increase in the temperature T2. In practical terms, assuming that it becomes T2≧T2' while the nth copy is being made, the larger the value of n is, the smaller the value of T is set.

Up to this embodiment, the image heating process is interrupted according to the temperature detected by the second temperature detecting member. Next, embodiments are described, in which the sheet feeding interval is varied.

Incidentally, the same device structures as those presented in FIGS. 1 to 3 are employed.

EMBODIMENT 17

Figure 19:
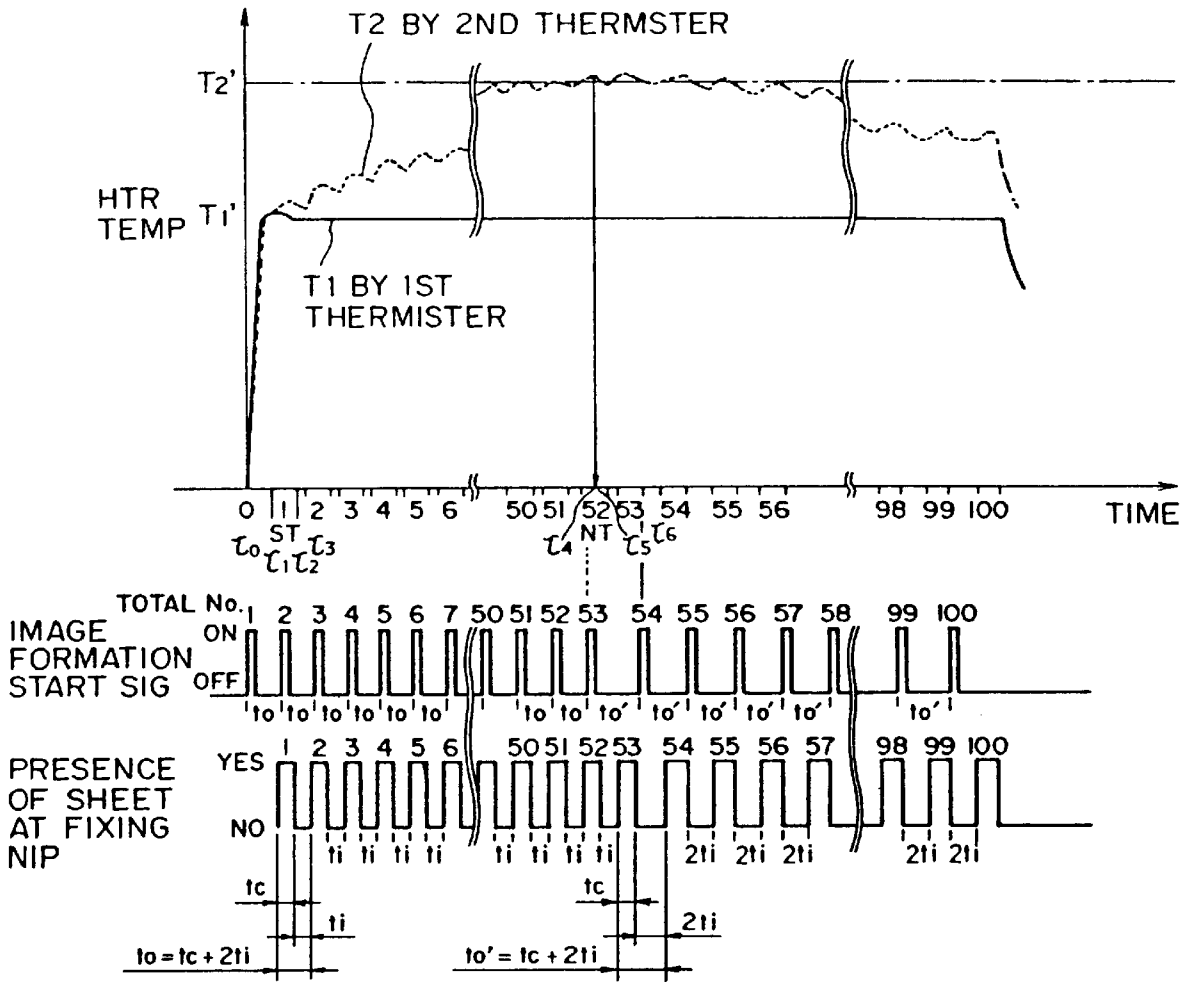
FIG. 19 is a drawing showing the temperature fluctuation and its timing for another embodiment of the present invention.

FIG. 19 presents two timing charts showing the point of time when the image formation start signal is turned on after the copy count is set to be a plural number (for example, 100) before the copy start key is depressed, and the point of time when the sheet P comes out of the fixing nip N ("present" indicates when the sheet P is passing through, and "absent" indicates when the sheet P is not passing); and the time-based changes in the temperature T1 detected by the first thermistor 5A and the temperature T2 detected by the second thermistor 5B, all of which are plotted on the same time axis.

The image formation start signal in this embodiment is a signal outputted from the microcomputer MPU 19, to control the operations of the unshown clutch which controls the movement of the feed roller 61 and the light sources 21 and 22, and initiates the image forming operation.

Incidentally, in this embodiment, the B4 size (257 mm wide) sheet weighing 80 g/m$^2$ is passed at a speed of 100 mm/sec. Also, in this embodiment, the power is supplied to the heater 1 according to the value of T1, so that the temperature T1 detected by the first thermistor 5A is maintained at a predetermined constant fixing temperature T1' (for example, 190° C.). As soon as the copy key is depressed at the time $\tau_0$, the image formation start signal is transmitted by the MPU 19 to each section of the image forming apparatus, and the feed roller 61, for example, begins to rotate to convey the sheet P toward the transfer charger 34. Also, at the same time of $\tau_0$, the rotation of the fixing film 6 of the fixing device is started and the power supplied to heater 1 are initiated.

At the time $\tau_1$, the B4 wide sheet P reaches a fixing point P, but the temperatures T1 and T2 detected by the thermistors increase in advance from the room temperature to the temperature T1' at approximately the same speed. While the sheet P passes through the nip N, T1=T2, but T2 climbs higher than T1' because of so-called non-passage region heat accumulation.

The sheet passes through the nip N after staying for the duration of $t_c$ ($=\tau_2-\tau_1$)

The image formation signal for the second sheet is issued from the MPU 13 after the duration of $t_0$ (for example 5 second) since the copy key is depressed, whereby the sheet P is fed. Then, the second sheet enters the nip N at the time $\tau_3$, with the interval having the duration of ti, after the first sheet passes the nip N. From this point on, the above mentioned procedure is repeated for a while.

The temperature T2 detected by the second thermistor rises during the period of the sheets passage, and falls during the sheet interval with the duration of $t_i$, but in macro terms, it gradually climbs.

After the next 53rd image formation signal is outputted at the time $\tau_4$, the temperature T2 detected by the second thermistor 5B reaches the predetermined temperature T2' (in this embodiment, 240° C.) at the time $\tau_5$($\tau_5<\tau_4+t_0$) before the 54th image formation signal is issued.

In this manner, the temperature rises within the non-passage region, and if the temperature detected by the second thermistor 5B positioned within the non-passage region exceeds T2' which is 50° C. higher than the fixing temperature T1, the microcomputer MPU 19 extends the interval during the continuous image forming operation.

In other words, the image formation signal is not issued even if the duration $t_0$ elapses since the time $\tau_4$. The 54th image formation signal is issued at the time $\tau_6$ which is the duration of $t_i$ after the time $\tau_4$ ($\tau_6=\tau_5+t_0+t_i=\tau_5+t_c+2t_i$). From the first sheet to the 53rd one, the intervals between the sheets P entering the fixing nip section is $t_i$, but the interval between the 53rd and 54th sheets doubles to $2t_i$. From this point on up to the 100th image formation, the intervals between the image formation signals outputted from the MPU 19 are $t_0'$ ($=t_0+t_i$), which is longer than the initial interval. Therefore, the difference in the amount of heat radiation from the surface of the heater per unit time, between the locations of the second and first thermistors becomes small compared to the initial one, and therefore, the temperature T2 detected by the second thermistor falls, in other words, the temperature increase within the non-passage region is reduced.

COMPARATIVE EXAMPLE

One hundred copies were continuously made in the same manner as in the above mentioned embodiments, except that the sheet interval was not varied, being kept to be $t_1$.

After the 100th copy, the temperature reached where T2=260° C. Then, the film laterally shifted toward the side of the higher temperature, and as a result, the film edge was damaged. Further, after this operation of making 100 copies was repeated 20 times, the damages occurred on the coating of the fixing film.

EMBODIMENT 18

FIG. 19 shows a timing chart for the eighteenth embodiment of the present invention.

The copy count is set to be 150 copies before the copy start key is depressed.

The temperature T2 detected by the second thermistor 5B keeps on rising as the copy count continuously progress, and reaches T2' (260° C.) during the 53rd copying operation as it did in the first embodiment.

Then, the intervals are extended from $t_1$ to $2t_1$ after the 54th operation; therefore, the temperature detected after the 54th operation by the second thermistor within the non-passage region falls.

Within a duration of $t_0'$ after the 99th image formation signal is issued at the time $\tau_6$, the temperature detected by the second thermistor 5B reaches, at the time $\tau_7$, a temperature at which $T2 \leqq T2''$ (T2"=220° C. <T2').

When the temperature detected by the second thermistor 5B within the non-passage region falls sufficiently, in other words, below the temperature T2" which is high enough as the fixing temperature but is low enough to leave some thermal margin for the device, the microcomputer MPU 19 again shortens the intervals during the image formation operation, restoring to ti.

As a result, the 101st image formation signal is issued at a time $\tau_9=\tau_8+t_0$ ($=\tau_8+t_c+t_i$).

From this point on, the image formation signals are issued with intervals having the duration of $t_0$.

After the 100th sheet P comes out of the nip N, the value of T2 begins to climb again. When the temperature T2 reaches a temperature at which $T2 \geqq T2'$, the intervals between the image formation signals are extended again $t_0'=t_0+t_i$.

According to this embodiment, the copy count per unit time can be higher than in the first embodiment, while preventing damage caused by the heat accumulation within the non-passage region.

EMBODIMENT 19

In the above mentioned embodiments 17 and 18, the intervals are changed in two steps of $t_1$ and $2t_1$, but in this embodiment, the changes are made in more steps for a more detailed control.

FIG. 6 shows the relation between the T2 and interval in this embodiment.

Up to the point where the temperature T2 detected by the second thermistor 5B reaches T2" (220° C.), the copies are continuously made with intervals having the duration of $t_i$.

When $T2'' \leqq T2 < T2'$(240° C.), the duration of interval is increased 50% to $3/2t_1$, and when $T2' \leqq T2$, the duration of interval is increased 100% to $2t_i$.

However, the temperature rise within the non-passage region continues, and when the temperature reaches the point where T2=T3 (260° C.), the device is stopped.

According to this embodiment, the non-passage region heat accumulation and the copy count loss per unit time can be both suppressed.

The duration of interval in this embodiment is switched in three steps, but it may be switched in a larger number of smaller steps, or in a stepless manner.

EMBODIMENT 20

The rate of heat accumulation within the non-passage region varies depending on the size of the sheet being passed, in particular the distance from the edge of the sheet being passed.

Therefore, in this embodiment, the recording material size is detected by an unshown size detecting means, and the value of T2' is changed according to this detected recording material size, to change the duration of intervals between the sheets, during the continuous image forming operation.

In other words, the temperature is lowered to extend the interval in proportion to the distance between the sheet edge and second thermistor; for example, when the B4 size sheets are passed, T2'=240° C.; when the A4 size sheets are passed, T2'=235° C.; and when the A6 size sheets are passed, T2'=225° C.

Therefore, if T2=240° C., and the A6 size sheets, the smallest size sheets, are passed, the maximum temperature of the heater surface reaches as high as 255° C. However, if the temperature setting is switched to change the sheet interval according to the recording material size, the maximum heater surface temperature can be kept low regardless of the recording material size.

Further, the amount of the power supplied to the heater (voltage or wattage) is detected in addition to the recording material size, and the larger the supplied power is, the lower the temperature T2' is set to extend the interval.

Since the heat capacity of the recording material, in addition to the recording material size, is taken into consideration by this detection of the power supply, far better results can be obtained.

Further, when the sheet feeding interval is changed as above, it is also preferable that multiple thermistors 5B to 5E be provided outside the sheet passage region for the smallest size sheet, corresponding to the recording material sizes, and the sheet feeding interval is extended if the temperature detected by a specific one of these thermistors exceeds a predetermined temperature T2'.

EMBODIMENT 21

Figure 22:
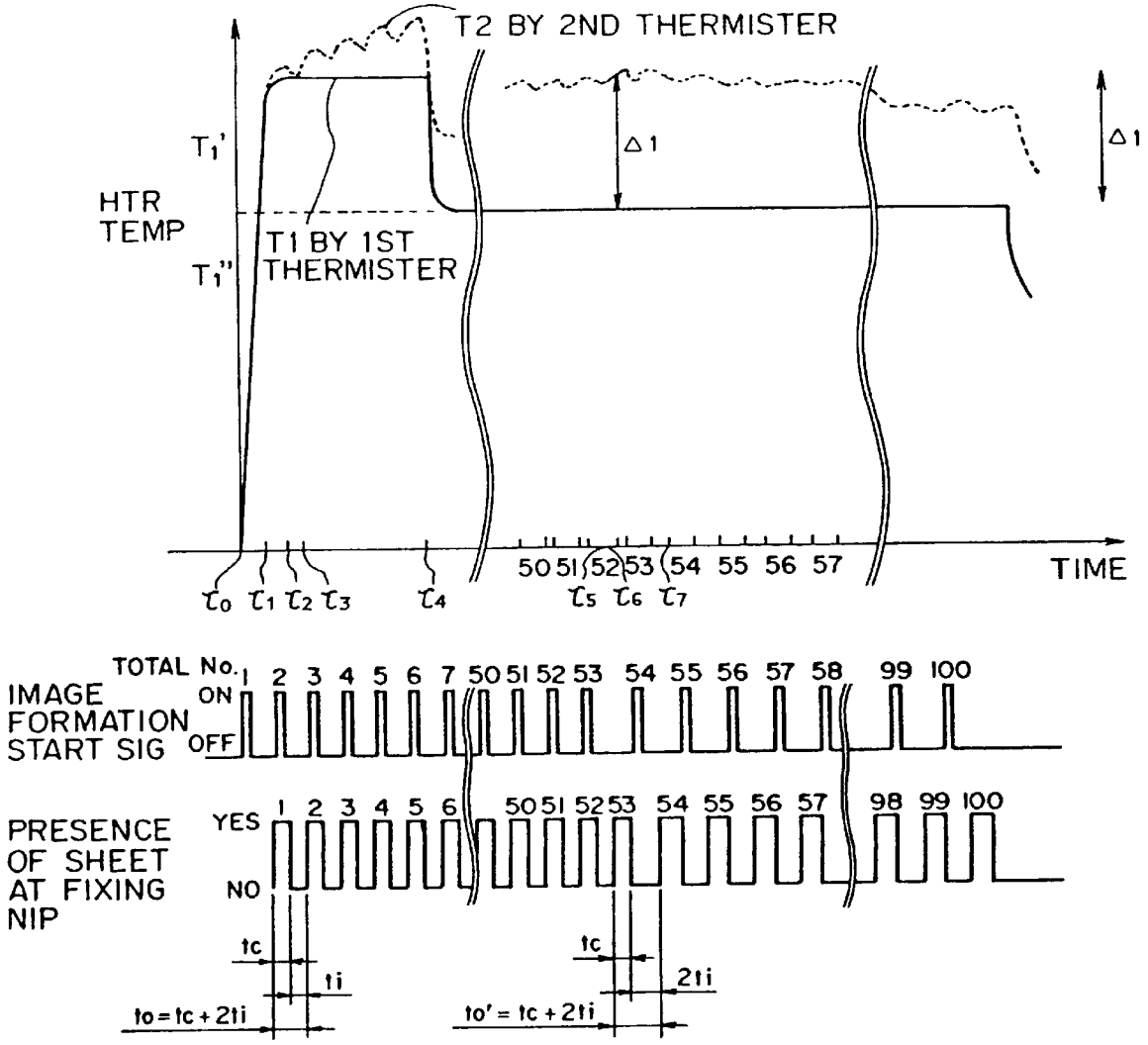
FIG. 22 is a drawing showing the temperature fluctuation and its timing for yet another embodiment of the present invention.

FIG. 22 is a timing chart for the 21st embodiment of the present invention, which relates to the case in which 100 copies are continuously made. In this chart, there are plotted together on the same time axis, the timing at which the image formation start signal is issued; the timing at which the sheet P passes through the fixing nip N ("present" indicates when the sheet P is passing, and "absent" indicates when the sheet P is not passing); and the time-based changes of the temperature T1 detected by the first thermistor 5A and temperature T2 detected by the second thermistor 5B.

Also, in this embodiment, the B4 size (257 mm wide) sheets with a weight of 80 g/m$^2$ are passed at a speed of 100 mm/sec.

In this embodiment, a predetermined amount of power is supplied to the heater according to the value of T1, so that the temperature T1 detected by the first thermistor 5B can be kept at T1' (for example 225° C.) from the time when the copy key is turned on until the fifth sheet passes through the fixing nip, and from that point on, at T1" (however, T1"<T1', for example, T1"=190° C. in this embodiment). (However, in this embodiment, it is approximately one second after the first sheet enters the fixing nip when T1 reaches the point where T1=T1' after the copy key is turned on. However, there is no practical problem as far as fixing of the first sheet is concerned), the reason why the temperature T1 is set lower after the fixing process of the fifth sheet is completed is to prevent a temperature increase in the device, for example, the heat accumulation within the non-passage region (since the temperatures of the pressing roller and the like will have sufficiently risen through the heating process of the first to fifth sheets, there is no practical problem).

As soon as the copy key is depressed at the time $\tau_0$, the image formation start signal is transmitted from the MPU 19 to each section of the image forming apparatus. Then, the feed roller 61 begins to rotate, and the sheet P is conveyed toward the transfer charger 34. At the same time of $\tau_0$, the rotational drive of the film 6 in the fixing device 60, and the power to be supplied to the heater 3, are started. At the time $\tau_1$, the B4 size sheet P arrives at the fixing nip. At the time $\tau_2$ the sheet comes out of the fixing nip N after staying in the nip for the duration of $t_c$ ($=\tau_2-\tau_1$).

After the duration of $t_0$ (for example, five seconds) since the copying operation begins, the second image formation signal is issued from the MPU 19, and the sheet P is fed. Then, the second sheet enters the nip N at the time $\tau_3$, with the interval having the predetermined duration of $t_i$ since the first sheet came out of the nip N.

From this point on, the above described process is repeated until the fifth image formation signal is issued.

When the fifth sheet is detected by the. unshown discharge sheet sensor at the time $\tau_4$ as it comes out of the nip, the target temperature for T1 is lowered from T1' to T1".

Since the heat capacity of the heater 1 is sufficiently small, the temperature T1 detected by the first thermistor 5A for executing a thermostatic control can be quickly dropped to T1" by reducing the power supplied to the heater 1.

Following this drop, the temperature T2 detected by the second thermistor 5B also falls.

Around this point of time, when the temperature setting of T1 is switched, the count of the finished copies is still small, and the value of |T2−T1| hardly changes.

The temperature T2 detected by the second thermistor rises for the duration of $t_c$ of the sheet passage, because of so-called non-passage region heat accumulation, but falls during the interval with the duration of $t_i$.

However, the temperature T2 gradually rises in macro terms.

Since the temperature T1 within the sheet passage region is kept at T1" or T1', the value (hereinafter, referred to as Δ) of |T2−T1| resultantly increases.

After the 53rd image formation signal is issued at the time $\tau_5$, the value of |T2−T1| reaches a predetermined value of Δ2 (50° C.) at the time $\tau_6$ ($\tau_6 < \tau_5+t_0$) before the next, the 54th, image formation signal is issued.

When the temperature within the non-passage region rises in the above mentioned manner, and the difference between the temperatures detected by the second thermistor 5B and the first thermistor 5A exceeds the predetermined value of Δ2, the microcomputer MPU 13 extends the duration of the interval during the continuous image forming operation.

In other words, the image formation signal is not issued even if the duration $t_0$ will have passed since the time $\tau_5$, and then, after the additional duration of $t_1$, the 54th image formation signal is issued at the time $\tau_7$ ($\tau_7=\tau_6+t_0+t_i=\tau_6+t_c+2t_i$). Then, the duration of intervals between the sheets entering the fixing nip, which remains to be $t_i$ while the first to 53rd sheets are processed, is doubled to $2t_i$ between the 53rd and 54th sheets. From this point on to the 100th image formation, the intervals between the image formation signals sent out of the MPU 19 is $t_0'$ ($=t_0+t_i$), which is longer than the initial one. Therefore, the difference in the amount of heat radiation per unit time from the heater surface between the locations of the second and first thermistors becomes smaller compared to the initial one. Consequently, the temperature T2 detected by the second thermistor drops, reducing the temperature difference |T2−T1|.

As a result, the temperature variance across the longitudinal direction of the film, heater, driving roller, and the like remains within a predetermined range; therefore, running anomalies, such as lateral shifting of the fixing film 6 formed in an endless belt, does not occur, and abnormal temperature rise within the non-passage region can also be prevented.

It is especially effective in the device with provision of multiple fixing temperature settings to vary the duration of the interval according to the difference between T2 and T1, as determined by calculating means in the above mentioned manner.

Incidentally, it is also preferable that the duration of interval be restored to $t_1$ by shortening when: the value Δ of T2−T1 exceeds the predetermined one; the duration of interval is extended; Δ becomes sufficiently smaller to take the value Δ2' (30° C. <2) which affords the device some thermal margin; and it is also preferable that the duration of interval be extended if the A again exceeds Δ2.

Figure 21:
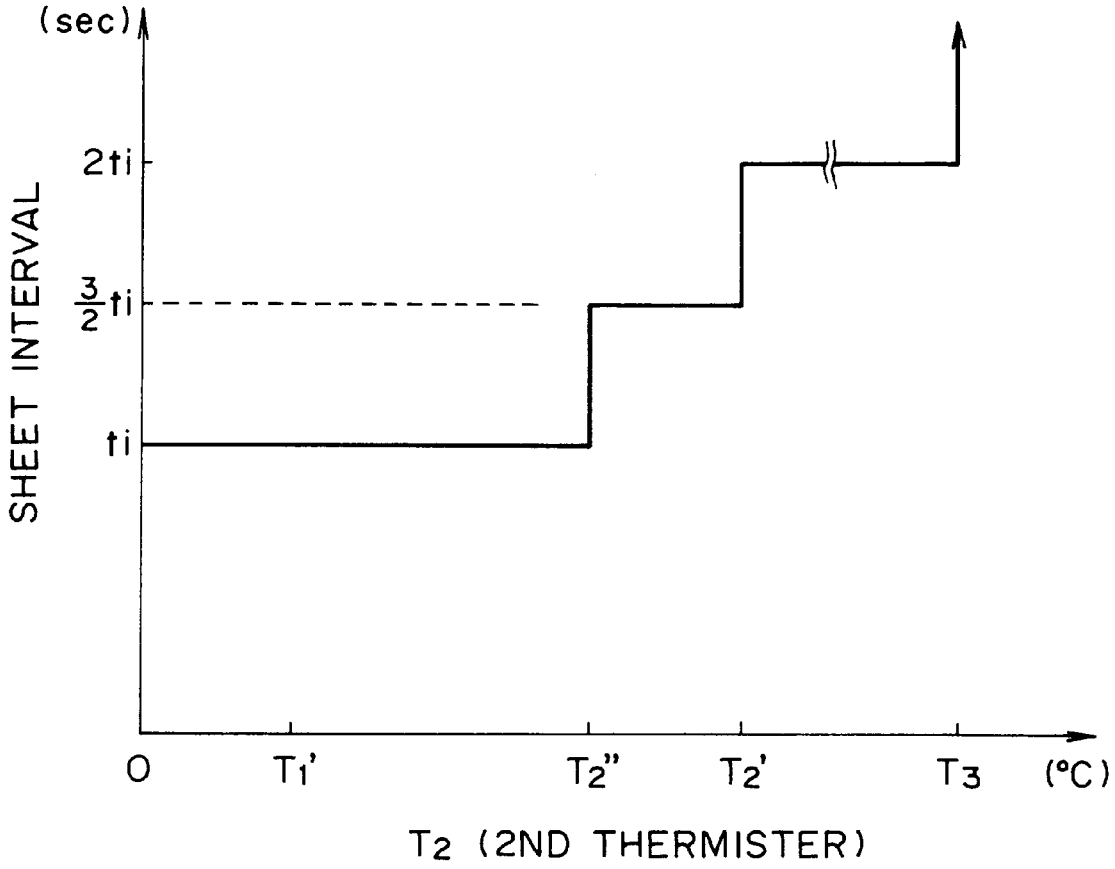
FIG. 21 is an explanatory drawing to describe a further embodiment of the present invention.

Further, the T2 in the FIG. 21 may be substituted by T2−T1, whereby the duration of interval is changed at Δ1 and Δ2, and the device is stopped at Δ3.

Further, it is also preferable to switch the value at which the duration of interval is switched, according to the recording material size or the amount of supplied power.

Next, an embodiment is described in which the temperature rise within the non-passage region is prevented by changing the heat processing speed according to the temperature detected by the second temperature detecting member.

EMBODIMENT 22

Figure 23:
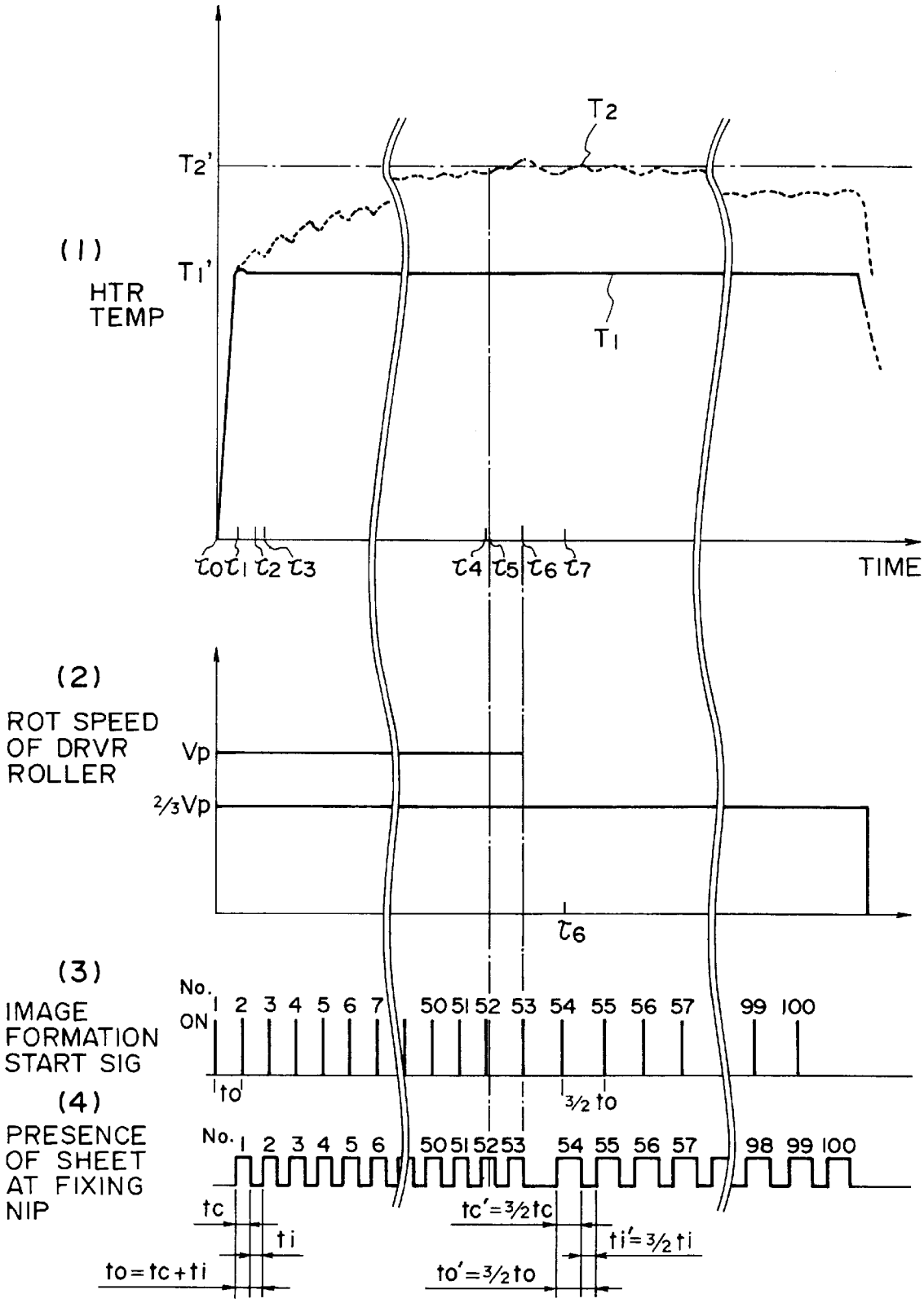
FIG. 23 is an operational timing chart for another embodiment of the present invention.
Figure 24:
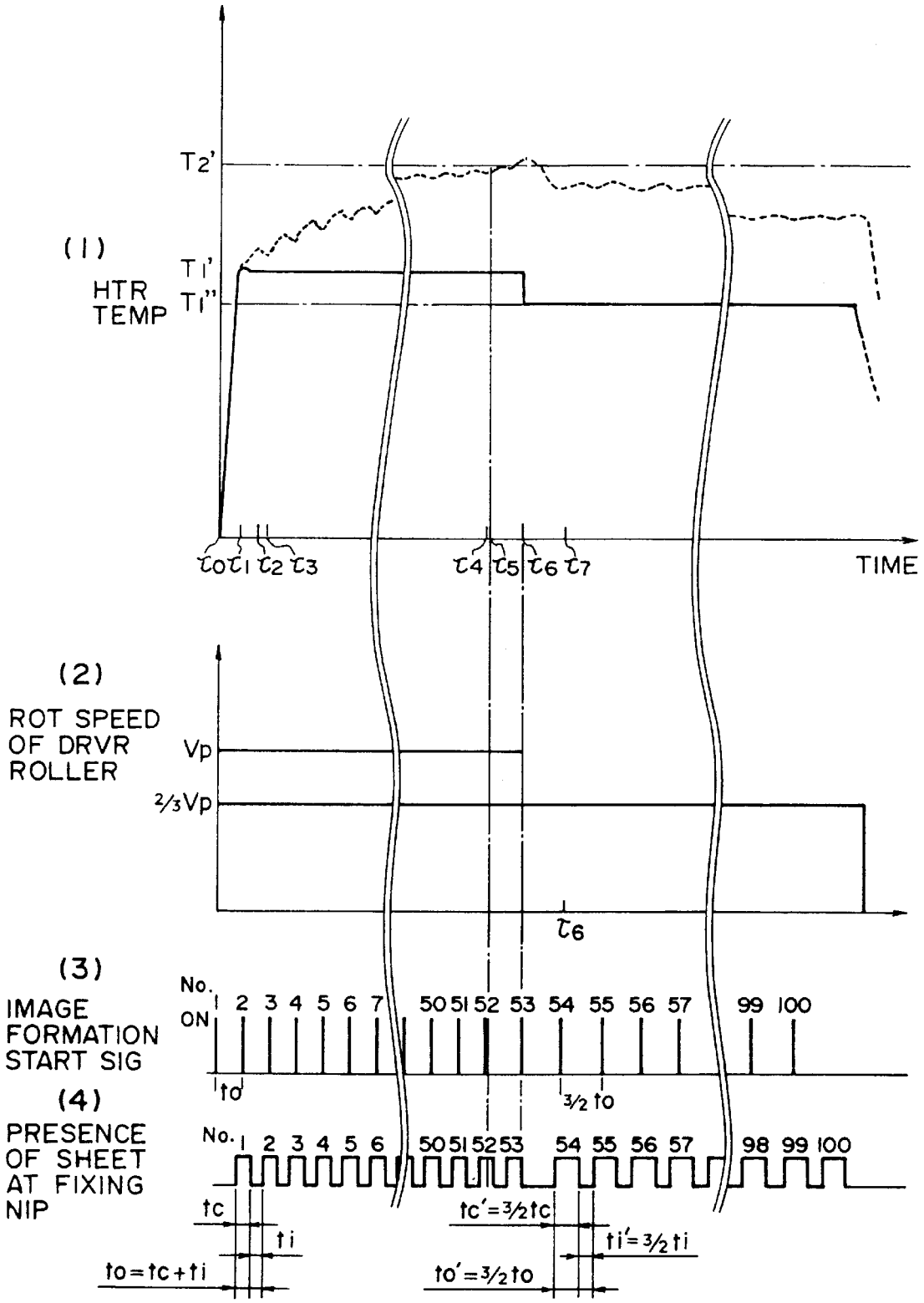
FIG. 24 is an operational timing chart for another embodiment of the present invention.

FIG. 23 is a timing chart for the embodiment 22, in which the copy count is set to be more than two (for example, 100 copies) before the copy start key is depressed, and in which the B4 size (257 mm wide) sheets with a basis weight of 80 $g/m_2$ are continuously fixed. FIG. 23 consists of four graphic sections showing: (1) time-based changes of the temperatures T1 and T2 detected by the first and second thermistors, respectively: (2) time-based change of the peripheral speed of the driving roller 7; (3) timing at which the image formation start signal is issued from the microcomputer MPU 19; and (4) timing at which the sheet P is passed through the fixing nip N ("present" refers to when the sheet is passing, and "absent" refers to when the sheet is not passing).

The image formation start signal in this embodiment is a signal issued from the microcomputer MPU 13 to initiate the image forming operation, that is, to activate the unshown clutch which controls the movement of the feed roller 61, and the optical system which includes the light source 21.

In order for the detected temperature T1 to be kept at the constant fixing temperature T1', (for example, 190° C.), a predetermined amount of power which corresponds to the value of T1 is supplied by the power source and heater driving circuit.

As soon as the copy key is depressed at the time $\tau_0$, the image formation signal is transmitted from the MPU 19 to the feed roller, high voltage power source, main motor driving circuit, optical system driving circuit, and the like. Then, the feed roller 61 begins to rotate, and the sheet P is conveyed toward the transfer charger 34. Simultaneously, the light source 21 and the like begin to move forward at the speed of $V_0$ (for example, 100 mm/sec), and the photosensitive drum 39 which starts to rotate at the same speed of V0 begins to be exposed. Simultaneously at the time $\tau_0$, the power begins to be supplied to the heater 1, and the fixing film 6 begins its rotational movement at the speed of approximately $V_0$, in the fixing device 60.

At the time $\tau_2$, the B4 size sheet P reaches the fixing nip N. By this time, the temperatures T1 and T2 detected by respective thermistors will have risen from the room temperature to T1' at approximately the same speed. While the sheet P is passing through the nip N, T1 is maintained at T1', but T2 rises above T1' due to the so-called non-passage region heat accumulation. The sheet P comes out of the fixing nip N after staying in the nip N for the duration of $t_c$ ($=\tau_2-\tau_1$).

The second image formation signal is issued from the MPU 19 after the duration of $\tau_0$ (for example, five seconds) since the copy key is depressed, and the sheet P is fed. After the first sheet comes out of the nip N, the second sheet enters the nip N at the time $\tau_3$, with the interval having the predetermined duration of $t_i$. From this point on, the above mentioned operations are repeated for a while.

The temperature T2 detected by the second thermistor climbs for the duration of $t_c$ while the sheet is being passed, and falls for the duration $t_i$ of the interval, but in macro terms, gradually climbs.

Then, after the 53rd image formation signal is issued at the time $\tau_4$, and while the 52nd sheet P is passing through the fixing nip N, the temperature T2 detected by the second thermistor 5B reaches the predetermined temperature T2' (here, 240° C.) at the time $\tau_5$.

If the temperature of the non-passage region increases and the temperature detected by the second thermistor 5B within the non-passage region exceeds T2', which is 50° C. higher than the fixing temperature T1, the microcomputer 13 extends the duration of the interval during the continuous image forming operation, for a start.

In other words, the image formation signal is not issued even after the duration of $t_0$ will have passed since the time $\tau_4$. Then, the next, the 54th, image formation signal is issued at the time $\tau_6$ when the 53rd sheet P, which is exposed to the fixing process at the speed of Vp, is detected by the unshown sensor as it comes out of the nip. Simultaneously, at the time $\tau_6$, in response to the signal from the MPU 13, the main motor driving circuit and optical system motor driving circuit reduce, by a predetermined amount, the duty ratio of the voltage applied to the main motor and optical system motor, to slow the rotational speed of these motors to ⅔ their speed. Further, at about the time $\tau_6$ the voltages applied from the high voltage power source to the primary charger 30, transfer charger 34, discharging needles 35, and developing sleeve 32 are changed, with a predetermined timing, to obtain proper image transfer properties. The 55th image formation signal is issued at the time $\tau_7$ when is ⅜ the duration of $t_0$ after the 54th image formation signal is issued. From this point on to the 100th copy, the image formation signals are issued from the MPU 13, with intervals having a duration of ⅜ $t_0$.

After the 54th copy, the duration $t_c'$ it takes for the sheet to pass through the fixing nip is ⅜ $t_c$, in other words, it is extended ⅜ times the duration for the early stage of copying operation. Further, the duration of $t_i'$ of the sheet interval is ⅜ $t_i$, in other words, it is extended ⅜ times the duration for the early stage of copying operation. Therefore, the number of sheets passing through the fixing nip per unit time becomes ⅔. Since the rate of the temperature rise within the non-passage region is proportional to the amount of heat robbed by the sheet P within the passage region per unit time and per unit length in the longitudinal direction, the temperature T2 detected by the second thermistor which is located where the non-passage region heat accumulation occurs falls. After the 54th copy, the fixing process speed slows down to ⅔ the preceding speed, and the non-passage region heat accumulation declines.

COMPARATIVE EXAMPLE

One hundred copies were continuously made in the same manner as the above mentioned embodiment, except that the fixing process speed and the sheet interval were kept constant without being changed.

At the 100th copy, the temperature reached the point where T=260° C.

Then, the film laterally shifted toward the side with the higher temperature, and the film edge was damaged.

Further, after this operation of making 100 copies was repeated 20 times (a total of 2,000 copies), damage occurred to the coating of the fixing film.

EMBODIMENT 23

FIG. 5 shows a timing chart for the 23rd embodiment.

In this embodiment, the target temperature of the fixing heater is also lowered as the fixing process speed becomes slower.

In other words, the MPU 13 switches the target temperature from T1' (190° C.) to the lower temperature T1" (175° C.) at the time $\tau_6$.

Since the fixing speed is dropped from Vp to ⅔ Vp after the time $\tau_6$, the fixing process is properly carried out even at a temperature which is lower than T1'.

Since the amount of heat robbed per sheet becomes smaller as described above, and also, since the temperature within non-passage region naturally falls as the target temperature is lowered, the nonpassage region heat accumulation becomes further smaller.

EMBODIMENT 24

In the same manner as in the first embodiment, when the temperature of the non-passage region climbs here T2≧T2', the fixing speed is lowered to ⅔ Vp.

Then, after the temperature of the non-passage region falls and the temperature detected by the thermistor 5B comes down below the predetermined temperature T2" (=220° C., T2<T2'), the next operational step is carried out.

After all of the image forming operations (which includes sheet feeding, exposure, and fixing) which are being carried out at the time when the temperature reaches where T2<T2", are completed, the speeds of the main motor and optical system are restored to the initial ones (restored to the drum rotation spherical velocity of Vp). Simultaneously, the detected temperature T1 is raised from T1" to T1'. Further, the conditions under which the voltage is applied to the charger and the like are all restored with the predetermined timing.

From this point on, the copying operation is continued under these conditions (initial conditions), and when the temperature again reaches where T2>T2', the image forming speed is slowed down by the method demonstrated in the Embodiment 2.

According to this embodiment, the damage caused by the non-passage region heat accumulation can be prevented while minimizing the drop in the copy count per unit time during the continuous image forming operation.

Incidentally, the fixing speed is switched in two steps in the first to third embodiments, but it may be switched in finer steps, or in a stepless manner.

EMBODIMENT 25

The rate of the non-passage region heat accumulation varies depending on the size of sheet being passed, in particular the distance from the sheet edge.

Therefore, in this embodiment, the recording material size is detected by the unshown size detecting means, and the value of the temperature T2', which changes the fixing speed, is switched according to this recording material size.

In other words, the fixing speed is lowered in proportion to the distance between the sheet edge and the second thermistor. For example, T2'=240° C. when the B4 sheet is passed; T2'=235° C. for the A4 size sheet; and T2'=225° C. when the A6 size sheet is passed.

Because of this reason, the heater surface temperature climbs as high as 255° C. if T2=240° C. when the sheet of the A6 size, the smallest size, is passed. However, the maximum heater surface temperature can be kept lower regardless of the recording material size, by switching the temperature, which changes the fixing speed, according to the recording material size.

Further, while the sheets are being passed, the power supply to the heater (voltage or wattage) is detected in addition to the recording material size, and the larger the supplied power is, the lower the temperature T2' is set to lower the temperature T2'.

Since the heat capacity of the recording material, in addition to the recording material size, is taken into consideration by this detection of the power supply, far better results can be obtained.

EMBODIMENT 26

Figure 25:
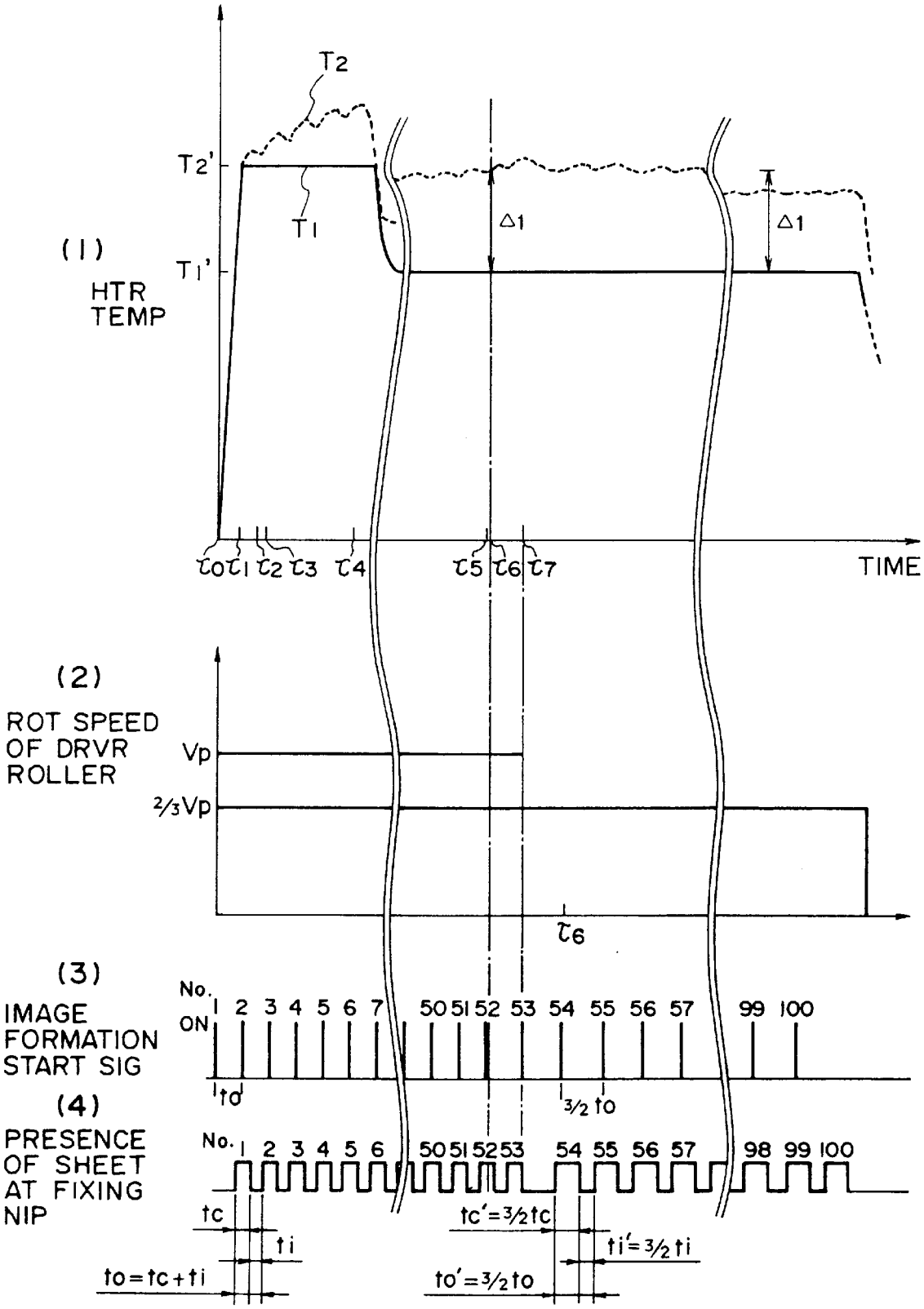
FIG. 25 is an operational timing chart for another embodiment of the present invention.

FIG. 25 presents four graphic charts for the 26th embodiment in which 100 copies are made using the B4 size (257 mm wide) recording material sheet with a basis weight of 80 g/m$^2$: (1) time-based changes of the temperatures T1 and T2 detected by the first and second thermistors, respectively; (2) time-based changes of the peripheral speed of the driving roller 7; (3) timing when the image formation start signal is issued; (4) timing when the sheet P is passing through the fixing nip N ("present" refers when the sheet P is passing, and "absent" refers when the sheet P is not passing). In this embodiment, the predetermined amount of power which corresponds to the value of T1 is supplied by the power source and heater driving circuit, so that the temperature T1 detected by the first thermistor 5B remains at T1' (for example, 225° C.) during the period from the time when the copy start key is depressed to the time when the fifth sheet passes through the fixing nip, and from that point on, at T1" (for example 190° C. in this embodiment, however T1"<T1').

The reason why the temperature T1 is set lower after the fixing process of the fifth sheet is completed is to prevent the temperature increase of the device. Since the temperatures of the pressing roller and the like sufficiently rise through the heating process of the first to fifth sheets, there is no problem as far as the fixing quality of the sixth copy is concerned. In this embodiment, the temperature is lowered 35 degrees between the fifth and sixth sheets, but the temperature may be gradually lowered in steps ranging from 5 degrees to 20 degrees for a single sheet or double sheets.

Substantially, as soon as the copy key is depressed at the time $\tau_0$, the image formation start signal is transmitted from the MPU 19 to the feed roller, high voltage power source, main motor driving circuit, optical system driving circuit, and the like. Then, the feed roller 61 begins to rotate, and the sheet P is conveyed toward the transfer charger 34. Simultaneously, the light source 21 and the like begins to move forward at the speed of $V_0$ for example, 100 mm/sec), and the photosensitive drum 39 which starts to rotate at the same speed of $V_0$ begins to be exposed. Simultaneously, at the time $\tau_0$, the power begins to be supplied to the heater 1, and the fixing film 6 begins its rotational movement at a speed of approximately $V_0$, in the fixing device 60.

At the time $\tau_1$, the B4 size sheet P reaches the fixing nip N. By this time, the temperatures T1 and T2 detected by respective thermistors will have risen from room temperature to close to T1' at approximately the same speed. While the sheet P is passing through the nip N, T1 is maintained at approximately T1', but T2 rises above T1' due to so-called non-passage region heat accumulation. The sheet P comes out of the fixing nip N after staying in the nip N for the duration of $t_c$ ($=\tau_2-\tau_1$).

After the duration of $t_0$ (for example, five seconds) since the copy key was depressed, the second image formation signal is issued from the MPU 19, and the sheet P is fed. Then, after the first sheet comes out of the nip, the second sheet enters the nip N at the time $\tau_3$, with an interval having the predetermined duration of $t_i$. From this point on, the above described process is repeated.

The temperature T2 detected by the second thermistor rises for the duration of tc while the sheet is being passed, and falls for the duration $t_i$ of the interval, but in macro terms, it gradually rises.

When the fifth sheet is detected by the unshown discharge sheet sensor at the time $\tau_4$ as it comes out of the nip, the target temperature for T1 is lowered from T1' to T1". Since the heat capacity of the heater 1 is sufficiently small, the temperature T1 is quickly dropped to T1" by reducing the power supplied to the heater 1. Following this drop, the temperature T2 also falls in the same manner (the value of |T2−T1| hardly changes around the point where the temperature setting of T1 is switched).

In macro terms, the temperature T2 detected by the second thermistor gradually rises as described above. On the other hand, since the temperature T1 is accurately maintained (T1' or T1"), the value of T2−T1 (hereinafter, referred to as Δ) gradually rises.

Then, after the 53th image formation signal is issued at the time $\tau_4$, and while the 52nd sheet P is passing through the fixing nip N, the value of the A reaches the predetermined value ΔL (here, 50 degrees) at the time $\tau_5$. Then, the image formation signal is not issued even after the duration of $t_0$ will have passed since the time $\tau_4$. The next, the 54th, image formation signal is issued at the time $\tau_6$ when the 53rd sheet P is detected by the unshown sensor as it comes out of the nip after being exposed to the fixing process at the speed of Vp. Simultaneously, at the time $\tau_6$, in response to the signal from the MPU 19, the main motor driving circuit and optical system motor driving circuit reduce, by a predetermined amount, the duty ratio of the voltage applied to the main motor and optical system motor, as shown the rotational speed of these motors to ⅔ the speed. Further, at about the time $\tau_6$, the voltages applied from the high voltage power source to the primary charger 30, transfer charger 34, discharging needles 35, and developing sleeve 32 are also changed, with a predetermined timing, to obtain proper image transfer properties. The 55th image formation signal is issued at the time $\tau_7$ when is ⅜ the duration of $t_0$ after the 54th image formation signal is issued. From this point on to the 100th copy, the image formation signals are issued from the MPU 19, with intervals having a duration of ⅜ $t_0$.

After the 54th copy, the duration $t_c'$ it takes for the sheet to pass through the fixing nip is ⅜ $t_c$, in other words, it is extended to ⅜ times the duration for the preceding stage of copying operation. Further, the duration $t_i'$ of the sheet interval is ⅜ $t_i$, in other words, it is extended to ⅜ times the duration for the preceding stage of copying operation. Therefore, the number of sheets passing through the fixing nip per unit time becomes ⅔. Since the rate of the temperature increase within the non-passage region is proportional to the amount of heat robbed by the sheet P within the passage region per unit time and per unit length in the longitudinal direction, the fixing speed slows down to ⅔ compared to the initial one. After the 54th copy, the temperature T2 detected by the second thermistor which is located in the region where the non-passage region heat accumulation occurs gradually comes down. Therefore, the temperature difference Δ also comes down, never again exceeding Δ1.

As a result, the temperature variance across the longitudinal direction of the film, heater, driving roller, and the like remains within the predetermined range (Δ); therefore, running anomalies, such as lateral shifting of the fixing film 6 formed in an endless belt do not occur, and abnormal temperature rise within the non-passage region can also be prevented.

It is especially effective in the device with the provision of multiple fixing temperature settings to vary the duration of interval according to the difference between T2 and T1 in the above mentioned manner.

Incidentally, it is also preferable to switch the target temperature from T1' (190° C.) to T1" (175° C.) as the value of T2−T1 comes to exceed the value Δ and the fixing speed is reduced.

Next, another embodiment is described, in which multiple temperature sensors are used together to keep the heater temperature constant.

EMBODIMENT 27

Figure 26:
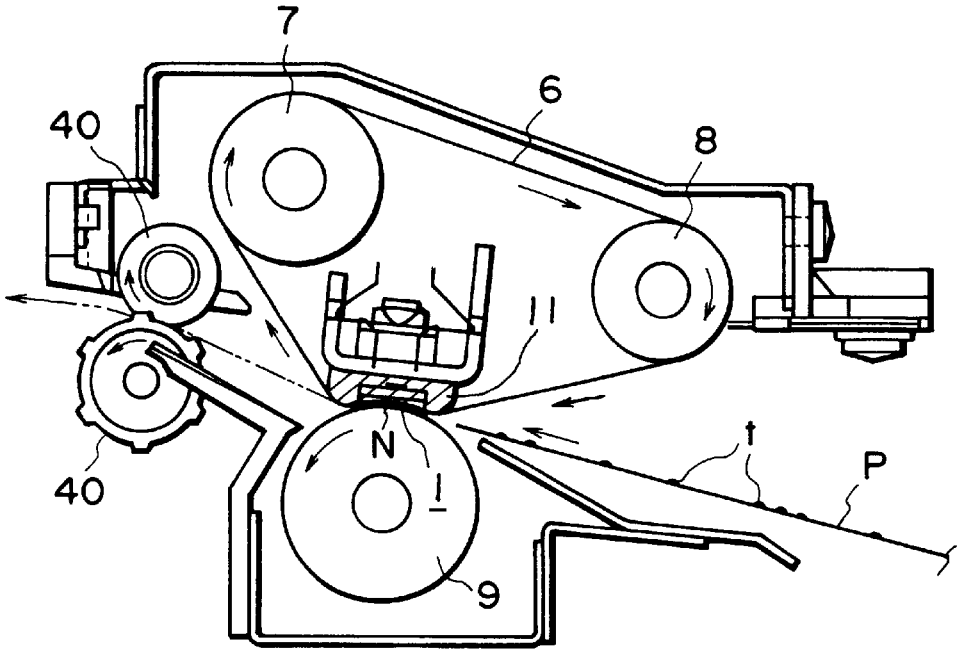
FIG. 26 is a sectional view of a fixing device, which is the image heating device in accordance with another embodiment of the present invention.

FIG. 26 is a sectional view of an image heating device in accordance with the embodiment of the present invention. Incidentally, the description is omitted since the structure is the same as that in FIG. 1.

Figure 27:
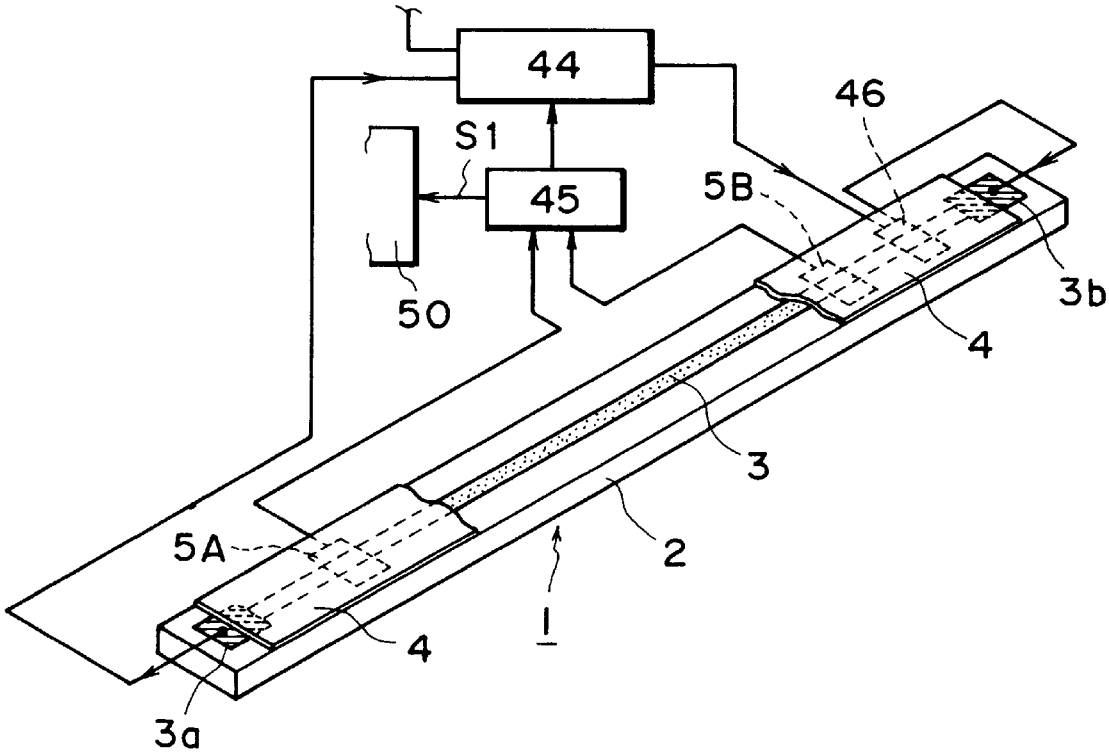
FIG. 27 is a combination of a partial perspective view of the heating element and a block diagram of the current control system.

The heating unit 1 is a linear heater comprising, as shown in FIG. 27, a heater substrate 2, exothermic layer 3, protective layer 4, temperature sensor 5 (A, B), and the like. FIG. 27 is a partially cut out perspective view of this heating unit 1, with its protective layer 4, which is on the side in contact with the film, facing upward.

The heater substrate 2 is an aluminum substrate measuring, for example, 1.0 mm thick, 10 mm wide, and 320 mm long, and on one of its surfaces, the exothermic layer 3 of silver-palladium or such, is coated to a 1.0 mm wide and a dozen or so microns thick formation, along the longitudinal direction.

Reference numerals 3*a* and 3*b* refer to power supply electrodes of silver or the like formed at both ends of the exothermic layer 3. The heater substrate surface where the exothermic layer 3 is formed is covered with the protective layer such as glass, except where the power supply electrodes 3*a* and 3*b* are. The heater substrate surface, opposite to the one where the exothermic layer 3 is formed, is in contact with the first and second temperature sensors 5A and 5B, such as thermistors.

The heating unit is fixedly supported, with its protective layer 4 facing downward (outward), on the mount 11 made of liquid crystal polymer or the like, which has heat resistance, thermally insulating properties, and high rigidity. In the heating unit 1, the power is supplied by a power circuit 44, between the power supply electrodes 3*a* and 3*b* located at each end of the exothermic layer 3, whereby this exothermic layer 3 generates heat across its entire length. The heater substrate 2 is heated by this generated heat and increases its temperature. The heating unit 1 rapidly increases its temperature since the exothermic layer 3, temperature sensor 5 (A, B), and the like have a low heat capacity, and also, it is supported on the mount 11 in a thermally insulated manner.

The temperature of the heater substrate of the heating unit 1 is detected by the temperature sensors 5 (A, B), and this information of the detected temperature is inputted to temperature control circuit 45. The temperature control circuit 45 controls the output of the power circuit 44, based on this inputted temperature information, so that the temperature of the heating unit 1 is maintained at a predetermined temperature. The temperature of the heating unit 1 is controlled in this manner. Reference numeral 46 refers to a thermo-fuse or thermo-switch, used as a safety device, which is interposed in series between the exothermic layer 3 and the power circuit 44, and also, in contact with the heater substrate 2.

Figure 28:
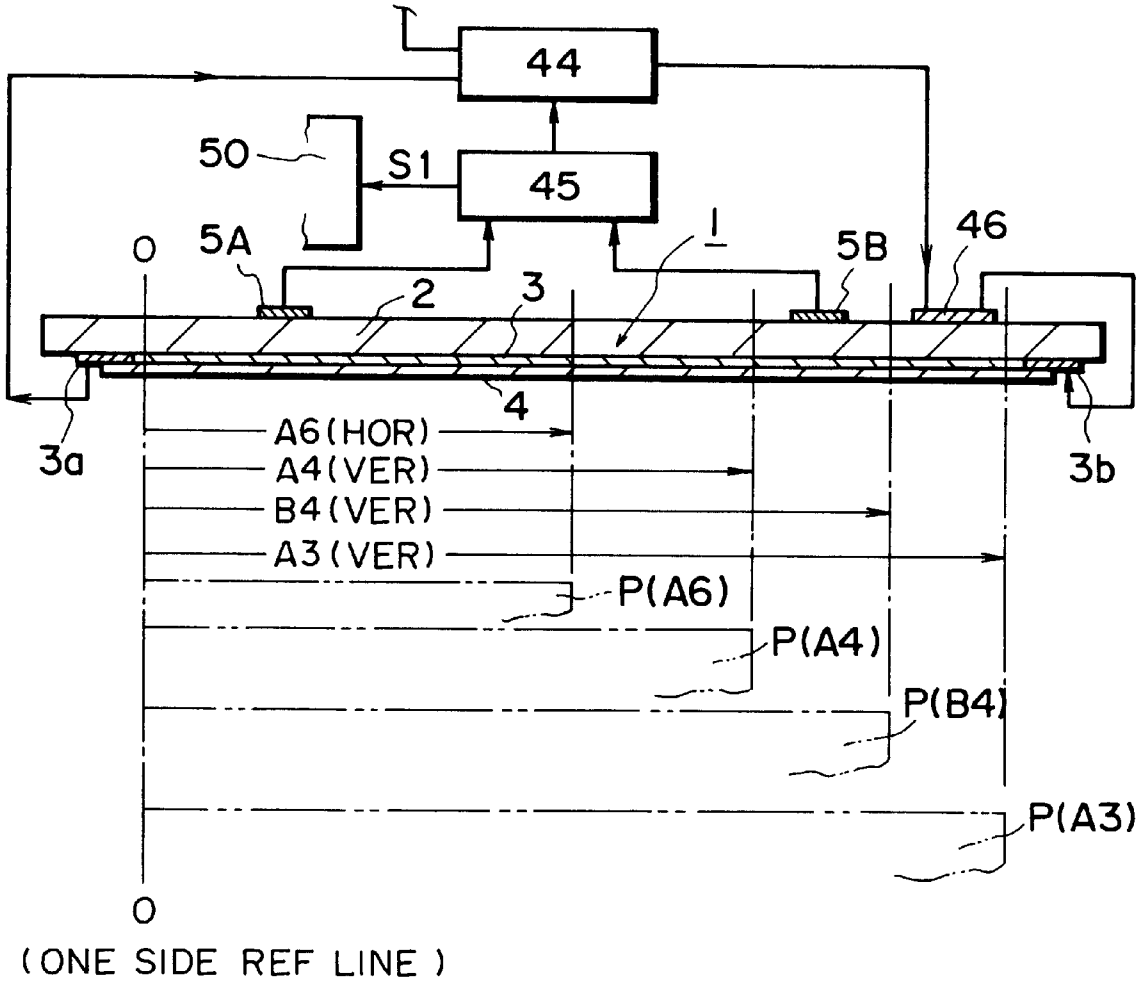
FIG. 28 is a drawing showing the positional relation between the heating element, regions within respective recording material passages, and temperature sensors.

FIG. 28 shows the positional relation between the heating unit 1, sheet passage region, and the temperature sensors 5 (A, B).

In this embodiment, the effective length of the exothermic layer 3 is 300 mm. The maximum sheet size is A3 (longitudinal feed), and the minimum sheet size is A6 (cross feed). The sheet alignment reference is single sided, in other words, the sheet is fed in alignment with the reference line 0—0 at the left end of the exothermic layer 3 in the drawing.

The first temperature sensor 5A is mounted on the heater substrate of the heating unit, at a location which corresponds to the passage of the A6 size recording material, in other words, at the location which falls within the passages of all the recording materials from A6 to A3 sizes.

The second temperature sensor 5B is mounted on the heater substrate of the heating unit, at a location which is in the passage zone of the B4 size recording material (cross feed) and which falls outside the passage of the A4 size recording material (longitudinal feed). The section of the heating unit where the second temperature sensor 5B is mounted is a non-passage region when the recording material of the A6 or A4 size is passed, in other words, the region where the heat accumulates because the sheet does not pass. It is a passage region when the sheet of the B4 or A3 size is passed; therefore, the non-passage region heat accumulation does not occur.

Figure 29:
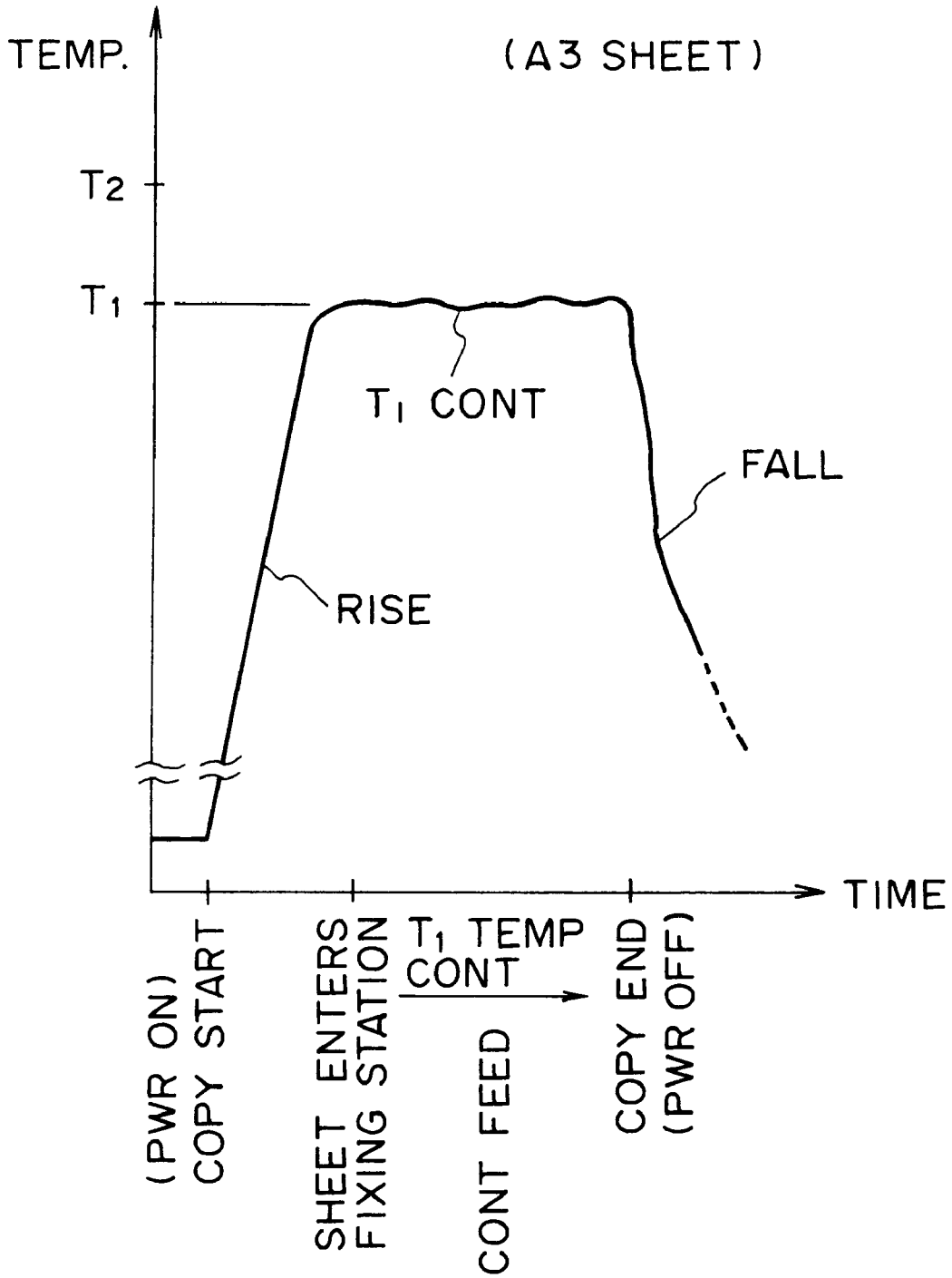
FIG. 29 is a graph showing the temperature fluctuation, under the control of the temperature control system for the heating element, during the passage of a large size recording sheet.
Figure 30:
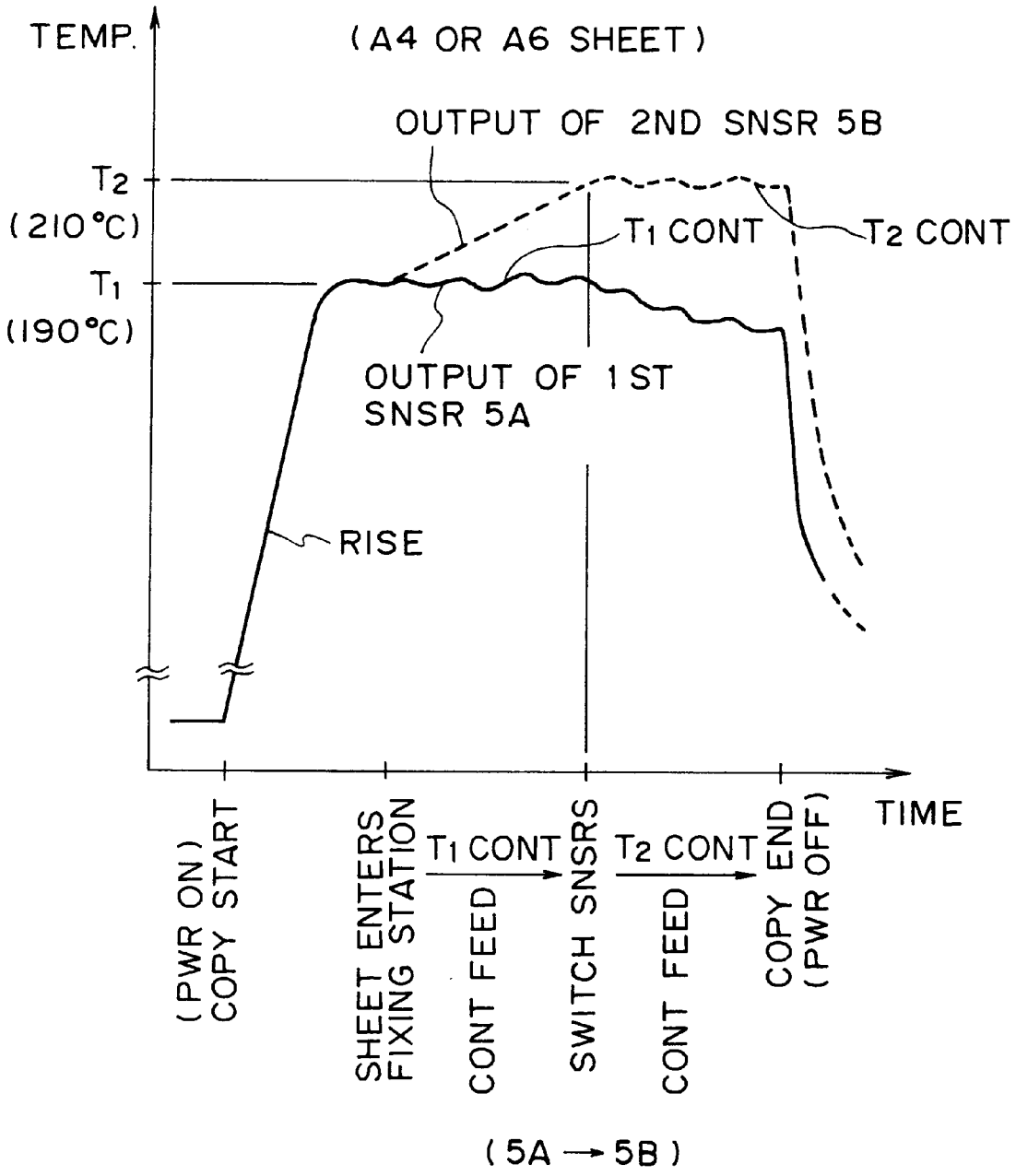
FIG. 30 is a graph showing the temperature fluctuation, under the control of the temperature control system for the heating element, during the passage of a small size recording sheet.

Thus, the above mentioned first and second temperature sensor 5A and 5B are used together to control the temperature of the heating unit 1 in such a manner as is shown in FIG. 29 or FIG. 30.

(1) Let it be assumed that the recording material of the A4 size, the maximum size, is fed as a recording material (see FIG. 29). When the copy button of the image forming apparatus is depressed, the power is supplied by the power circuit 44 to the exothermic layer 3, causing the entire length of the exothermic layer 3 to generate heat, whereby the entire length of the heater substrate, that is, the heater unit 1, is quickly and uniformly heated up. The information about the temperature of the heating unit 1, which are detected by the first and second temperature sensors 5A and 5B, respectively, and inputted to the temperature control circuit 45, are approximately the same temperature information. Normally, the temperature information detected by the first sensor takes precedence, and when the temperature control circuit 45 determines, based on this first temperature information, that the heating unit 1 has reached the predetermined first target temperature T1, it controls the power circuit 44, so that the temperature of the heating unit 1 is maintained at this first target temperature T1, which in turn controls the power supply to the exothermic layer 3. This first target temperature T1 is established to be a temperature at which the toner image t carried on the recording material P can be satisfactorily fixed. Up to this point, the temperature of the heater unit 1 rapidly rises (several seconds) since the heating unit 1 is a low heat capacity heater.

Next, the A3 size recording material P carrying the toner image t formed in the image forming section is introduced into the fixing device, and the toner image t is thermally fixed as described previously. In this case, since the entire length of the exothermic layer 3 is the passage region, heat is uniformly robbed across the entire length of the heating unit 1 by the recording material; therefore, the non-passage region heat gain does not occur on the heating unit 1 even while the recording materials are continuously passed.

Consequently, the temperatures of the heating unit 1 sensed by the first and second temperature sensors 5A and 5B are always remains approximately the same. The second temperature sensor 5B constantly monitors the temperature of the heating unit 1, but it does not get directly involved in controlling the power supply to the exothermic layer 3 unless an abnormal temperature is sensed, and the temperature control is executed to maintain the temperature of the heating unit 1 at the first target temperature T1, based on the temperature information from the first temperature sensor 5A.

After the passage of a single sheet or continuous passages of a predetermined number of sheets, the power supply to the exothermic layer 3 is cut off, and the temperature of the heating unit 1 quickly drops, while remaining in the standby state.

In this embodiment, even in case the recording material to be passed is the B4 size recording material, the same temperature controls as the one for the above mentioned A3 recording material is executed.

(2) Let it be assumed that the recording material of the A4 (longitudinal feed) or smaller size is passed (see FIG. 30). Up to the point where this recording material is introduced into the fixing device, the power supply and temperature are controlled in the same manner as in the case (FIG. 29) of the A3 (or A4) recording material.

When the recording materials are continuously fed, the first temperature sensor 5A detects the temperature of the passage region and this information is used to maintain the temperature of the heating unit 1 at the first target temperature, but the second temperature sensor detects the temperature of the non-passage region of the heating unit 1, where no heat is robbed from this section of the heating unit; therefore, the temperature of this region increases due to the heat accumulation. In other words, the second temperature sensor 5B senses a temperature higher than the first target temperature T1.

When the temperature control circuit 45 determines that the temperature detected by this second temperature sensor 5B has reached the second target temperature T2 which is predetermined degrees higher than the first target temperature T1, the temperature control circuit 45 controls the temperature of the heating unit 1, based on the temperature detected by the second temperature sensor 5*b*, so that the temperature of the heating unit 1 is maintained at this second target temperature T2 from this point on (primary temperature sensor is switched from the first temperature sensor 5A to the second temperature sensor 5B). Therefore, from this point on, the temperature changes of the heating unit 1 within the non-passage region follows the broken line of the graph in FIG. 30.

The above mentioned second target temperature T2 is set so that the heating unit 1 or fixing film 6 is not going to be subjected to heat damage caused by the rising temperature.

After the above mentioned target temperature switch, the power supply is controlled so that the temperature of the heating unit section within the non-passage region, where the amount of heat loss is small, is maintained at the second target temperature T2 as described above. Meanwhile heat is repeatedly robbed from the heating unit section within the passage region, during the continuous feeding, and the temperature of this section gradually falls in proportion to the amount of this heat loss. The toner image is satisfactorily fixed until the temperature of the heating unit section within the passage region drops to a predetermined target temperature.

By positioning on the heating unit 1 the first and second temperature sensor 5A and 5B, and controlling the temperature in the manner as described above, such problems as heat damage, that is, the prior faults, which occur on the heating unit or fixing film, can be avoided.

In this embodiment, the above mentioned effects can be obtained by making an arrangement, wherein First target temperature T1=190° C.

Second target temperature T2=210° C.

and, by positioning the first temperature sensor 5A at a location 100 mm from the single side reference line 0—0, and the second temperature sensor 5B at a location 260 mm from the same.

EMBODIMENT 28 (FIG. 31)

After the above mentioned target temperature switch, if a substantially large number of sheets are continuously fed or the recording materials to be passed are thick sheets, the temperature of the heating unit section within the passage region drops relatively quickly below the predetermined target temperature. If this drop continues without any change, it comes to a point where a fixing error occurs.

Therefore, the following means is used for avoiding this situation. The temperature of the heating unit section within the passage region is monitored by the first temperature sensor 5A, and at the time when it is sensed that the temperature has reached a predetermined third target temperature T3 (a predetermined temperature lower than the first target temperature T1), below which the fixing error occurs (see FIG. 31(*a*)), a signal S1 from the temperature control circuit 45 is inputted to a main control circuit 50 of the image forming apparatus. The operation to feed sheets into the image forming section is interrupted, and as soon as all of the recording materials fed before this point are discharged after coming through the fixing device, the copying operation of the image forming apparatus is immediately interrupted, by the main control circuit 50.

In this manner, even if the small size recording materials are fed, satisfactory fixing performance can be maintained until the copying operation is completed.

After the copying operation is temporarily interrupted, the copying operation can be resumed by executing a control for restoring the temperature of the heating unit 1 to the initial (first) target temperature T1 (for example, a control method in which the first temperature sensor 5A is used to restore the target temperature T1 while the fixing device is idled without carrying out the copying operation).

Figure 31A:
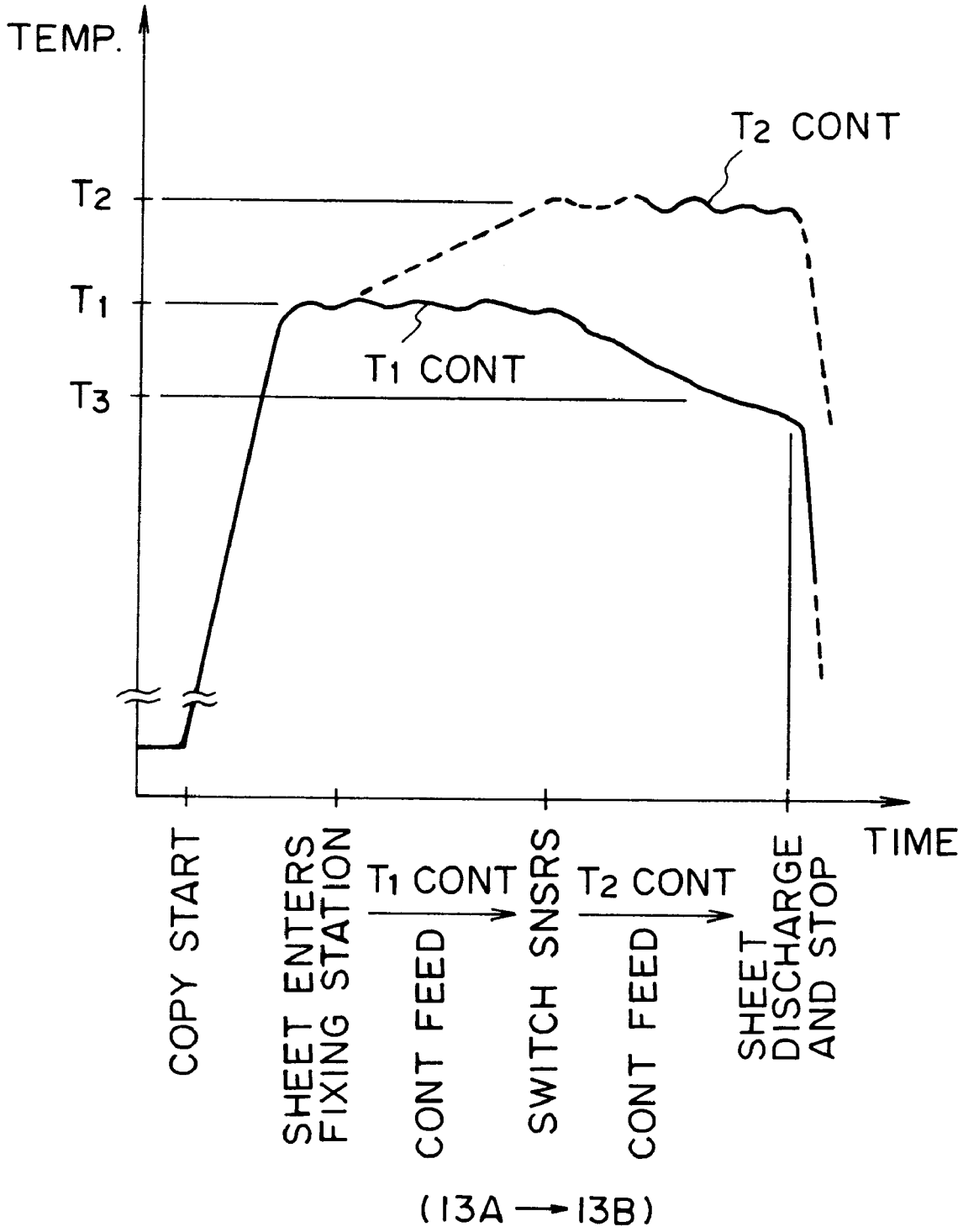
FIGS. 31(*a*) and 31(*b*) are graphs showing the temperature fluctuation, under the control of the temperature control system for the heating element, while a control is executed to interrupt the operation of the device.
Figure 31B:
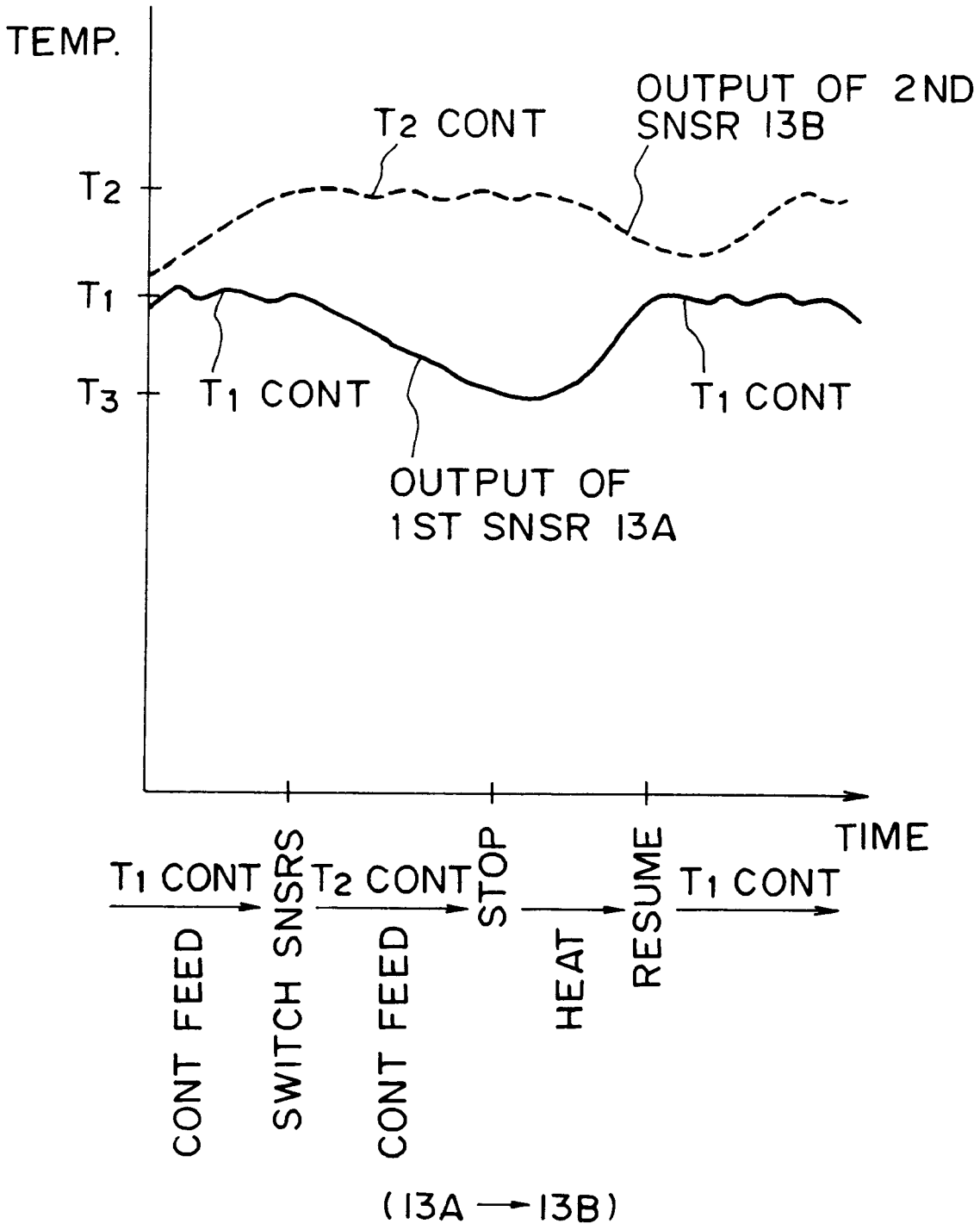

FIG. 31(*b*) shows the temperature fluctuation of the heating unit 1 at this time. After the above interruption, the copying operation is restarted as soon as the first temperature sensor 5A detects the first target temperature T1, to obtains the rest of the copies.

The temperature of the heating unit 1 is controlled to fall within a range in which the fixing performance is maintained, and the excessive temperature increase does not occur; therefore, the copy can be continuously made whether the size of the recording material is large or small.

EMBODIMENT 29 (FIG. 32)

As means for preventing the non-passage region heat accumulation in the heating unit 1, there is a method in which the non-passage heat accumulation in the heating unit is controlled by providing junctions on the exothermic layer, so that the heat generating range of the exothermic layer can be switched according to whether the size of the recording material is large or small.

Figure 32:
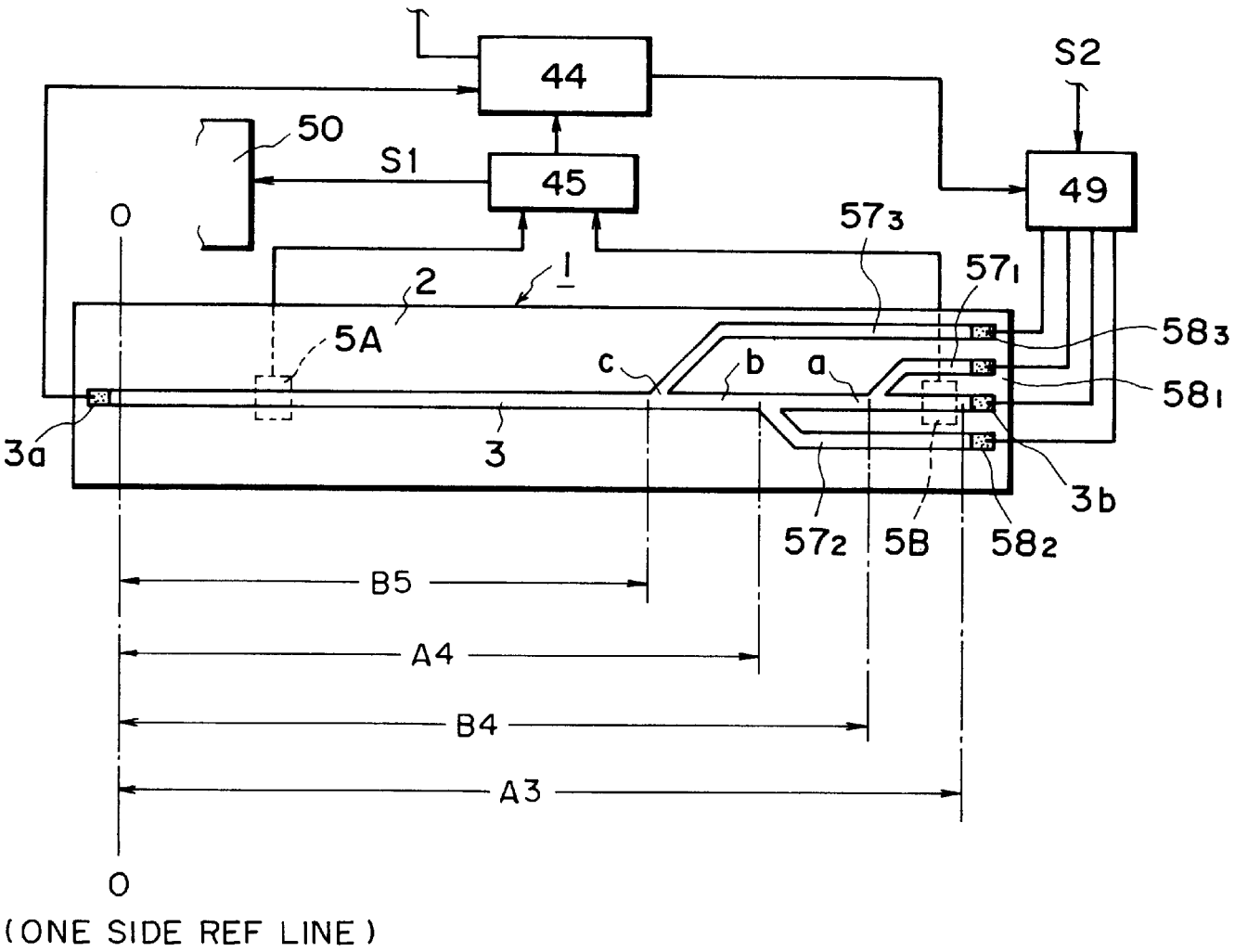
FIG. 32 shows the structural outline of a heat element provided with branch for the power supply.

FIG. 32 shows an example. The first to third branches $\mathbf{57}_1$ to $\mathbf{57}_3$ are extended from the exothermic layer 3. Reference numerals $\mathbf{58}_1$ to $\mathbf{58}_3$ refer to power supply electrodes at the ends of the branches $\mathbf{57}_1$ to $\mathbf{57}_3$.

(1) When the recording material is the A3 size recording material, which is of the largest size, the voltage is applied between the electrodes 3*a* and 3*b* at the respective ends of the exothermic layer 3, whereby the exothermic layer 3 generates a proper amount of heat across its entire range.

(2) In the case of the B4 size recording material, the voltage is applied between the electrodes 3*a* and 3*b*, and to the electrode $\mathbf{58}_1$ of the first branch $\mathbf{57}_1$, so that the exothermic layer 3 generates a proper amount of heat across its specific section that corresponds to the passage of the A4 size recording material, and the amount of heat generated across the section which corresponds to the non-passage region is restricted.

(3) In the case of the A4 size recording material, the voltage is applied between the electrodes 3*a* and 3*b*, and to the electrode $\mathbf{58}_2$ of the second branch $\mathbf{57}_2$, so that the exothermic layer 3 generates a proper amount of heat across its specific section that corresponds to the passage region of the A4 size recording material, and the amount of heat generated across the section which corresponds to the non-passage region is restricted.

(4) In the case of the B5 size recording material, the voltage is applied between the electrodes 3*a* and 3*b*, and to the electrode $\mathbf{58}_3$ of the third branch $\mathbf{57}_3$, and the exothermic layer 3 generates a proper amount of heat across its specific section that corresponds to the passage region of the B5 size recording material, and the amount of heat generated across the section which corresponds to the non-passage region is restricted.

As described above, the length of the heat generation section of the exothermic layer 3 is controlled according to the recording material size, and therefore, the heat accumulation within the non-passage region can be restricted.

The switch between the above mentioned current applications (1) to (4) that correspond to the recording material sizes is automatically carried out by the current switching circuit 49 which is controlled by a signal S2 from a cassette which stores the recording materials of various sizes. Therefore, the switch is made at the point in time when an operator selects the recording material size (selects a specific cassette), which is extremely effective for restraining the non-passage region heat accumulation.

However, when the recording material is manually fed instead of using the cassette, since it is difficult to detect the size of the manually fed recording material, the voltage is applied between the electrodes 3*a* and 3*b* at respective ends of the exothermic layer 3, to generate a sufficient amount of heat across the entire length of the heating unit, as if the recording material of the largest size were fed. Consequently, if the small size recording materials are manually fed in succession, the non-passage region heat accumulation occurs.

In this embodiment for eliminating the above problem, the first and second temperature sensors 5A and 5B are provided on the heater substrate 2 of the heating unit 1 in the same manner as in the Embodiment 27, and both of these temperature sensors 5A and 5B are used together to control the temperature of the heating unit 1.

The first temperature sensor 5A is positioned in contact with the heater substrate section which corresponds to the passage region of the recording material of the B4 size, the smallest size, and the second temperature sensor 5B is positioned in contact with the heater substrate section which corresponds to the exothermic layer section between a junction a (first junction) of the first branch $\mathbf{57}_1$ and the exothermic layer 3, and the electrode 3*b*.

In the case of cassette feeding, one of the branches $\mathbf{57}_1$ to $\mathbf{57}_3$ is automatically selected in response to the signal S2 which indicates the recording material size; therefore, the amount of power supply is automatically controlled as described in the above paragraphs (1) to (4), to control the temperature in conjunction with the first temperature sensor 5A.

In the case of manual feeding, the voltage is applied between the electrodes 3*a* and 3*b* to cause the entire length of the exothermic layer 3 to generate heat, and the first and second temperature sensors 5A and 5B are used together to control the temperature, so that the non-passage region heat accumulation is prevented, in the same manner as the Embodiments 27 and 28. With this arrangement, the non-passage region heat accumulation is restrained, and the excellent fixing performance can be maintained.

Figure 33:
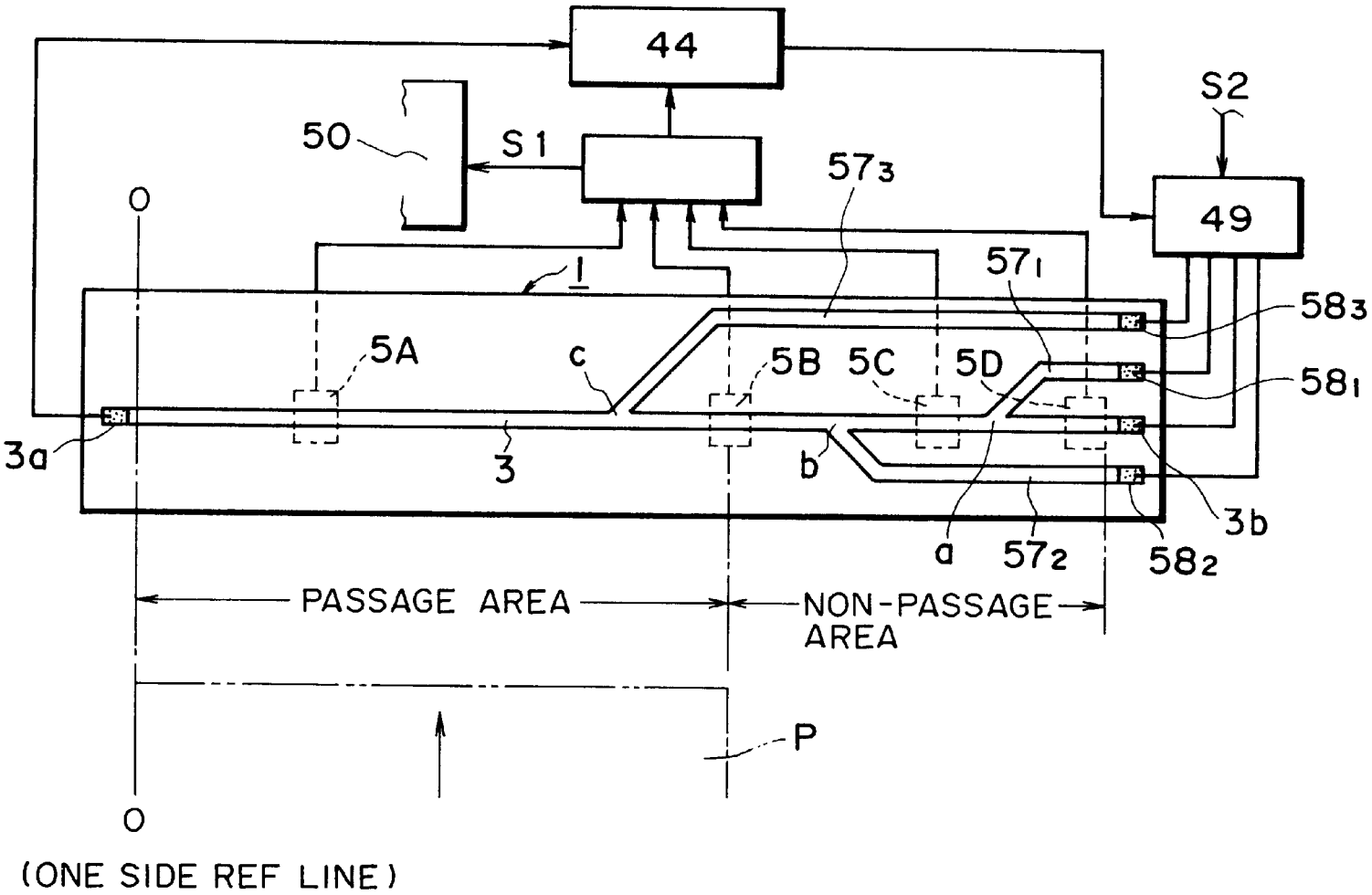
FIG. 33 is a drawing showing the structural outline of the multi-junction type heating element having four temperature sensors.
Figure 34:
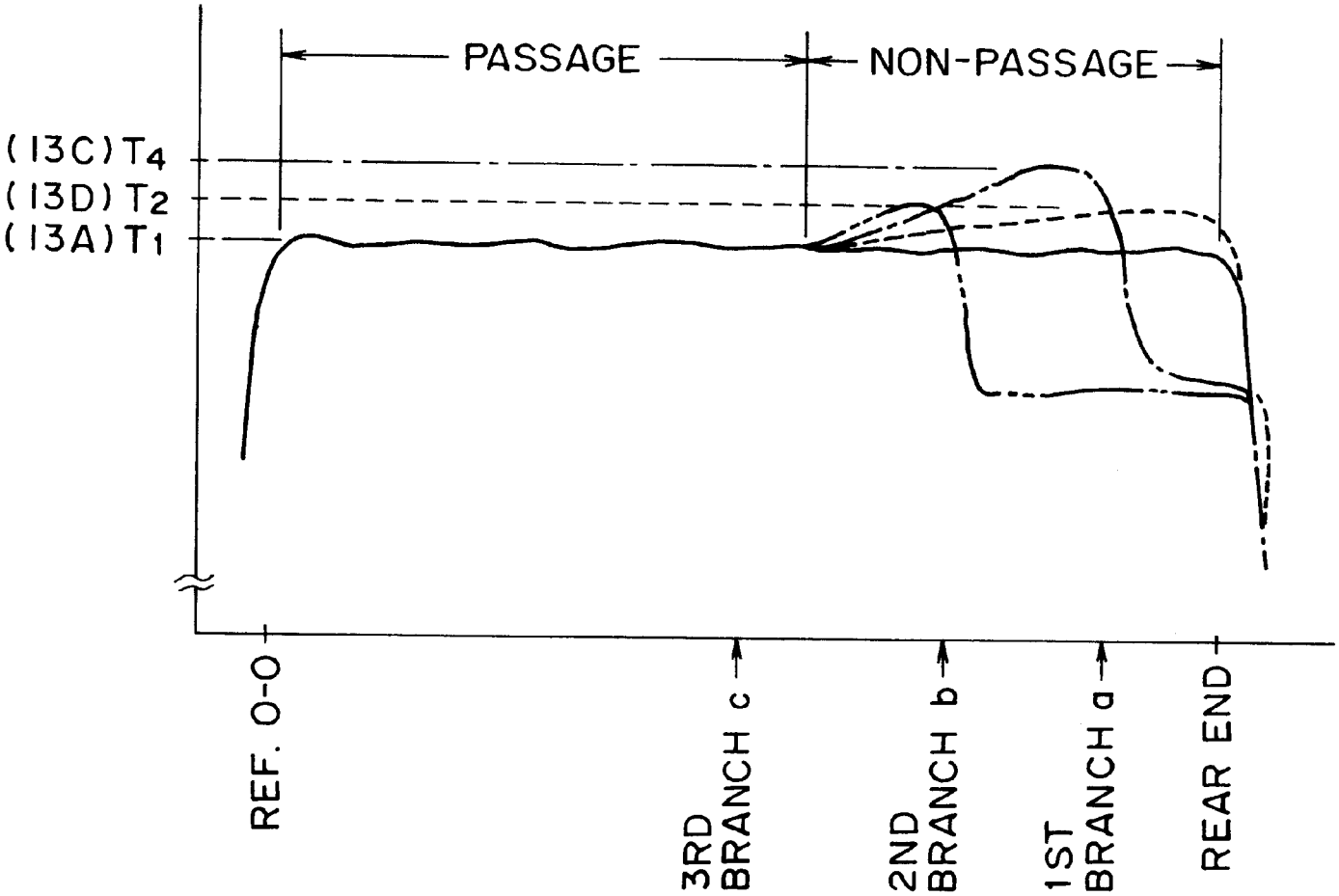
FIG. 34 is a graph showing the temperature distribution across the longitudinal direction of the heating element while this heating element is under the temperature control.

EMBODIMENT 30 (FIGS. 33 and 34)

The temperature of the heating unit 1 is controlled by a structure in which more than two temperature sensors are provided to be used together.

FIG. 33 presents such an embodiment. In this embodiment, the first temperature sensor 5A is positioned on the section of the heater substrate which corresponds to between the electrode 3*a* and a junction c (third junction) of the third branch $\mathbf{57}_3$ and the exothermic layer 3; the second temperature sensor 5B is positioned on the section of the heater substrate which corresponds to between the junction c (third junction) of the third branch $\mathbf{57}_3$ and the exothermic layer 3, and the junction b (second junction) of the second branch 572 and the exothermic layer 3; the third temperature sensor 5C is positioned on the section of the heater substrate which corresponds to between the junction b (second junction) of the second branch 572 and the exothermic layer 3, and the junction a (first junction) of the first branch $\mathbf{57}_1$ and the exothermic layer 3; and the fourth temperature sensor 5D is positioned on the section of the heater substrate which corresponds to between the junction a (first junction) of the first branch $\mathbf{57}_1$ and the exothermic layer 3, and the electrode 3*b*.

With such an arrangement in place, a case is described in which small size recording materials P are manually fed in succession so that the edge of the sheet P passes, for example, between the third junction c and the second junction b. The power is supplied to the exothermic layer 3 by applying the voltage between the electrodes 3*a* and 3*b*; therefore, the entire length of the exothermic layer 3 generates heat.

When the feeding of sheets begins, the first temperature sensor 5A is initially used to control the temperature of the heating unit 1, and the heating unit 1 displays a temperature distribution, as shown by the solid line in FIG. 34, which stays fairly close to the first target temperature T1.

As the feeding of sheets continues, the temperature of the section of the heating unit within the non-passage region climbs as shown by the broken line (a) in the graph. Then, when the fourth temperature sensor 5D detects the predetermined second target temperature T2, the power begins to be supplied through the first branch $\mathbf{57}_1$ so that the temperature of the heating unit section detected by this first sensor does not go up any further in excess. Therefore, the heating of the heating unit section between the first junction a and the electrode 3*b* is restricted.

However, the heating unit section between the third junction c and the first junction a keeps on climbing, displaying a temperature distribution as shown by a single dot chain (b) in the graph. Then, when the third temperature sensor 5C detects the predetermined fourth target temperature T4, the power begins to be supplied through the second branch $\mathbf{57}_2$ to prevent the excessive temperature increase in the heating unit section, which is detected by this temperature sensor 5C, and the temperature of the heating unit section between the second junction b and the first junction a declines. As a result, the temperature of the heating unit section within the non-passage region displays a two-dot chain line (c) in the graph.

The heating unit section between the third junction c and the second junction b remains as the non-passage region, but it is near the sheet edge, which allows the heat to flow into the passage region; therefore, its temperature does not rise as much as expected.

In this manner, switches can be made as needed between the branches $\mathbf{57}_1$ to $\mathbf{57}_3$, to prevent the non-passage region heat accumulation in the heating unit 1; therefore, the proper temperature can be fairly uniformly maintained across the heating unit section within the specific sheet passage even when the small size recording materials are manually fed.

So far, a heating device of film type was described with reference to fixing devices, but the same effects can be obtained by applying the present invention to a heating device of the heater roller type. Further, it is needless to say that the same effect can be obtained by applying the present invention not only to a device which uses a single side sheet passage reference, but also, to a device which uses a central sheet passage reference.

As described above, according to the present invention, the heating device, through the heating unit of which the material to be heated is fed and thermally processed, is provided with the heating unit which is controlled by the temperature control circuit to maintain the predetermined target temperature; wherein an excessive temperature increase (non-passage region heat accumulation) of the heating unit section within the non-passage region is prevented, to avoid such problem as high temperature offset, instability in film drive, heat damage of the heating unit, and the like, which occur in the fixing device of heat roller type, film type, and the like, while the heating performance of the heating unit is properly maintained within the sheet passage region.

The present invention has been described with reference to the above embodiments, but is not confined within the areas of those embodiment, and can be modified in various manner within the technical scope of the following claims.

What is claimed is:

1. An image heating apparatus, comprising:

a heater for heating an image on a recording material, said heater extending in a direction perpendicular to a moving direction of said recording material;

a first temperature detecting element positioned within a passage area of a predetermined smallest recording material, for detecting the temperature of said heater;

power control means for controlling electric power to said heater so that the temperature detected by said first temperature detecting element is maintained at a set temperature;

a second temperature detecting element positioned outside a passage area of the predetermined smallest recording material, for detecting the temperature of said heater; and control means for controlling feeding of a recording material, said control means controlling expanding of a recording material feeding interval when the temperature detected by said second temperature detecting element reaches a first predetermined temperature, and interrupting feeding of the recording material when the temperature detected by said second temperature detecting element reaches a second predetermined temperatures, which is higher than the first predetermined temperature.

* * * * *

UNITED STATES PATENT AND TRADEMARK OFFICE

CERTIFICATE OF CORRECTION

PATENT NO. : 5,915,146

DATED : June 22, 1999

INVENTOR(S): KENSAKU KUSAKA, ET AL.

It is certified that error appears in the above-identified patent and that said Letters Patent is hereby corrected as shown below:

COVER PAGE AT ITEM [56] FOREIGN PATENT DOCUMENTS:
"2157878 6/1990 Japan" should read --2-157878 6/1990 Japan--.

FIGURE 19:
"THERMSTER" should read --THERMISTER-.

Figure 20:
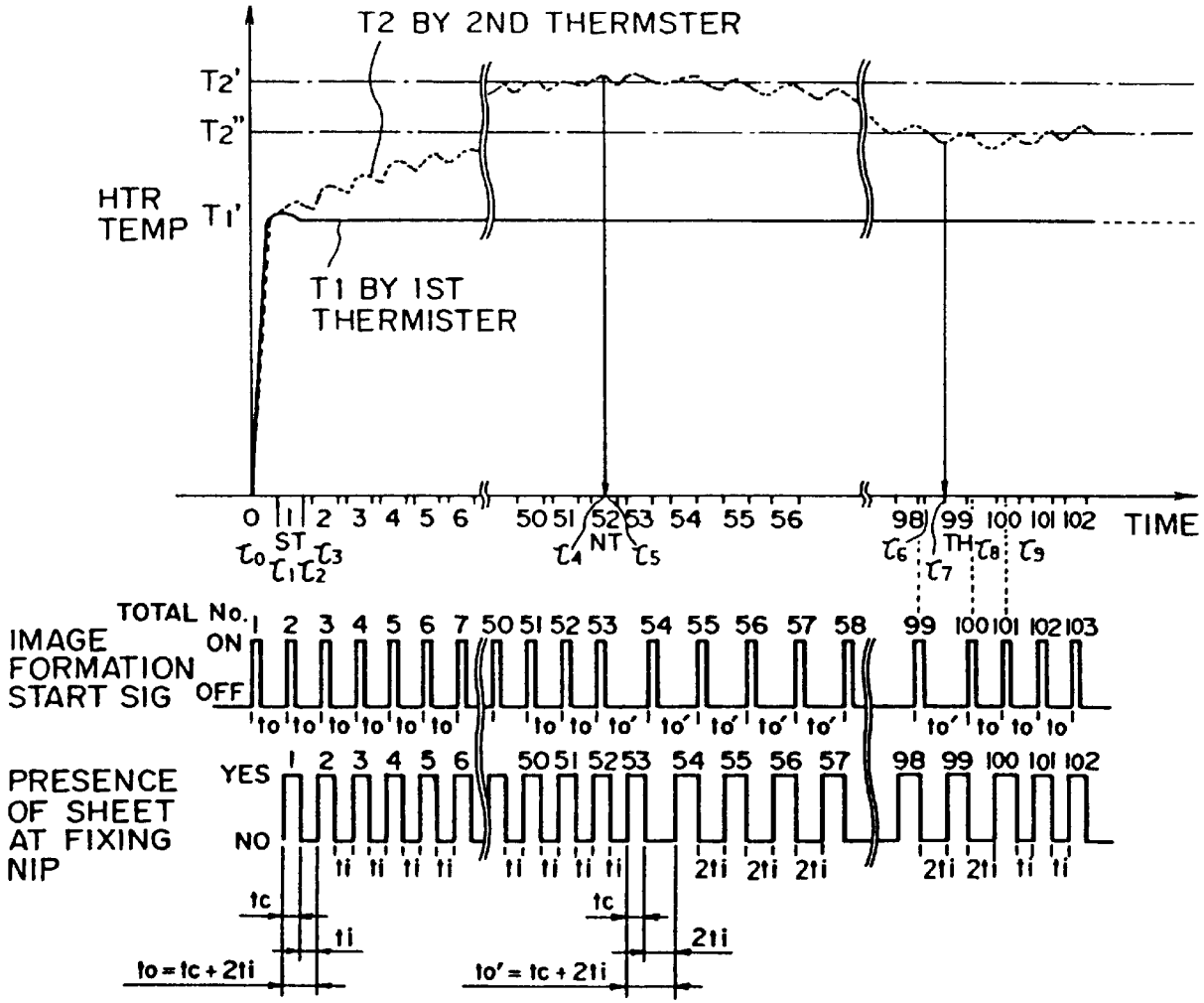
FIG. 20 is a drawing showing the temperature fluctuation and its timing for another embodiment of the present invention.

FIGURE 20:
"THERMSTER" should read --THERMISTER--.

COLUMN 7,
Line 64, "t0" should read --$t_o$--.

COLUMN 8,
Line 45, "above" should read --above- --.

COLUMN 10,
Line 18, " urface" should read --surface--.

COLUMN 11,
Line 28, "T224T2'" should read -T2≥T2'-.

UNITED STATES PATENT AND TRADEMARK OFFICE

CERTIFICATE OF CORRECTION

PATENT NO. : 5,915,146

DATED : June 22, 1999

INVENTOR(S): KENSAKU KUSAKA, ET AL.

It is certified that error appears in the above-identified patent and that said Letters Patent is hereby corrected as shown below:

COLUMN 14,
Line 14, "radiation).to" should read -radiation) to-;
Line 47, "Δreaches" should read --Δ reaches-; and
Line 50, $\sigma_4$." should read --$\tau_4$.-.

COLUMN 16,
Line 51, "ti," should read -$t_i$,-.

COLUMN 19,
Line 55, "the." should read -the-.

COLUMN 20,
Line 52, "A" should read --Δ--.

COLUMN 21,
Line 3, $g/m_2$" should read -$g/m^2$-.

COLUMN 25,
Line 8, "53th" should read -53rd-; and
Line 10, "A" should read --Δ--.

UNITED STATES PATENT AND TRADEMARK OFFICE

CERTIFICATE OF CORRECTION

PATENT NO. : 5,915,146

DATED : June 22, 1999

INVENTOR(S): KENSAKU KUSAKA, ET AL.

It is certified that error appears in the above-identified patent and that said Letters Patent is hereby corrected as shown below:

COLUMN 27,
Line 53, "are" should be deleted.

COLUMN 31,
Line 18, "572" should read -$57_2$-; and
Line 21, "572" should read -$57_2$-.

COLUMN 32,
Line 63, "temperatures," should read -temperature,-.

Signed and Sealed this

Twenty-first Day of December, 1999

*Attest:*

Q. TODD DICKINSON

*Attesting Officer*

*Acting Commissioner of Patents and Trademarks*